US005547824A

United States Patent [19]

Mihayashi et al.

[11] Patent Number: 5,547,824

[45] Date of Patent: Aug. 20, 1996

[54] SILVER HALIDE COLOR PHOTOGRAPHIC LIGHT-SENSITIVE MATERIAL CONTAINING COMPOUNDS CAPABLE OF RELEASING PHOTOGRAPHICALLY USEFUL GROUPS AND A SPECIFIC SILVER IODOBROMIDE

[75] Inventors: Keiji Mihayashi; Atsuhiro Ohkawa, both of Minami-Ashigara, Japan

[73] Assignee: Fuji Photo Film Co., Ltd., Kanagawa, Japan

[21] Appl. No.: 909,684

[22] Filed: Jul. 7, 1992

[30] Foreign Application Priority Data

Jul. 16, 1991 [JP] Japan ..... 3-199863

[51] Int. Cl.[6] ..... G03C 1/08; G03C 1/46; G03C 1/005; G03C 7/26

[52] U.S. Cl. ..... 430/544; 430/223; 430/955; 430/957; 430/543; 430/505; 430/567

[58] Field of Search ..... 430/544, 233, 430/567, 551, 505, 543, 549, 955, 957

[56] References Cited

U.S. PATENT DOCUMENTS

| | | | |
|---|---|---|---|
| 4,668,614 | 5/1987 | Takada et al. | 430/567 |
| 4,835,095 | 5/1989 | Ohashi et al. | 430/567 |
| 4,861,701 | 8/1989 | Burns et al. | 430/543 |
| 4,916,053 | 4/1990 | Ohshima et al. | 430/567 |
| 5,118,597 | 6/1992 | Mihayashi et al. | 430/957 |

FOREIGN PATENT DOCUMENTS

| | | | |
|---|---|---|---|
| 0365348 | 4/1990 | European Pat. Off. | 430/957 |
| 0438129 | 7/1991 | European Pat. Off. | 430/543 |
| 0438150 | 7/1991 | European Pat. Off. | 430/543 |
| 60-218645 | 11/1985 | Japan . | |
| 62-168146 | 7/1987 | Japan | 430/955 |

*Primary Examiner*—Charles L. Bowers, Jr.
*Assistant Examiner*—J. Pasterczyk
*Attorney, Agent, or Firm*—Sughrue, Mion, Zinn, Macpeak & Seas

[57] ABSTRACT

Disclosed is a silver halide color photographic light-sensitive material which contains an emulsion in which the silver iodide surface content of the silver halide grains is less than the average silver iodide content of the grains. The material also contains a compound capable of releasing two photographically useful groups through at least one timing group and/or a compound capable of releasing a photographically useful group through two timing groups.

15 Claims, No Drawings

SILVER HALIDE COLOR PHOTOGRAPHIC LIGHT-SENSITIVE MATERIAL CONTAINING COMPOUNDS CAPABLE OF RELEASING PHOTOGRAPHICALLY USEFUL GROUPS AND A SPECIFIC SILVER IODOBROMIDE

BACKGROUND OF THE INVENTION

1. Field of the Invention

The present invention relates to a silver halide color photographic light-sensitive material and, more particularly, to a silver halide color photographic light-sensitive material which contains a silver halide emulsion having a high content of silver iodide and a novel, development inhibitor-releasing compound, which excels in sensitivity, sharpness, color reproducibility, and graininess, and whose has its photographic properties are little changed while being stored.

2. Description of the Related Art

There is a demand for a silver halide color photographic light-sensitive material, more particularly, a color light-sensitive material for taking photogroup which has high light-sensitivity and excels in sharpness, color reproduction and graininess, whose photographic properties are little changed while being stored.

As a means for improving the sharpness and color reproduction of such a light-sensitive material, a timing DIR coupler which releases a development-inhibiting compound through two timing groups is known. DIR couplers of this type are disclosed in, for example, JP-A-51-146828, ("JP-A" means Published Unexamined Japanese Patent Application), JP-A-60-218645, JP-A-61-156127, JP-A-63-37346, JP-A-1-280755, JP-A-1-219747, JP-A-2-230139, Laid-open European Patent Applications 348139, 354532, and 403019. The use of a timing DIR coupler indeed enhances inter-layer effect or edge effect, and improves sharpness and color reproduction to some extent. However, neither the inter-layer effect nor the edge effect can be sufficient. This is because the release of the development-inhibitor is substantially only once, or the release timing is not appropriate. Further, the photographic properties oflight-sensitive materials containing these couplers have their photographic properties are changed greatly while being stored.

Light-sensitive materials which contain silver halide grains having a distinct stratiform structure, containing high AgI-content silver bromoidodide, and having a high average AgI content are disclosed in JP-A-60-143331, JP-A-1-186938, JP-A-1-269935, and JP-A-2-28637. According to these disclosures disclosure, high sensitive and good grained light-sensitive materials were produced. But even with the combination of the DIR couplers and them, the level of color reproduction and sharpness is still insufficient.

SUMMARY OF THE INVENTION

A first object of the present invention is to provide a light-sensitive material which has high light-sensitivity and excels in graininess, color reproduction and sharpness.

A second object of the invention is to provide a light-sensitive material whose photographic properties are little changed while being stored.

A third object of this invention is to provide a light-sensitive material which can be low cost and produce a high-quality image, by using an emulsion having good graininess and a timing DIR coupler which performs its function with addition of a small amount of it.

These objects of the invention have been achieved by the silver halide color light-sensitive material specified below.

According to the invention, there is provided a silver halide color photographic light-sensitive material which comprises a support and at least one light-sensitive emulsion layer on the support. The emulsion layer contains silver halide grains having a lower silver iodide content in its surface than the average silver iodide content of the grains, and at least one emulsion layer contains a compound represented by the following formula (I) and/or (II).

Formula (I)

$$A—(L_1)_j—(L_2)_m[—(L_3)_n\text{-}PUG]_s$$

wherein A is a coupler residue or a redox group, $L_1$ and $L_3$ are divalent timing groups, $L_2$ is a timing group having 3 or more valence, PUG is a photographically useful group, j and n indicate independently 0, 1, or 2, m is 1 or 2, s indicates 2 or a greater integer obtained by subtracting 1 from the valence number of $L_2$, if there are two or more $L_1$, $L_2$ or $L_3$ in the molecule, they can either be identical or different, and if there are two or more PUGs in the molecule, they can either be identical or different;

Formula (II)

$$A\text{–}L_4—L_5\text{-}PUG$$

where A and PUG are as defined in formula (I); $L_4$ is —OCO—, —OSO—, —$OSO_2$—, —OCS—, —SCO—, —SCS—, or —$WCR_{11}R_{12}$—, where W is an oxygen, a sulfur or tertiary amino group (—$NR_{13}$—), $R_{11}$ and $R_{12}$ are independently a hydrogen or a substituent group, $R_{13}$ is a substituent group, and $R_{11}$, $R_{12}$ and $R_{13}$ can be divalent groups and can form a ring stracture by linking together, $L_5$ is a group which releases PUG by electron transfer along a conjugated system or a group defined by $L_4$.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DETAILED DESCRIPTION OF THE PREFERRED EMBODIMENTS

The compounds represented by the formulas (I) and (II) will be described in detail.

A in the formula (I) is a coupler residue or an oxidation-reduction group. Examples of the coupler residue are: an yellow coupler residue (e.g., a open-chained ketomethylene type coupler residue such as acyl acetanilide or malondianilide); a magenta coupler residue (e.g., a coupler residue such as a 5-pyrazolone-type, a pyrazoloazole-type, or an imidazopyrazole-type); a cyan coupler residue (e.g., a phenol-type, a naphthol-type, an imidazole-type disclosed in Laid-open European Patent Application 249,453, or a pyrazolopyrimidine-type disclosed in Laid-open European Patent Application 304,001); and a colorless compound forming coupler residue (e.g., an indanone-type one or an acetophenone-type one). Other examples of the coupler residue may be the heterocyclic coupler residues which are disclosed in U.S. Pat. Nos. 4,315,070, 4,183,752, 4,174,969, 3,961,959 and U.S. Pat. No. 4,171,223, and JP-A-52-82423.

If A in the formula (I) is a redox group, this is a group that can be cross-oxidized by the oxidized form of developing agent. Examples of the redox group are: hydroquinones, catechols, pyrogallols, 1,4-naphthohydroquinones, 1,2-naphthohydroquinones, sulfonamidophenols, and sulfonamidonaphthols. These groups can be those disclosed in JP-A-61-230135, JP-A-62-251746, JP-A-61-278852, U.S. Pat. Nos. 3,364,022, 3,379,529, 3,639,417, 4,684,604, and J. Org. Chem., 29, 588 (1964).

Preferable examples of A may be represented by the following formulas (Cp-1), (Cp-2), (Cp-3), (Cp-4), (Cp-5), (Cp-6), (Cp-7), (Cp-8), (Cp-9), (Cp-10), and (Cp-11). These couplers were preferable because of having high coupling rates.

Formula (Cp-1)

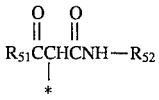

Formula (Cp-2)

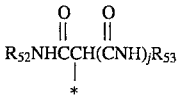

Formula (Cp-3)

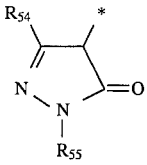

Formula (Cp-4)

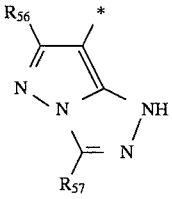

Formula (Cp-5)

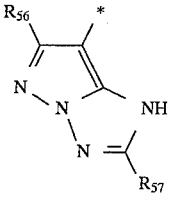

Formula (Cp-6)

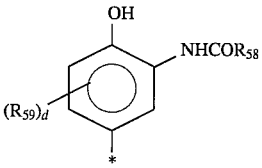

Formula (Cp-7)

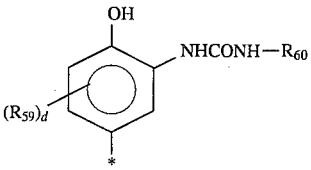

-continued

Formula (Cp-8)

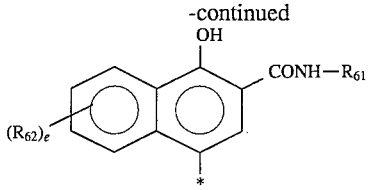

Formula (Cp-9)

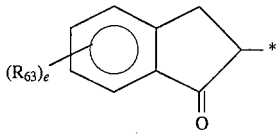

Formula (Cp-10)

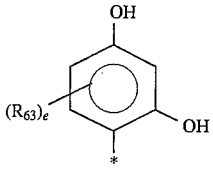

Formula (Cp-11)

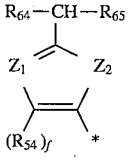

In the formulas (Cp-1) to (Cp-11), the mark * represents the position where the groups linked by $L_1$ are coupled to in the formula (I), and also the position where $L_4$ etc. seq. are coupled to in the formula (II).

When $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$, $R_{63}$, $R_{64}$, or $R_{65}$ shown in the formulas (Cp-1) to (Cp-11) include a nondiffusion group, $R_{51}$ to $R_{65}$ are selected from a group in which the total carbon atoms are 8 to 40, preferably 10 to 30. Otherwise, $R_{51}$ to $R_{65}$, in which the total carbon atoms are 15 or less carbon atoms are preferable.

$R_{51}$ to $R_{65}$, k, d, e, and f, shown in the formulas (Cp-1) to (Cp-11), will be explained in detail. In the following explanation, $R_{41}$ is an aliphatic group, an aromatic group or a heterocyclic group, and $R_{42}$ is an aromatic group or a heterocyclic group. $R_{43}$, $R_{44}$, and $R_{45}$ are hydrogen, aliphatic groups, aromatic groups, or heterocyclic groups.

$R_{51}$ is identical to $R_{41}$. $R_{52}$ and $R_{53}$ are identical to $R_{42}$. k is 0 or 1. $R_{54}$ is identical to $R_{41}$; it is $R_{41}CON(R_{43})$—, $R_{41}R_{43}N$—, $R_{41}SO_2N(R_{43})$—, $R_{41}S$—, $R_{43}O$—, $R_{45}N(R_{43})CON(R_{44})$—, or :::C—. $R_{55}$ is a group identical to $R_{41}$. $R_{56}$ and $R_{57}$ are groups of the same meaning as $R_{43}$; they are $R_{41}S$—, $R_{43}O$—, $R_{41}CON(R_{43})$—, or $R_{41}SO_2N(R_{43})$—. $R_{58}$ is identical to $R_{41}$. $R_{59}$ is identical to $R_{41}$; it is $R_{41}CON(R_{43})$—, $R_{41}OCON(R_{43})$—, $R_{41}SO_2N(R_{43})$—, $R_{43}R_{44}NCON(R_{45})$—, $R_{41}O$—, $R_{41}S$—, a halogen atom, or $R_{41}R_{43}N$—. d is an integer 0 to 3. If d is plural, the plural groups $R_{59}$ may be same or different substituents and can form a ring structure by linking together. Example of the ring formation may include the formation of pyridine ring or a pyrrole ring. $R_{60}$ and $R_{61}$ are groups of the same meaning as $R_{41}$. $R_{62}$ is identical to $R_{41}$; it is $R_{41}OCONH$—, $R_{41}SO_2NH$—, $R_{43}R_{44}NCON(R_{45})$—, $R_{43}R_{44}NSO_2N(R_{45})$—, $R_{43}O$—, $R_{41}S$—, a halogen atom, or $R_{41}R_{43}N$—. $R_{63}$ is a group of the same meaning as $R_{41}$; it is $R_{43}CON(R_{45})$—, $R_{43}R_{44}NCO$—, $R_{41}SO_2N(R_{44})$—, $R_{43}R_{44}NSO_2$—, $R_{41}SO_2$—, $R_{43}OCO$—, $R_{43}O$—$SO_2$—, a halogen atom, nitro group, cyano group, or $R_{43}CO$—. The notation of e is an integer ranging from 0 to 4. If plural $R_{62}$ or $R_{63}$ present in above formula (Cp-1) to (Cp-11), these groups are identical or different, respectively. $R_{64}$ and $R_{65}$ are $R_{43}R_{44}NCO$—, $R_{41}CO$—, $R_{43}R_{44}NSO_2$—, $R_{41}OCO$—, $R_{41}SO_2$—, nitro group, or cyano group. $Z_1$ is a nitrogen or $=C(R_{66})$—, where $R_{66}$ is hydrogen or a group of the same meaning as $R_{63}$. $Z_2$ is a sulfur or an oxygen. f is 0 or 1.

The aliphatic groups are aliphatic hydrocarbon group containing 1 to 32, preferably 1 to 22 carbon atoms, which may be saturated or unsaturated, chain or cyclic, and straight or branched chain. Typical examples of the aliphatic groups are: methyl, ethyl, propyl, isopropyl, butyl, (t)-butyl, (i)-butyl, (t)-amyl, hexyl, cyclohexyl, 2-ethylhexyl, octyl, 1,1,3,3-tetramethylbutyl, decyl, dodecyl, hexadecyl, or octadecyl.

The aromatic groups can contain 6 to 20 carbon atoms, and can preferably be the groups selected from substituted or unsubstituted phenyl groups and substituted or unsubstituted naphthyl groups.

The heterocyclic groups may be contain 1 to 20 and preferably 1 to 7, and may preferably be substituted or unsubstituted 3- to 8-membered heterocyclic ring which include a heteroatom selected from nitrogen, oxygen or sulfur. Typical examples of the heterocyclic groups are: 2-pyridyl, 2-furyl, 2-imidazolyl, 1-indolyl, 2,4-dioxo-1,3-imidazolidin-5-yl, 2-benzoxazolyl, 1,2,4-triazol-3-yl or 4-pyrazolyl. When the aliphatic hydrocarbon groups, the aromatic groups and the heterocyclic groups described above have substitutent groups, typical examples of one, are a halogen atom, $R_{47}O$—, $R_{46}S$—, $R_{47}CON(R_{48})$—, $R_{47}N(R_{48})CO$—, $R_{46}OCON(R_{47})$—, $R_{46}SO_2N(R_{47})$—, $R_{47}R_{48}NSO_2$—, $R_{46}SO_2$—, $R_{47}OCO$—, $R_{47}R_{48}NCON(R_{49})$—, group of the same meaning as $R_{46}$, $R_{46}COO$—, $R_{47}OSO_2$—, cyano group, or nitro group. $R_{46}$ is a aliphatic group, aromatic group, or heterocyclic group. $R_{47}$, $R_{48}$, and $R_{49}$ are an aliphatic group, aromatic group, heterocyclic group, or a hydrogen. The aliphatic group, the aromatic group, and the heterocyclic group have the meanings defined above.

Preferable ranges for $R_{51}$ to $R_{65}$, k, d, e, and f will be described.

Preferably, $R_{51}$ is an aliphatic group or an aromatic group, $R_{52}$ and $R_{55}$ are preferably aromatic groups, and $R_{53}$ is an aromatic group or heterocyclic group.

In the formula (Cp-3), $R_{54}$ is preferably $R_{41}CONH$— or $R_{41}R_{43}N$—, $R_{56}$ and $R_{57}$ are preferably aliphatic groups, aromatic groups, $R_{41}O$—, or $R_{41}S$—, and $R_{58}$ is preferably an aliphatic group or an aromatic group. In the formula (Cp-6), $R_{59}$ is preferably a chlorine, an aliphatic group, or $R_{41}CONH$—, d is preferably 1 or 2, and $R_{60}$ is preferably an aromatic group. In the formula (Cp-7), $R_{59}$ is desirably $R_{41}CONH$—, d is preferably 1, and $R_{61}$ is preferably an aliphatic group or an aromatic group. In the formula (Cp-8), e is preferably 0 or 1, $R_{62}$ is preferably $R_{41}OCONH$—, $R_{41}CONH$— or $R_{41}SO_2NH$—, and these groups located at 5-position on the naphthol ring are preferred. In the formula (Cp-9), $R_{63}$ is preferably $R_{41}CONH$—, $R_{41}SO_2NH$—, $R_{41}R_{43}NSO_2$—, $R_{41}SO_2$—, $R_{41}R_{43}NCO$—, a nitro group, or cyano group, and e is preferably 1 or 2. In the formula (Cp-10), $R_{63}$ is preferably $(R_{43})_2NCO$—, $R_{43}OCO$— or $R_{43}CO$—, and e is preferably 1 or 2. In the formula (Cp-11), $R_{54}$ is preferably an aliphatic group, an aromatic group, or $R_{41}CONH$—, and f is preferably 1. Furthermore, A containing nondiffusion group is preferred.

In the formula (I), preferable $L_1$ groups are described below:

(1) Group Utilizing Cleavage of Hemiacetal

Examples of this group are disclosed in, for example, U.S. Pat. No. 4,146,396, JP-A-60-249148, and JP-A-60-249149. This group is represented by the following formula (T-1), wherein mark * indicates the position where the group bonds to A or $L_1$ of the compound represented by the formula (I), and mark ** indicates the position where the group bonds to $L_1$ or $L_2$ of the compound (I).

Formula ( T-1)

$$*—(W—CR_{11}(R_{12}))_t—**$$

In this formula, W is an oxygen, a sulfur, or —$NR_{13}$—, $R_{11}$ and $R_{12}$ are hydrogen or substituents, $R_{13}$ is a substituent, t is 1 or 2. If t is 2, the two —W—$CR_{11}(R_{12})$— may be either identical or different. If $R_{11}$ and $R_{12}$ are substituents typical examples of these and $R_{13}$ include $R_{15}$—, $R_{15}CO$—, $R_{15}SO_2$—, $R_{15}(R_{16})NCO$—, and $R_{15}(R_{16})NSO_2$—, where $R_{15}$ is an aliphatic group, aromatic group, or heterocyclic group, and $R_{16}$ is a hydrogen, aliphatic group, aromatic group, or heterocyclic group. In the case of $R_{11}$, $R_{12}$, and $R_{13}$ are divalent groups, and these groups can form a ring structure by linking together. Typical examples of the group represented in the formula (T-1) are as follows:

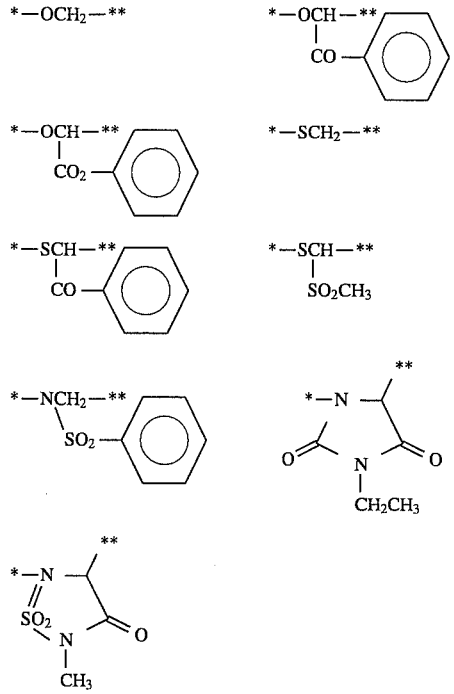

(2) Groups Causing Cleavage Reaction by Using Intramolcular Nucleophilic Substitution Reaction An example of this group is the timing group disclosed in U.S. Pat. No. 4,248,292. This group is represented by the following formula (T-2):

Formula (T-2)

$$* —Nu—Link—E—**$$

In the formula (T-2), Nu is a nucleophilic group, e.g., an oxygen or a sulfur, E is electrophilic group which can cleave the bond at the position ** when E is subjected to the nucleophilic attack by Nu, and Link is a linking group for sterically relating Nu and E to undergo intramolecular nucleophilic substitution reaction. Typical examples of the group represented by the formula (T-2) are as follows:

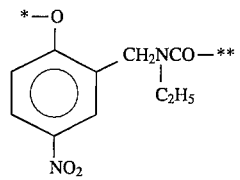

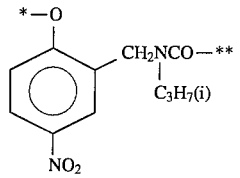

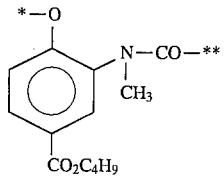

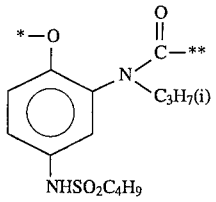

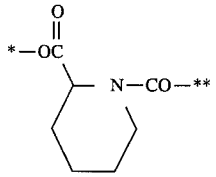

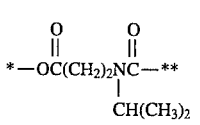

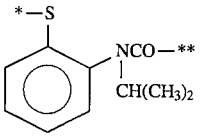

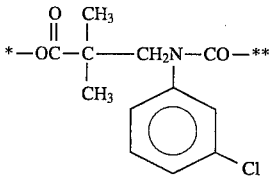

(3) Groups Causing a Cleavage Reaction by Using an Electron Transfer Reaction along a Conjugated System Examples of this group are disclosed in, for example, U.S. Pat. Nos. 4,409,323 and 4,421,845, JP-A-57-188035, JP-A-58-98728, JP-A-58-209736, and JP-A-58-209738. This group is represented by the following formula (T-3):

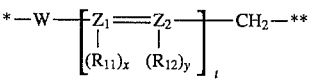

Formula (T-3)

In the formula (T-3), marks * and , W, $R_{11}$, $R_{12}$ and t are as defined in the formula (T-1). However, $R_{11}$ and $R_{12}$ can bond together to form a part of a benzene ring or a heterocyclic ring. In the formula (T-3), $Z_1$ and $Z_2$ are independently a carbon or a nitrogen, and X and y are integers, each being 0 or 1. If $Z_1$ is a carbon atom, x is 1. If $Z_1$ is a nitrogen, x is 0. $Z_2$ has the same relationship with y as $Z_1$ with x. In the formula (T-3), t is 1 or 2; if t is 2, the two $—[Z_1(R_{11})_x=Z_2(R_{12})_y]—$ can either be identical or different. The $—CH_2—$ group, which is adjacent to the position , can be substituted by alkyl group having 1 to 6 carbon atoms or by phenyl group.

Typical examples of the group represented by the formula (T-3) are as follows:

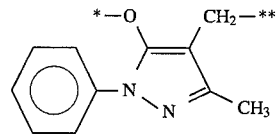

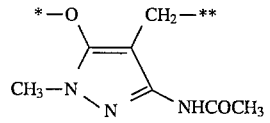

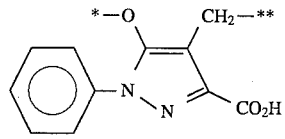

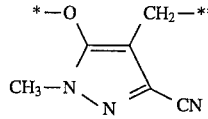

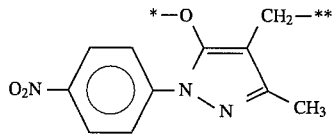

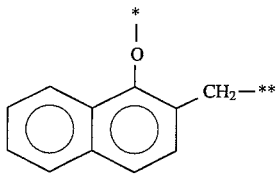

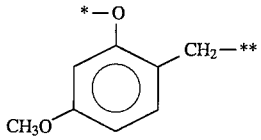

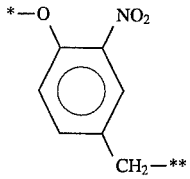

-continued

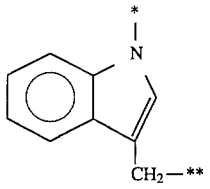

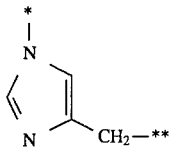

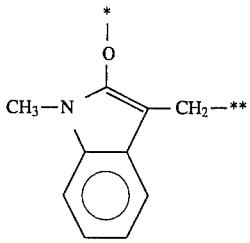

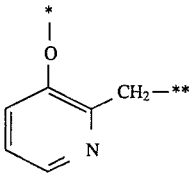

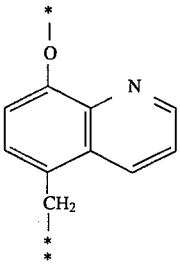

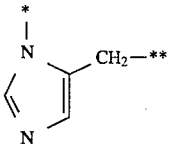

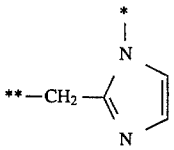

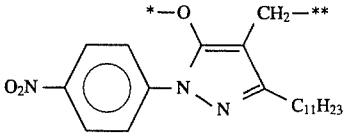

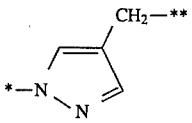

(4) Groups Utilizing Cleavage Reactions due to Hydrolysis of Ester

An example of this group is the linking group disclosed in, for example, West German Laid-Open Patent Application 2,626,315. For example there are two types of groups represented by the following formulas (T-4) and (T-5):

Formula (T-4)

*—OCO—**

Formula (T-5)

* —SCS—**

(5) Groups Utilizing Cleavage Reactions of Iminoketals

An example of this group is the linking group disclosed in U.S. Pat. No. 4,546,073. This group is represented by the following formula (T-6):

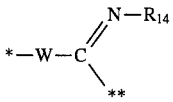

Formula (T-6)

In the formula (T-6), marks * and **, and W are as described in the formula (T-1). $R_{14}$ are identical with $R_{13}$. Typical examples of the group represented by the formula (T-6) are as follows:

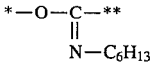

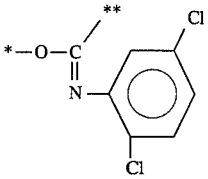

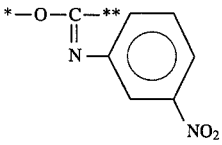

Preferable examples of $L_1$ contain the formulas (T-1) to (T-5), and more preferably (T-1), (T-3) and (T-4). j is preferably 0 or 1.

In the formula (I), $L_2$ is a timing group having a valence of 3 or more. Preferable $L_2$ groups are represented by the following formulas (T-$L_1$) and (T-$L_2$):

Formula (T-$L_1$)

$$—W—[Z_1(R_{11})_x{=}Z_2(R_{12})_y]_t—CH_2—**$$

In the formula (T-$L_1$), W, $Z_1$, $Z_2$, $R_{11}$, $R_{12}$, x, y and t are as defined in the formula (T-3). Marks * and ** indicate the positions where the group bonds to the A—$(L_1)_1$— group and —$(L_3)_n$-PUG group shown in the formula (I), respectively. However, if plural $R_{11}$ and $R_{12}$ are present in (T-$L_1$), at least one of the groups represents substituted or unsubstituted methylene groups which bond to —$(L_3)_n$-PUG.

A preferred example for formula (T-$L_1$) is one wherein W is a nitrogen. A more preferred example is one wherein W and $Z_2$ bond together to form a 5-membered ring. The most preferable example is one in which W and $Z_2$ bond together to form an imidazole ring or a pyrazole ring.

Formula (T-$L_2$)

$$-N-(Z_3-**)_2$$

In the formula (T-$L_2$), marks * and ** are as defined in the formula (T-$L_1$), $Z_3$ represents a substituted or an unsubstituted methylene group, and two groups of $Z_3$ can be either identical or different, and can bond to form a ring.

Typical examples of the timing groups represented by the formulas (T-$L_1$) and (T-$L_2$) are as follows. However, the timing groups used in the invention are not limited to these examples.

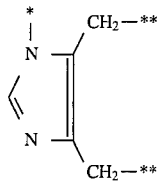

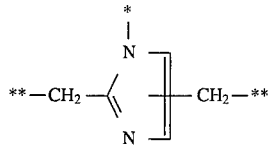

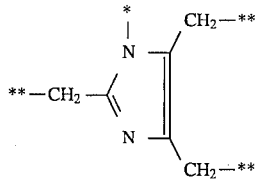

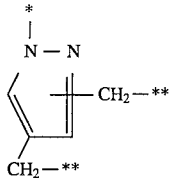

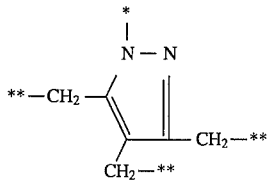

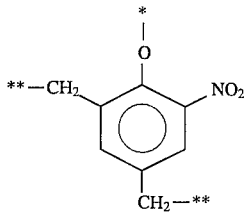

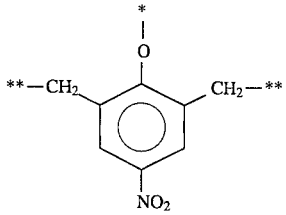

-continued

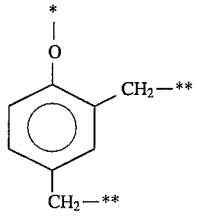

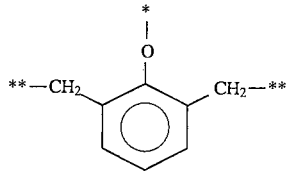

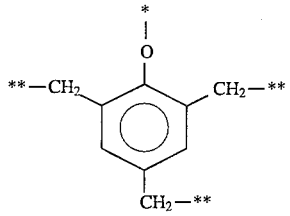

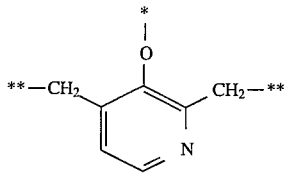

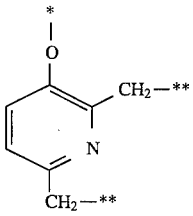

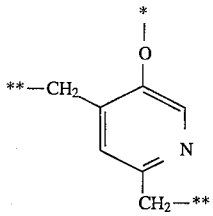

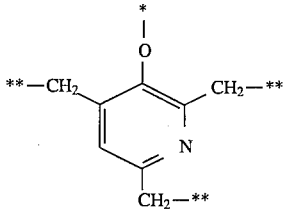

-continued

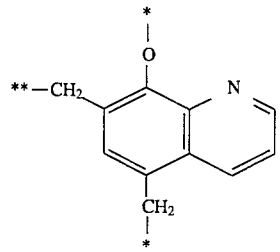

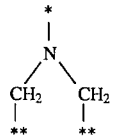

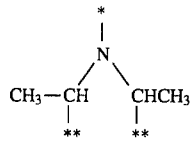

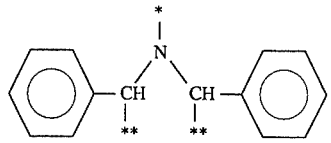

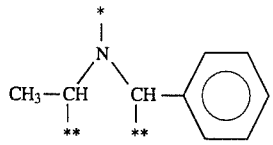

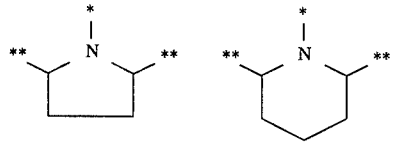

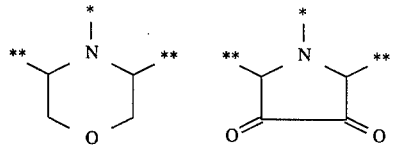

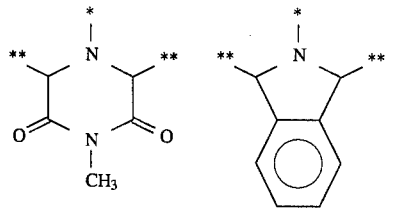

The timing groups described above can have substituents. Examples of these substituents are: an alkyl group (e.g., methyl, ethyl, isopropyl, t-butyl, hexyl, methoxymethyl, methoxyethyl, chloroethyl, cyanoethyl, nitroethyl, hydroxypropyl, carboxyethyl, dimethylaminoethyl, benzyl, or phenetyl); an aryl group (e.g., phenyl, naphthyl, 4-hydroxyphenyl, 4-cyanophenyl, 4-nitrophenyl, 2-methoxyphenyl, 2,6-dimethylphenyl, 4-carboxyphenyl, or 4-sulfophenyl); a heterocyclic group (e.g., 2-pyridyl, 4-pyridyl, 2-furyl, 2-thienyl or 2-pyrrolyl; a halogen atom (e.g., chloro or bromo); a nitro group; an alkoxy group (e.g., methoxy, ethoxy, or isopropoxy); an aryloxy group (e.g., phenoxy); an alkylthio group (e.g., methylthio, isopropylthio, or t-butylthio); an arylthio group (e.g., phenylthio); an amino group (e.g., amino, dimethylamino, or diisopropylamino); an acylamino group (e.g., acetylamino or benzoylamino); a sulfonamido group (e.g., methanesulfonamido or benzenesulfonamido); a cyano group; a carboxyl group; alkoxycarbonyl group (e.g., methoxycarbonyl or ethoxycarbonyl); an aryloxycarbonyl group (e.g., phenoxycarbonyl); and an carbamoyl group (e.g., N-ethylcarbamoyl or N-phenylcarbamoyl).

Of these substituent groups, an alkyl group, a nitro group, an alkoxy group, an alkylthio group, a amino group, an acylamino group, a sulfonamido group, an alkoxycarbonyl group, and a carbamoyl group are preferable.

In the formula ($T\text{-}L_1$), the $—CH_2—$ group, which is adjacent to the position **, can be substituted by alkyl or phenyl group having 1 to 6 carbon atoms. In the formula (I), n is preferably 1.

In the formula (I), the group represented by $L_3$ is identical to $L_1$. In the formual (I), n is preferably 0 or 1, more preferably 0.

The photographically useful group, represented as PUG in the formula (I), is an development inhibitor, a dye, a fogging agent, a developing agent, a coupler, a bleaching accelerator, or a fixing agent. Examples given as the preferable photographically useful groups are the group disclosed in U.S. Pat. No. 4,248,962 (i.e., in this patent, the group represented by formula PUG), the dye disclosed in JP-A-62-49353 (i.e., in the specifications, the leaving group released from a coupler), the development inhibitor described in U.S. Pat. No. 4,477,563, and the breaching accelerators disclosed in JP-A-61-201247 and JP-A-2-55 (i.e., in the specifications, the leaving groups released from couplers). In the present invention, a development inhibitor is particularly preferable as photographically useful group.

Examples given as the preferable development inhibitor include the groups represented by the following formulas (INH-1) to (INH-13):

(INH-1)

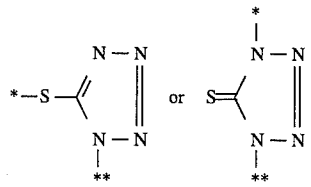

(INH-2)

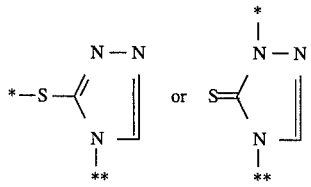

(INH-3)

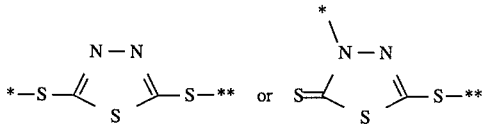

(INH-4)

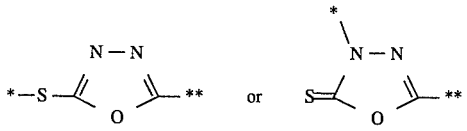

-continued (INH-5)

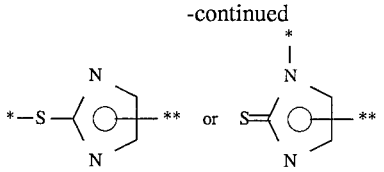

(INH-6)

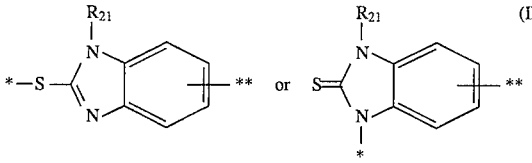

(INH-7)

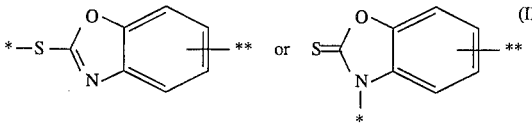

(INH-8)

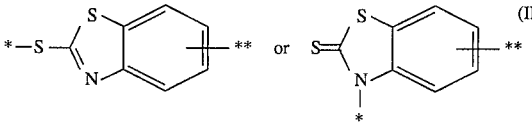

(INH-9)

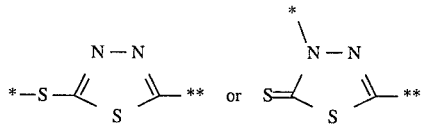

(INH-10)

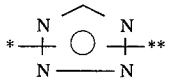

(INH-11)

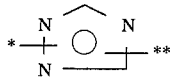

(INH-12)

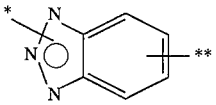

(INH-13)

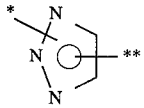

In the formula (INH-6), $R_{21}$ represents hydrogen, or substituted or unsubstituted hydrocarbon a group (e.g., methyl, propyl, or phenyl).

In the formulas (INH-1) to (INH-13), the mark * indicates the position where the development inhibitor bonds to the group $L_2$ or $L_3$ shown in the formula (I), and the mark ** indicates the position where the development inhibitor bonds to a substituent. Examples of the substituents can include a substituted or unsubstituted aliphatic group, an aryl group, or a heterocyclic group, which is preferred because these groups can be decomposed in a process solution during photographic processing.

More concretely, examples of the aliphatic group are: methyl, ethyl, propyl, butyl, hexyl, decyl, isobutyl, t-butyl, 2-ethylhexyl, 2-methylthioethyl, benzyl, 4-methoxybenzyl, phenethyl, 1-methoxycarbonylethyl, propyloxycarbonylmethyl, methoxycarbonyl, phenoxycarbonyl, 2-(propyloxycarbonyl)ethyl, butyloxycarbonylmethyl, pentyloxycarbonylmethyl, 2-cyanoethyloxycarbonylmethyl, 2,2-dichloroethyloxycarbonylmethyl, 3-nitropropyloxycarbonylmethyl, 4-nitropropyloxycarbonylmethyl, 2,5-dioxo-3,6-dioxa decyl, and a group represented by $—CO_2CH_2CO_2R_{100}$, where $R_{100}$ is an unsubstituted alkyl group having 1 to 8 carbon atoms.

Typical examples of the aryl group are: phenyl, naphthyl, 4-methoxycarbonylphenyl, 4-ethoxycarbonylphenyl, 2-methylthiophenyl, 3-methoxycarbonylphenyl, and 4-(2-cyanoethyloxycarbonyl)phenyl.

Examples of the heterocyclic group are: 4-pyridyl, 3-pyridyl, 2-pyridyl, 2-furyl, and 2-tetrahydropyranyl.

In INH described above, (INH-1), (INH-2), (INH-3), (INH-4), (INH-9) and (INH-12) are preferable, and (INH-1), (INH-2), (INH-3) are particularly preferred.

Substitutent which bonds to INH is preferably an aliphatic group or a substituted or unsubstituted phenyl group.

Particularly preferable compounds represented by the formula (I) are the compounds which are represented by the following formulas (Ia) and (Ib):

Formula (Ia)

$$A—(L_1)_j—W—[Z_1(R_{11})_x{=}Z_2(R_{12})_y]_i—CH_2\text{-}PUG$$

Formula (Ib)

$$A—(L_1)—N—(Z_3\text{-}PUG)_2$$

All symbols used in the formulas (Ia) and (Ib) are as defined in the formulas (I), ( T-$L_1$), and ( T-$L_2$). In the formula (Ia), j is preferably 0 or 1. In the formulas (Ia) and (Ib), preferred $L_1$ is —OC(=O)—, and preferred PUG is a development inhibitor.

If the photographically useful groups have different functions, the timing group is not one which utilizes intramolecular nucleophilic substitution. The term "function" of a photographically useful group means the function exhibited by a development inhibitor, that of a dye, that of a fogging agent, that of a developing agent, that of a coupler, that of a bleach accelerator, or that of a fixing agent. It is particularly preferred that two or more PUGs released from the same compound are identical development inhibitors.

The compound represented by the formula (II) will now be described. In the formula (II), A and PUG are of the same meaning as defined in conjunction with the formula (I). $L_4$ is —OCO—, —OSO—, $—OSO_2—$, —OCS—, —SCO—, —SCS—, $—WCR_{11}R_{12}—$, where W, $R_{11}$, and $R_{12}$ are as defined in the formula (T-1) described in $L_1$ in the compound represented by the formula (I).

If $L_4$ is $—WCR_{11}R_{12}—$, it is preferred that W be an oxygen or a tertiary amino group. More preferably, $L_4$ is $—OCH_2—$, or $L_4$ is $—WCR_{11}R_{12}—$, where W and $R_{11}$ or $R_{12}$ form a ring.

If $L_4$ is a group other than $—WCR_{11}R_{12}—$, it is preferably —OCO—, —OSO—, or $—OSO_2—$, in which —OCO— is most preferred.

The group represented by $L_5$ is either a group which releases PUG by electron transfer along a conjugated system, or a group which is defined as $L_4$. The group releasing PUG by electron transfer along the conjugated system is identical to the group represented by the formula (T-3), explained to $L_1$ in the formula (I). Preferable $L_5$ is a group which releases PUG as electron transfer along a conjugated system. More preferable $L_5$ is a group which can bond to $L_4$ through a nitrogen.

Among the compounds represented by the formula (II), those which are represented by the following formulas (III) and (IV) are preferable.

Formula (III)

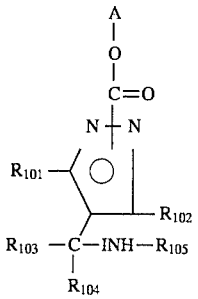

In the formula (III), A is identical to A in the formula (I). $R_{101}$ and $R_{102}$ are independently a hydrogen or a substituent group. $R_{103}$ and $R_{104}$ are independently a hydrogen or a substituent group. INH is a group which can inhibit development. $R_{105}$ is an unsubstituted phenyl or primary alkyl group, or a primary alkyl group substituted by a group other than an aryl group. At least one of groups $R_{101}$ to $R_{104}$ is a substituent group other than a hydrogen.

Formula (IV)

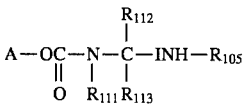

The compounds of the formula (IV) will be described in detail. In the formula (IV), A, INH, and $R_{105}$ are identical as in the formula (III), and $R_{111}$, $R_{112}$, and $R_{113}$ are independently a hydrogen or an organic residual group. Any two of $R_{111}$, $R_{112}$, and $R_{113}$ can be divalent groups to form a ring by bonding together.

The compound of the formula (III) will be described in more detail.

In the formula (III), A is defined as in the formula (I), and $R_{101}$ and $R_{102}$ are independently a hydrogen or a substituent group. Typical examples of the substituent group are: an aryl group (e.g., phenyl, naphthyl, p-methoxyphenyl, p-hydroxyphenyl, p-nitrophenyl, or o-chlorophenyl); an alkyl group (e.g., methyl, ethyl, isopropyl, propyl, tert-butyl, tert-amyl, isobutyl, sec-butyl, octyl, methoxymethyl, 1-methoxyethyl, or 2-chloroethyl); halogen atom (e.g., fluoro, chloro, bromo, iodo); an alkoxy group (e.g., methoxy, ethoxy, isopropyloxy, propyloxy, tert-butyloxy, isobutyloxy, butyloxy, octyloxy, 2-methoxyethoxy, 2-chloroethoxy, nitromethyl, 2-cyanoethyl, 2-carbamoylethyl, or 2-dimethylcarbamoylethyl); an aryloxy group (e.g., phenoxy, naphtoxy, or p-methoxyphenoxy), alkylthio group (e.g., methylthio, ethylthio, isopropylthio, propylthio, tert-butylthio, isobutylthio, sec-butylthio, octylthio, or 2-methoxyethylthio); an arylthio group (e.g., phenylthio, naphthylthio, or p-methoxyphenylthio); an amino group (e.g., amino, methylamino, phenylamino, dimethylamino, diisopropylamino, or phenylmethylamino); a carbamoyl group (e.g., carbamoyl, methylcarbamoyl, dimethylcarbamoyl, diethylcarbamoyl, diisopropylcarbamoyl, ethylcarbamoyl, isopropylcarbamoyl, tert-butylcarbamoyl, phenylcarbamoyl, or phenylmethylcarbamoyl); a sulfamoyl group (e.g., sulfamoyl, methylsulfamoyl, ethylsulfamoyl, isopropylsulfamoyl, phenylsulfamoyl, octylsulfamoyl, dimethylsulfamoyl, diethylsulfamoyl, diisopropylsulfamoyl, dihexylsulfamoyl, or phenylmethylsulfamoyl); an alkoxycarbonyl group (e.g., methoxycarbonyl, propyloxycarbonyl, isopropyloxycarbonyl, tert-butyloxycarbonyl, tert-amyloxycarbonyl, or octyloxycarbonyl); an aryloxycarbonyl group (e.g., phenoxycarbonyl or p-methoxyphenoxycarbonyl); an acylamino group (e.g., acetylamino, propanoylamino, pentanoylamino, N-methylacetylamino, or benzoylamino); a sulfonamido group (e.g., methanesulfonamido, ethanesulfonamido, pentanesulfonamido, benzenesulfonamido, or p-toluenesulfonamido); alkoxycarbonylamino group (e.g., methoxycarbonylamino, isopropyloxycarbonylamino, tert-butoxycarbonylamino, or hexyloxycarbonylamino); an aryloxycarbonylamino group (e.g., phenoxycarbonyl amino); an ureido group (e.g., 3-methylureiodo or 3-phenylureido); a cyano group, and a nitro group.

$R_{101}$ and $R_{102}$ can either be identical or different, but it is preferred that the sum of their formula weights is less than 120. Preferable substituent groups are an alkyl group, a halogen atom, and an alkoxy group. An alkyl group is most preferred.

In the formula (III), the groups represented by $R_{103}$ and $R_{104}$ are independently a hydrogen or an alkyl group. Examples of the alkyl group are methyl, ethyl, isopropyl, tert-butyl, isobutyl, hexyl, or 2-methoxyethyl. Preferable $R_{103}$ and $R_{104}$ are a hydrogen, a methyl, and an ethyl. A hydrogen is particularly preferable.

In the formula (III), the group identified by $R_{105}$ is an unsubstituted phenyl or primary alkyl group, or a primary alkyl group substituted by a group other than an aryl group. Examples of the alkyl group are, for example, ethyl, propyl, butyl, isobutyl, pentyl, isopentyl, 2-methylbutyl, hexyl, 2-methylpentyl, 3-methylpentyl, 4-methylpentyl, 2-ethylbutyl, heptyl, or octyl. Examples of the group other than an aryl group substituted to primary alkyl group are, for example, a halogen atom, an alkoxy group, an alkylthio group, an amino group, a carbamoyl group, a sulfamoyl group, an alkoxycarbonyl group, an acylamino group, a sulfonamido group, an alkoxycarbonylamino group, an ureido group, a cyano group, a nitro group, and a group represented by $—CO_2CH_2CO_2R_{106}$. Typical examples of each of these groups are all groups exemplified as $R_{101}$ and $R_{102}$, except for those having aryl groups. $R_{106}$ is an unsubstituted alkyl group having 3 to 6 carbon atoms (e.g., propyl, butyl, isobutyl, pentyl, isopentyl, or hexyl).

$R_{105}$ can be substituted by two or more types of substituent groups. Preferable substituents for $R_{105}$ are fluoro, chloro, alkoxy group, carbamoyl group, alkoxycarbonyl group, cyano group, nitro group, and $—CO_2CH_2CO_2R_{106}$. In these groups, particularly preferable are alkoxycarbonyl group and $—CO_2CH_2CO_2R_{106}$.

Preferable $R_{105}$ are a phenyl group and an unsubstituted primary alkyl group having 2 to 6 carbon atoms, or a primary alkyl group substituted by the group exemplified above as preferable substituent for $R_{105}$.

In the formula (III), the group represented by INH is a group which can inhibit development. Typical examples of this group are the inhibitors (INH-1) to (INH-13) exemplified as the PUG described in the formula (I). Preferable scope of the INH and other comments thereon are same as that described in connection with formula (I).

The compound of the formula (IV) will be described in detail.

First, the case where $R_{111}$, $R_{112}$, and $R_{113}$ are independently a hydrogen atom or a monovalent organic group will be described.

If $R_{111}$, $R_{112}$, and $R_{113}$ are monovalent organic groups, they are preferably alkyl groups (e.g., methyl or ethyl), or aryl group (e.g., phenyl). Preferable is the case where either $R_{112}$ or $R_{113}$, or both are hydrogen. Particularly preferable is the case where both $R_{112}$ and $R_{113}$ are hydrogen.

$R_{111}$ is an organic group. Preferable examples of this organic group are follows: an alkyl group (e.g., methyl, isopropyl, butyl, isobutyl, tert-butyl, sec-butyl, neopentyl, or hexyl); an aryl group (e.g., phenyl), an acyl group (e.g., acetyl or benzoyl); a sulfonyl group (e.g., methanesulfonyl or benzensulfonyl); a carbamoyl group (e.g., ethylcarbamoyl or phenylcarbamoyl); a sulfamoyl group (e.g., ethylsulfamoyl or phenylsulfamoyl); an alkoxycarboyl group (e.g., ethoxycarbonyl or butoxycarboyl); an aryloxycarbonyl group (e.g., phenoxycarbonyl or 4-methylphenoxycarbonyl); an alkoxysulfonyl group (e.g., butoxysulfonyl, ethoxysulfonyl); an aryloxysulfonyl group (e.g., phenoxysulfonyl or 4-methoxyphenoxysulfonyl); a cyano group; a nitro group, a nitroso group; a thioacyl group (e.g., thioacetyl or thiobenzoyl); thiocarbamoyl group (e.g., ethylthiocarbamoyl); an imidoyl group (e.g., N-ethylimidoyl); an amino group (e.g., amino, dimethylamino, or methylamino); an acylamino group (e.g., formylamino, acetylamino, or N-methylacetylamino); an alkoxy group (e.g., methoxy or isopropyloxy); and an aryloxy group (e.g., phenoxy).

These groups can further have a substituent group. Examples of the substituent group are a halogen atom (e.g., fluoro, chloro or bromo), a carboxyl group, and a sulfo group in addiation to those exemplified as $R_{111}$.

Preferably, the number of atoms other than hydrogen in $R_{111}$ is 15 or less. More preferable $R_{111}$ is a substituted or unsubstituted alkyl or aryl group. Particularly preferred is a substituted or unsubstituted alkyl group.

The case, where two of the groups represented by $R_{111}$, $R_{112}$, and $R_{113}$ are divalent groups to form a ring by bonding together, will now be explained.

The formed ring, is preferably a 4- to 8-membered ring, more preferably a 4- to 6-membered ring.

The preferable divalent groups are: —C(=O)—N($R_{114}$)—, —$SO_2$—N($R_{114}$)—, —$(CH_2)_3$—, —$(CH_2)_4$—, —$(CH_2)_5$—, —C(=O)—$(CH_2)_2$—, —C(=O)—N($R_{114}$)—C(=O)—, —$SO_2$—N($R_{114}$)—C(=O)—, —C(=O)—C($R_{114}$)($R_{115}$)—, and —$(CH_2)_2$—O—$CH_2$—.

In these notations, $R_{114}$ and $R_{115}$ are independently a hydrogen, or identical to $R_{111}$ which is a monovalent organic group. $R_{114}$ and $R_{115}$ can either be the same or different.

In $R_{111}$, $R_{112}$, and $R_{113}$, any one which does not contribute as a divalent group is a hydrogen or a monovalent organic group. Typical examples of the organic group are identical to those exemplified as $R_{111}$, $R_{112}$, and $R_{113}$ for the case where $R_{111}$, $R_{112}$, and $R_{113}$ do not form rings.

When two of $R_{111}$, $R_{112}$, and $R_{113}$ bond together to form a ring, it is preferred that $R_{112}$ or $R_{113}$ are a hydrogen, and the remaining one of $R_{112}$ and $R_{113}$ form a ring by bonding to $R_{111}$. It is more preferable that the divalent group described above bonds at its left end to the nitrogen atom of the compound represented by the formula (IV), and at its right end to a carbon atom.

Also, preferable $R_{111}$, $R_{112}$, and $R_{113}$ are groups which don't form rings and which are independently a hydrogen or a monovalent organic group.

In the formulas (I) and (II), the formula weight of the residual groups, i.e., the groups other than those represented by A and PUG, is preferably 64 to 240, more preferably 70 to 200, and still more preferably 90 to 180.

Typical examples of the compounds presented by the formulas (I) to (IV) will be present below. However, compounds for use in the present invention are not limited to these examples.

Of the compounds exemplified below, those of the formula (I), in which A is a coupler residue, are labeled with "CA," those of the formulas (II) to (IV), in which A is a coupler residue, are labeled with "CB," and those of the formulas (I) to (IV), in which A is a redox group, are labeled with "SA."

(CA-1)

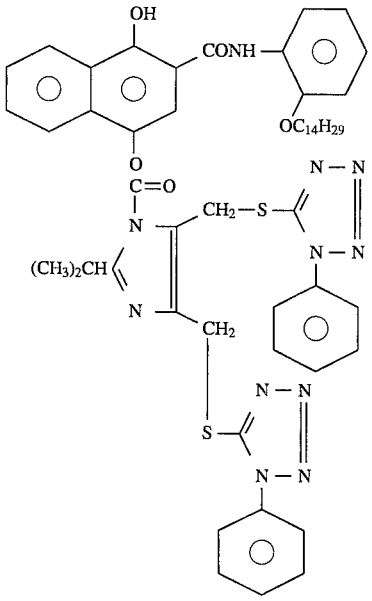

-continued
(CA-2)
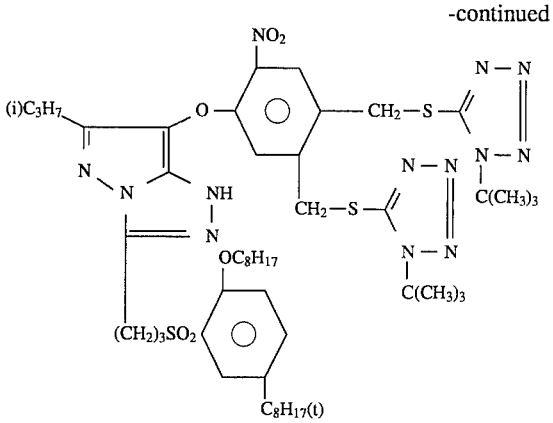
(CA-3)
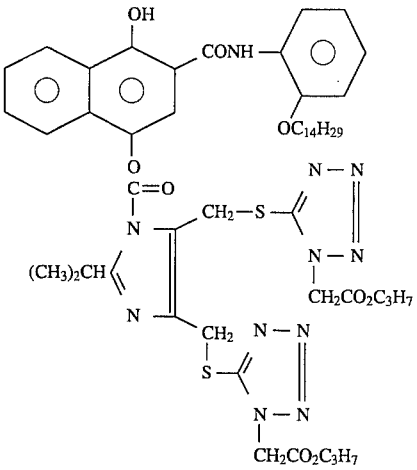
(CA-4)
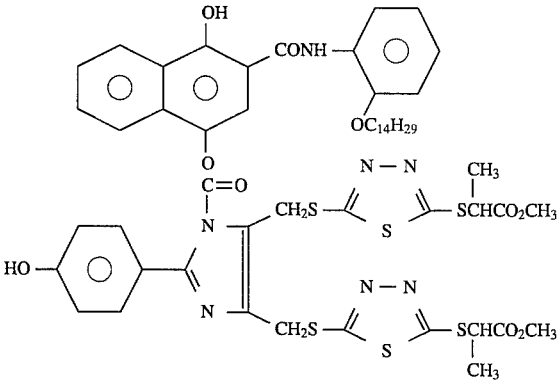
(CA-5)
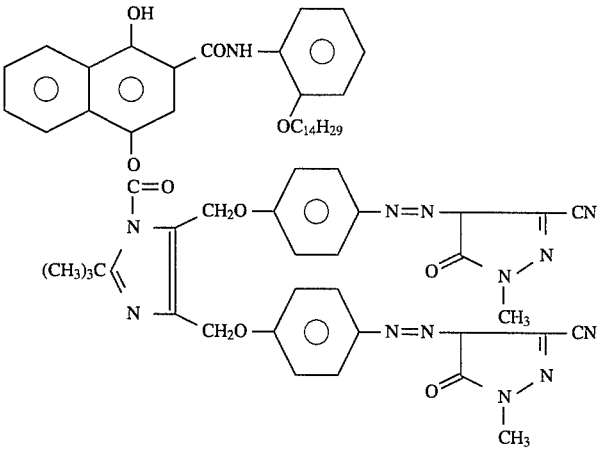

-continued
(CA-6)
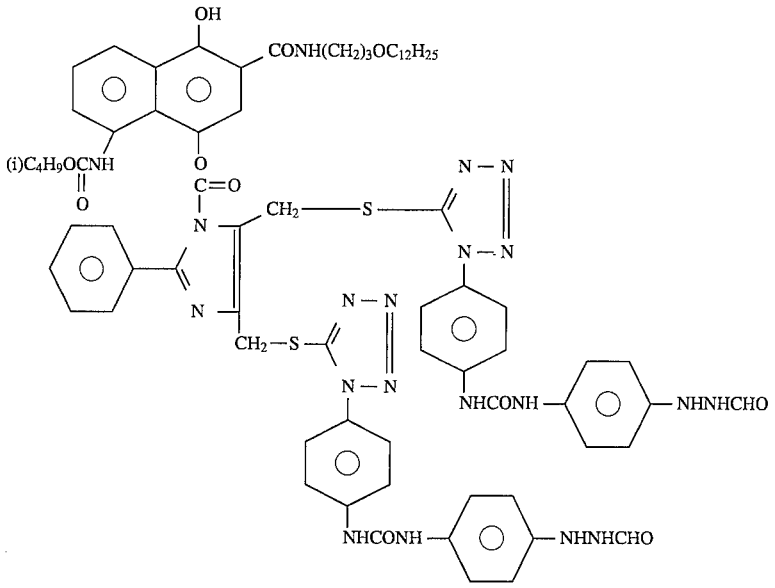
(CA-7)
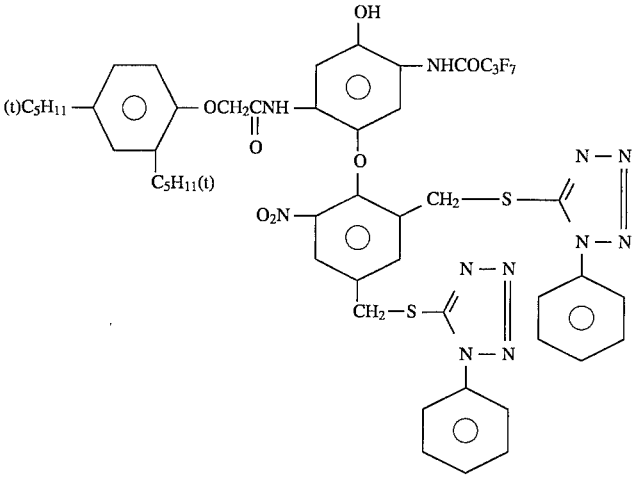
(CA-8)
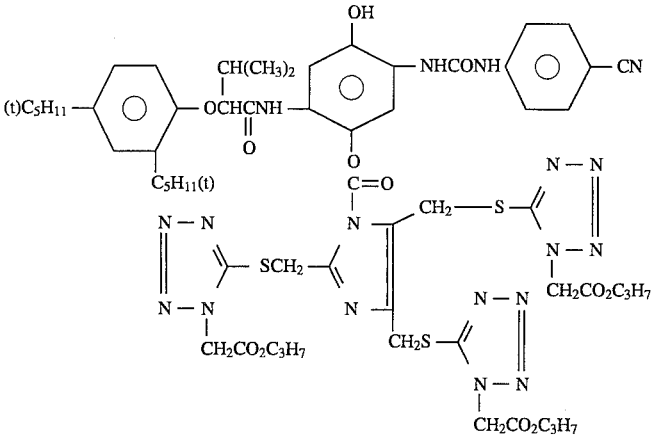

-continued
(CA-9)
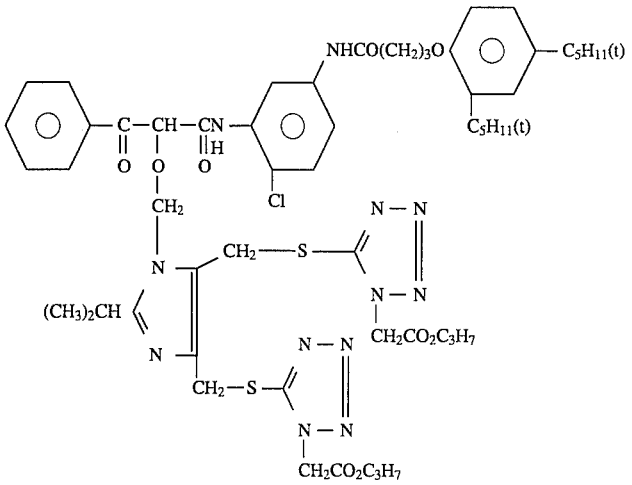
(CA-10)
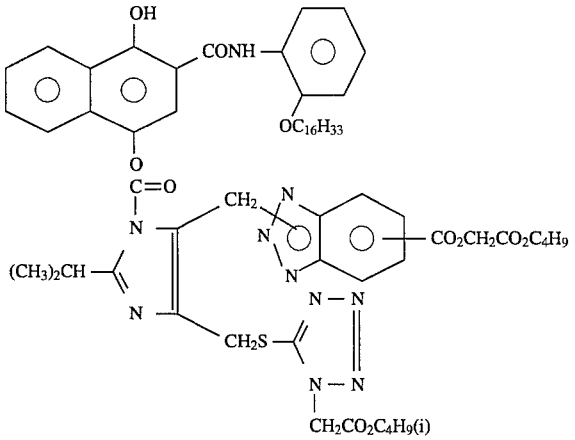
(CA-11)
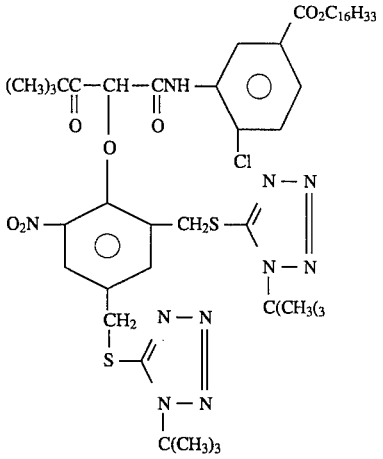

-continued
(CA-12)
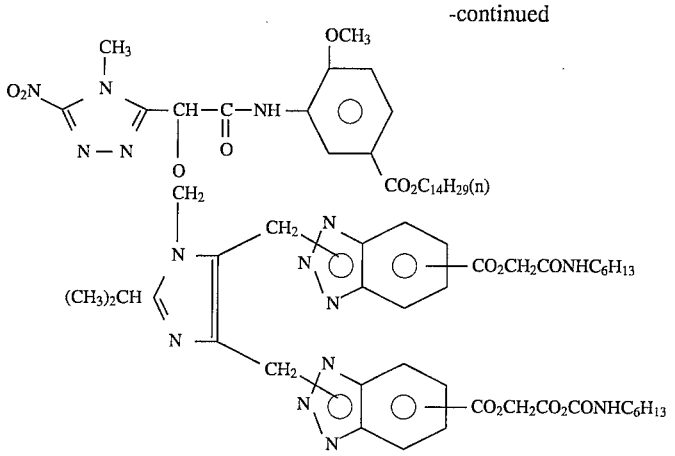
(CA-13)
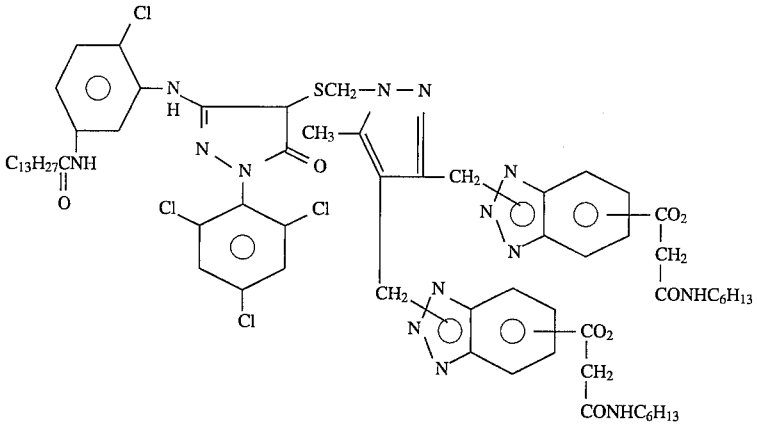
(CA-14)
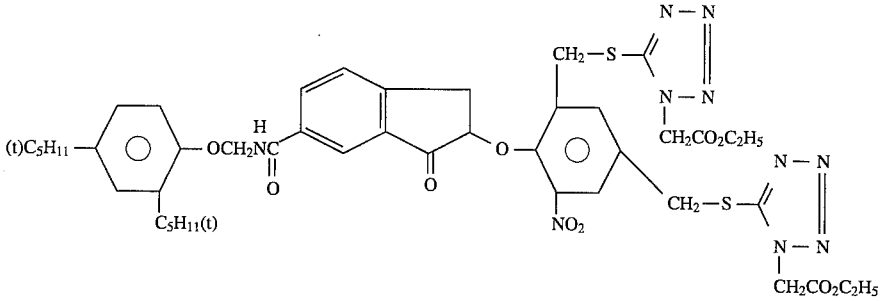
(CA-15)
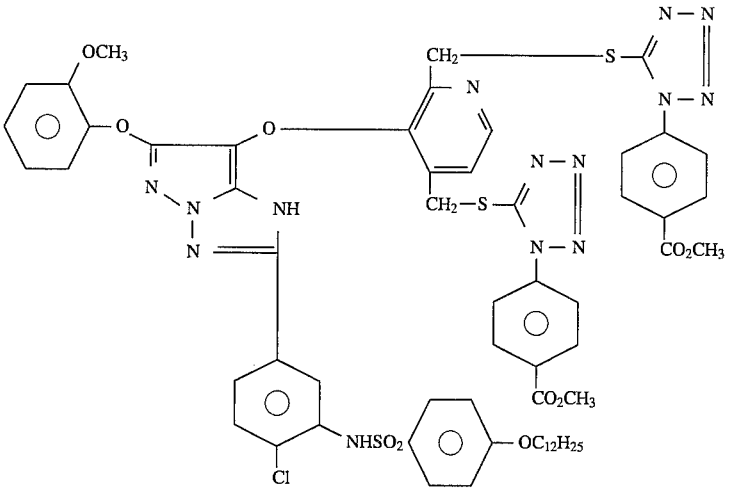

-continued
(CA-16)
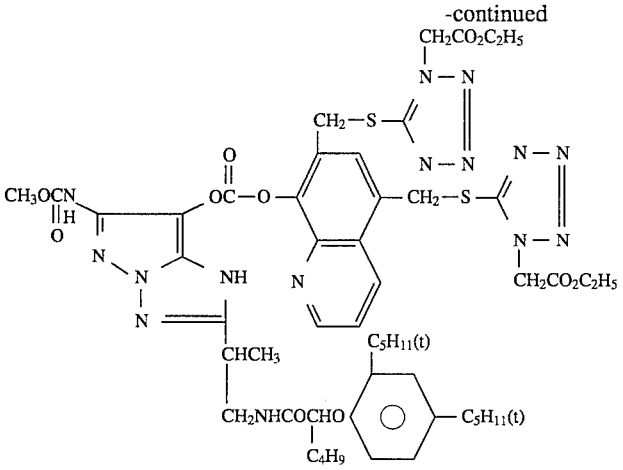
(CA-17)
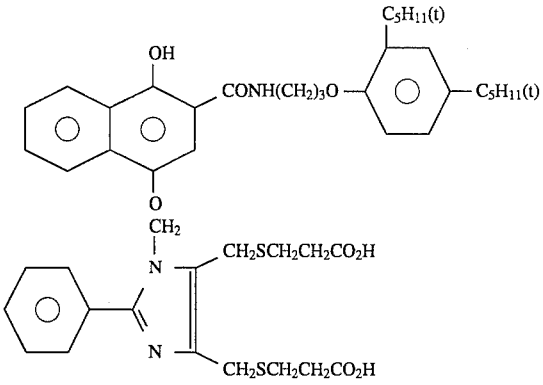
(CA-18)
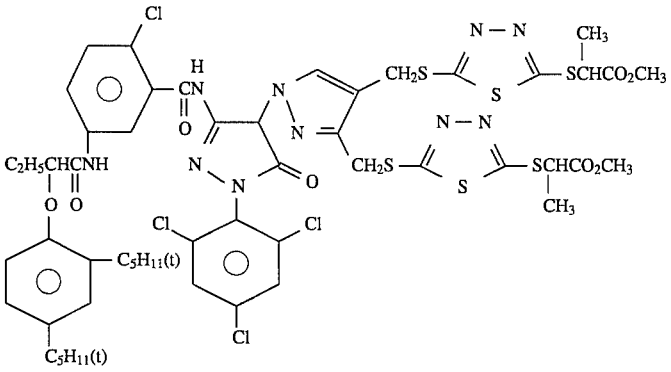

-continued
(CA-19)
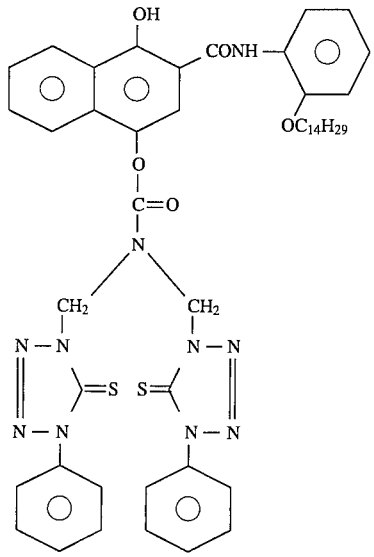
(CA-20)
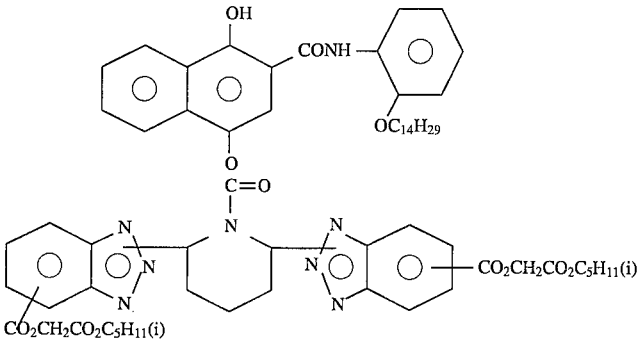
(CA-21)
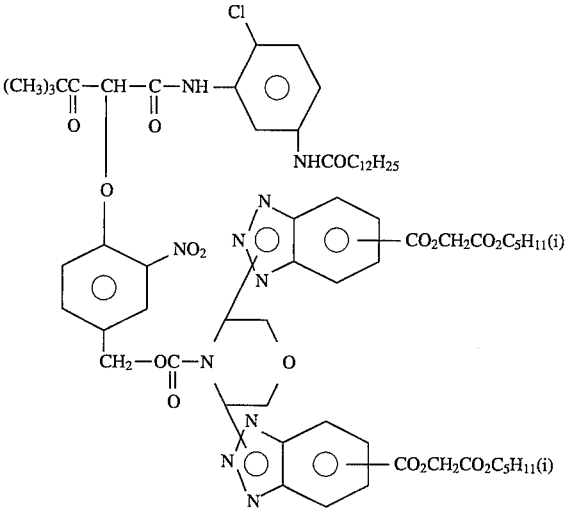

-continued
(CA-22)
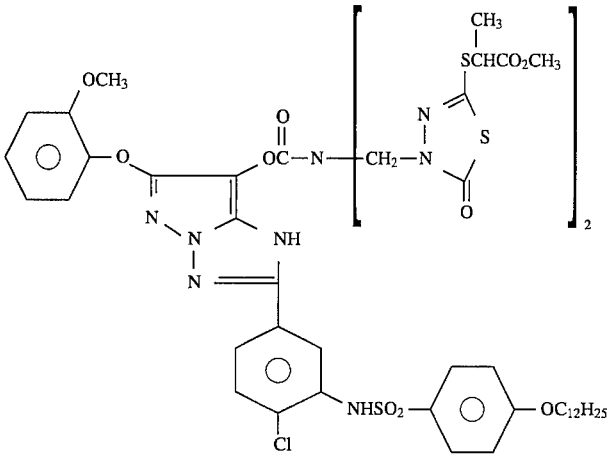
(CA-23)
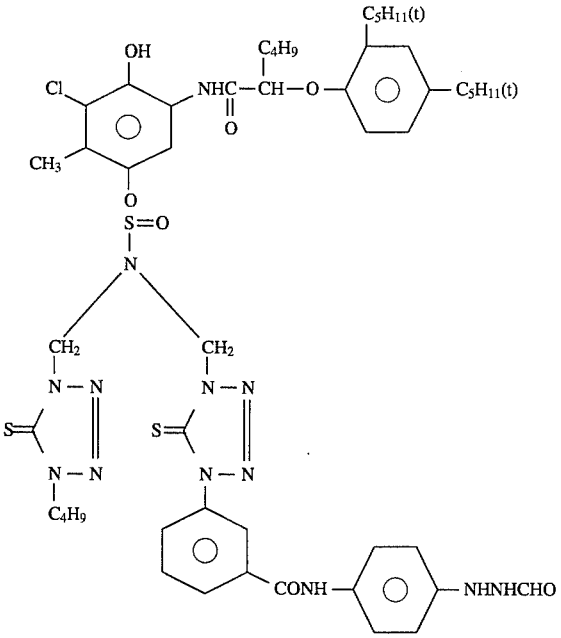
(CB-1)
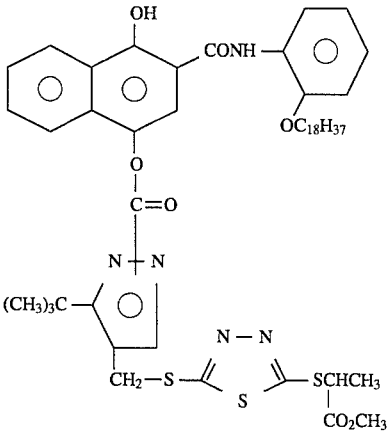

-continued
(CB-2)
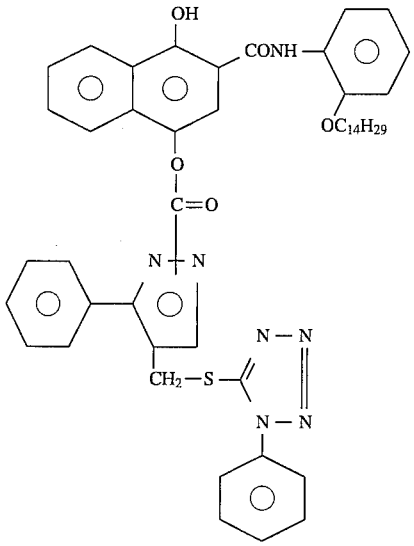
(CB-3)
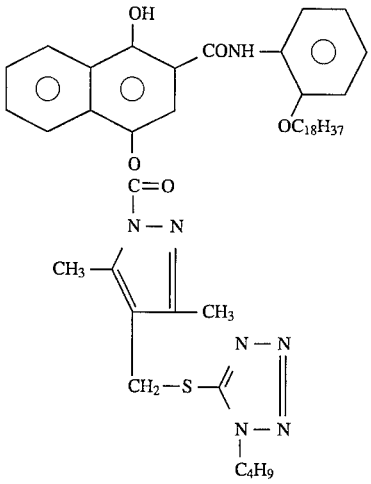
(CB-4)
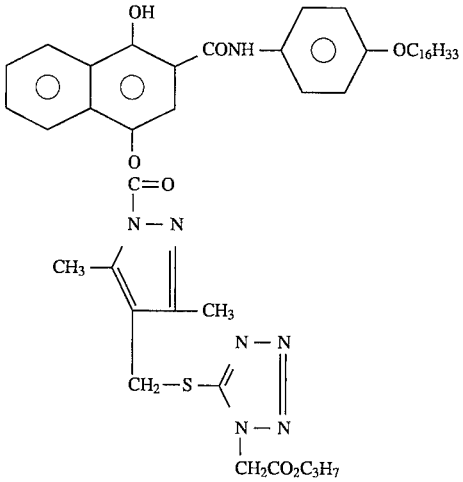

-continued
(CB-5)
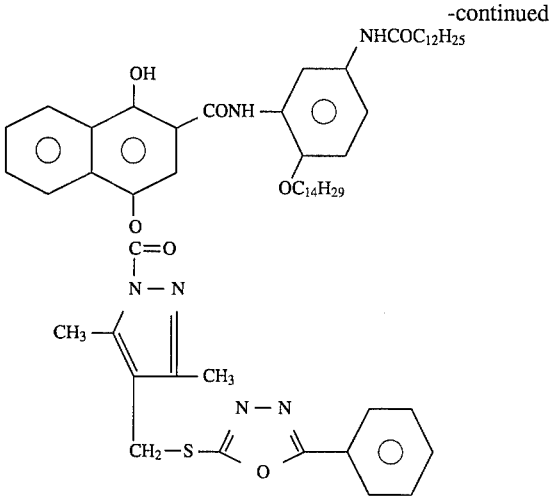
(CB-6)
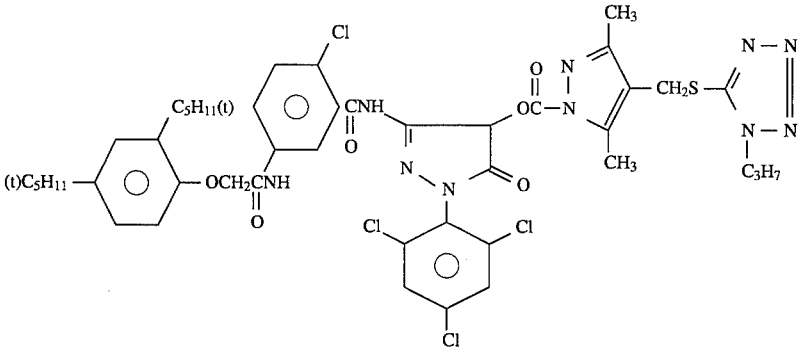
(CB-7)
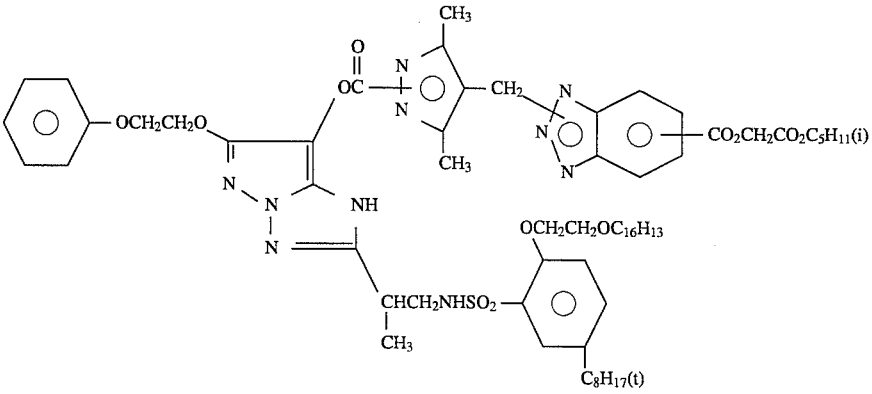
(CB-8)
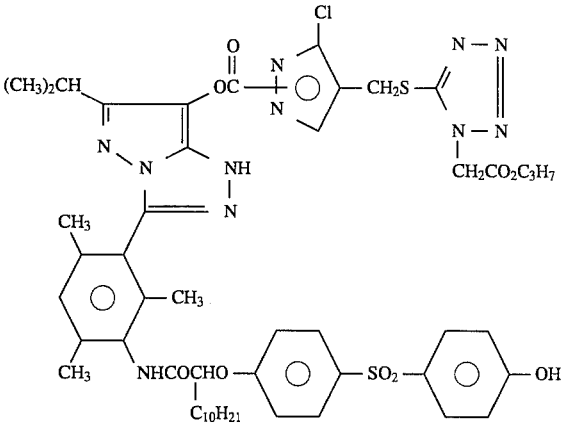

-continued
(CB-9)
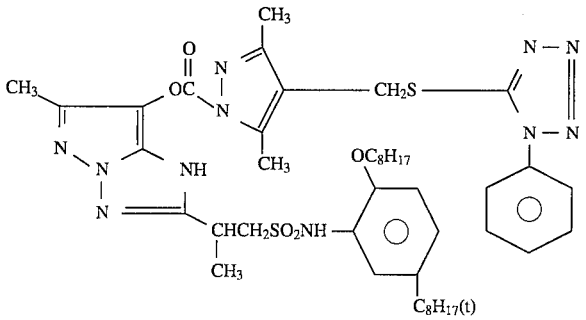
(CB-10)
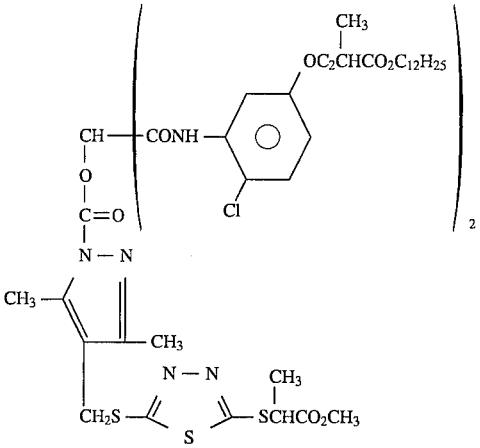
(CB-11)
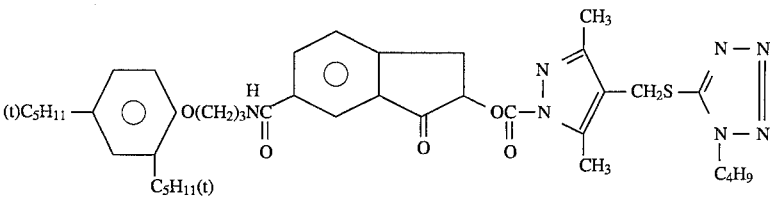
(CB-12)
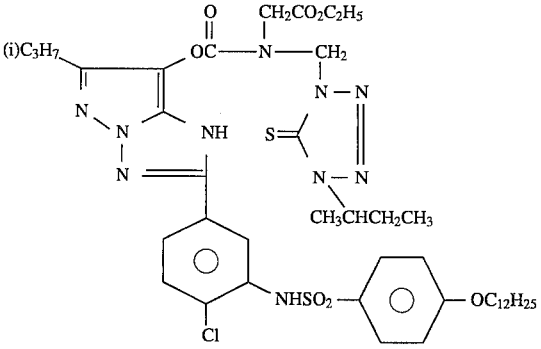

-continued
(CB-13)
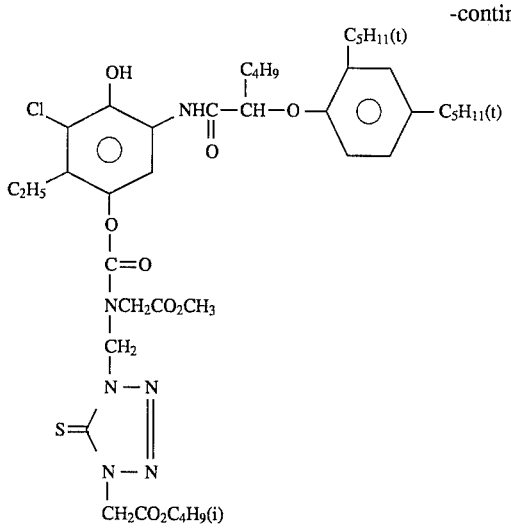
(CB-14)
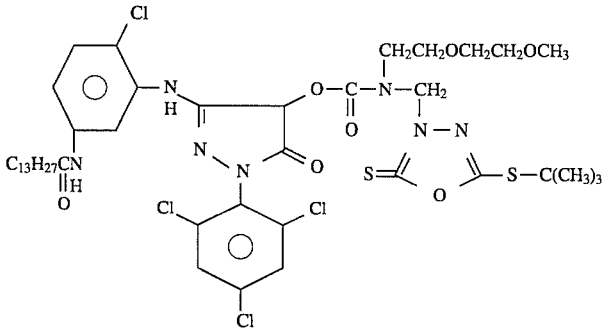
(CB-15)
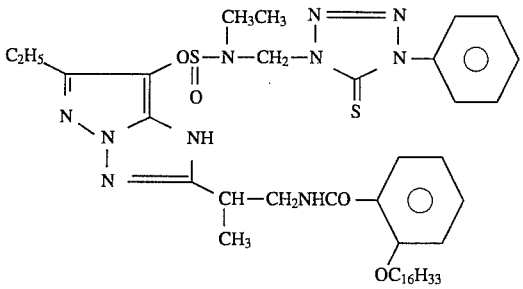
(CB-16)
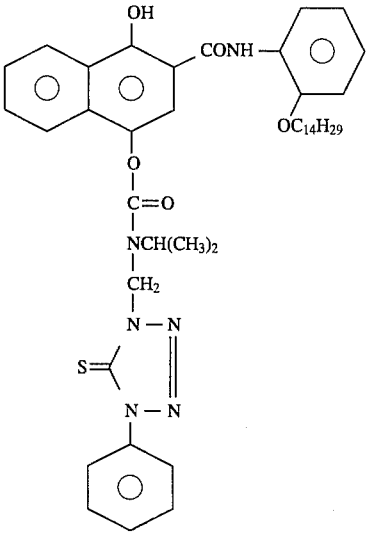

-continued
(CB-17)
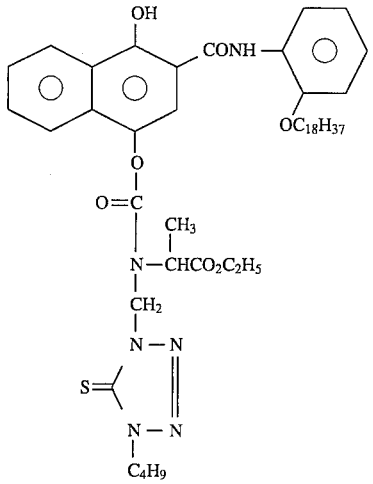
(CB-18)
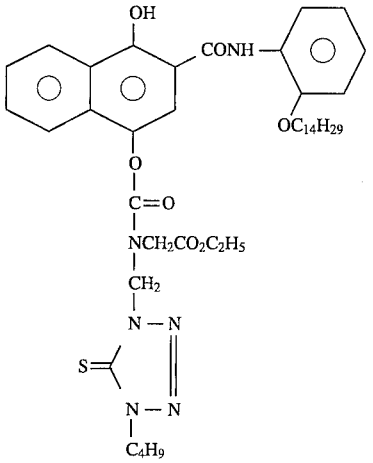
(CB-19)
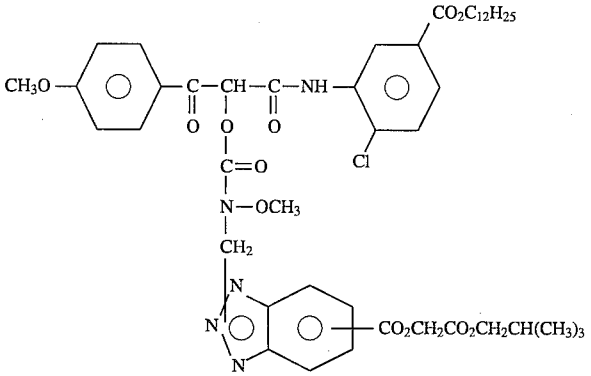
(CB-20)
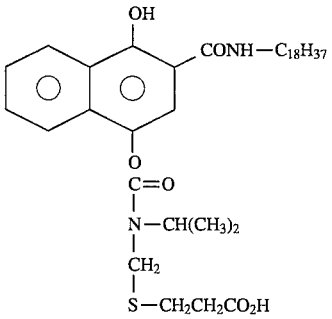

-continued
(CB-21)
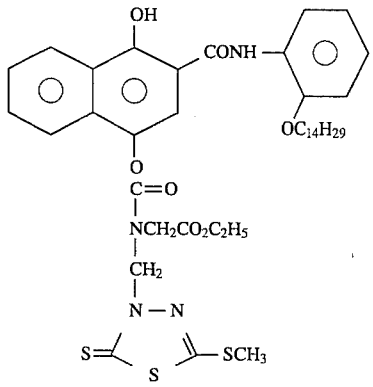
(CB-22)
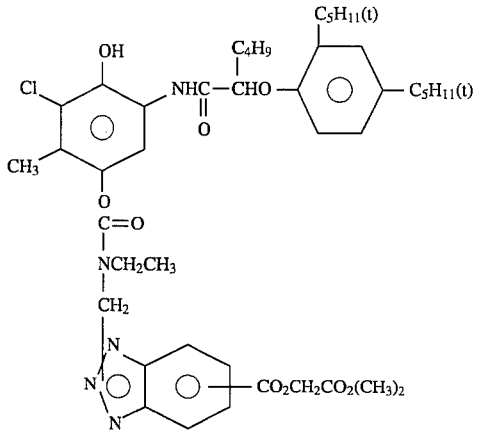
(CB-23)
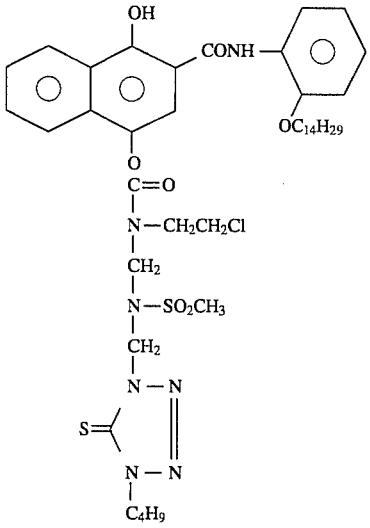
(CB-24)
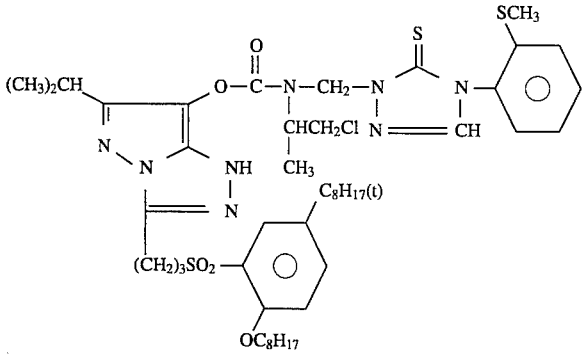

-continued
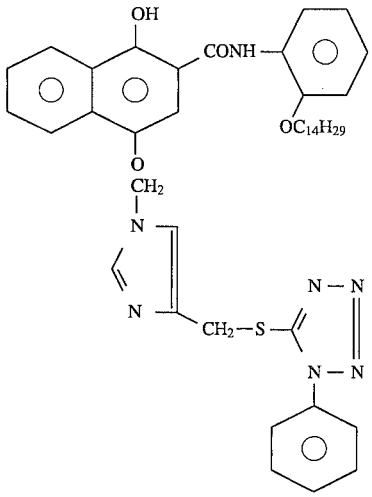
(CB-25)
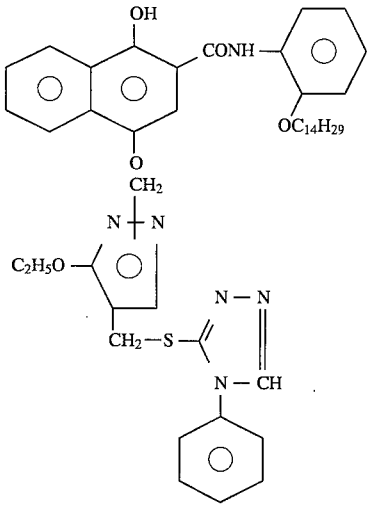
(CB-26)
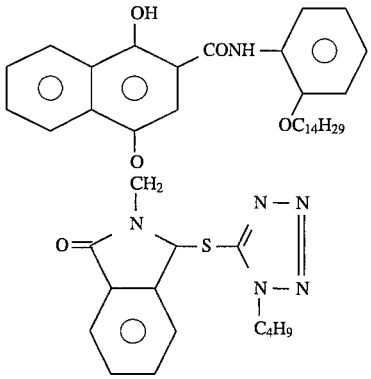
(CB-27)

-continued
(CB-28)
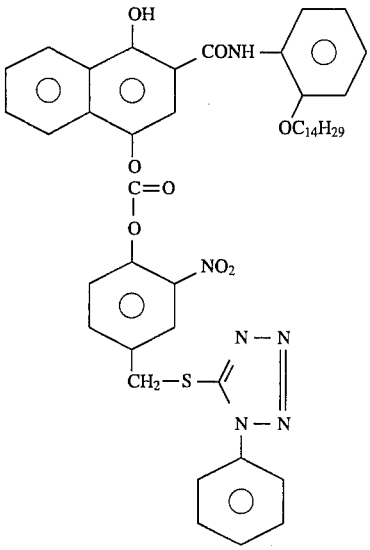
(CB-29)
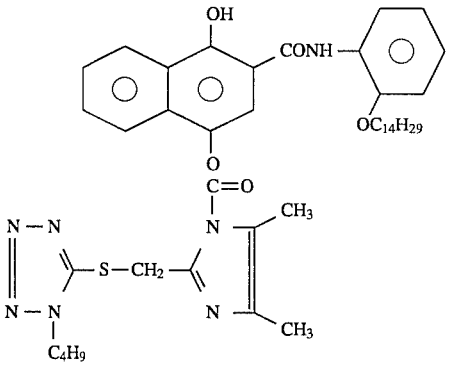
(CB-30)
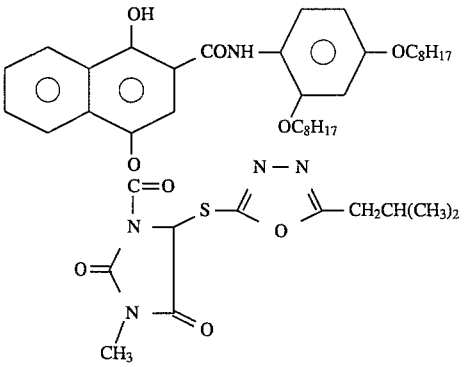

-continued
(CB-31)
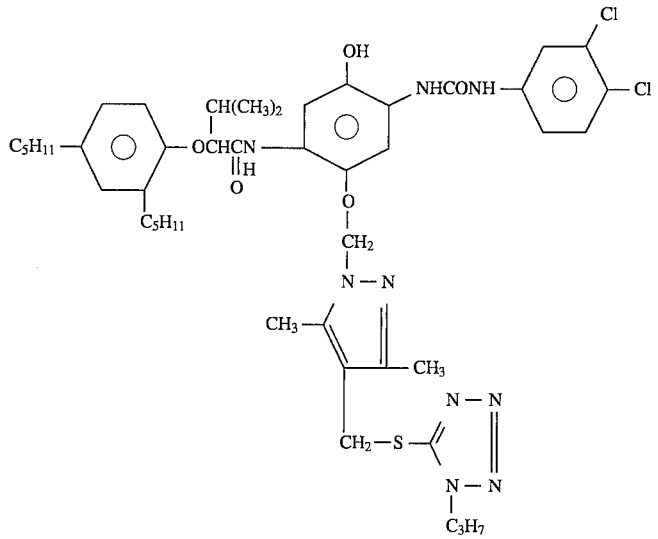
(CB-32)
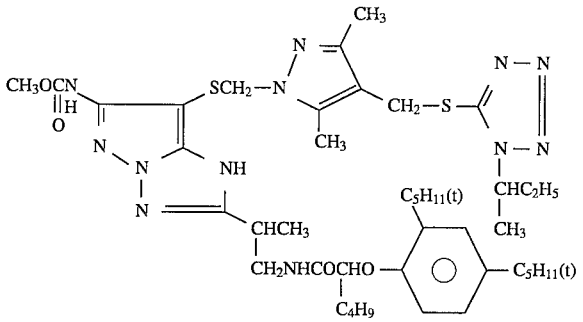
(CB-33)
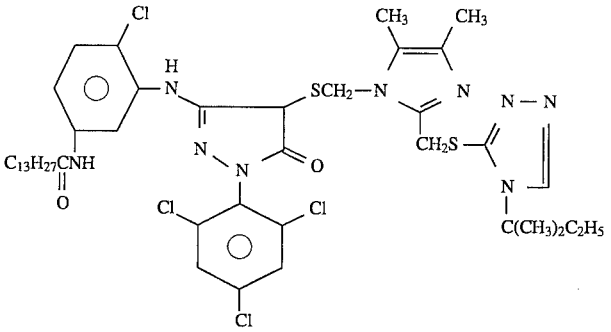
(CB-34)
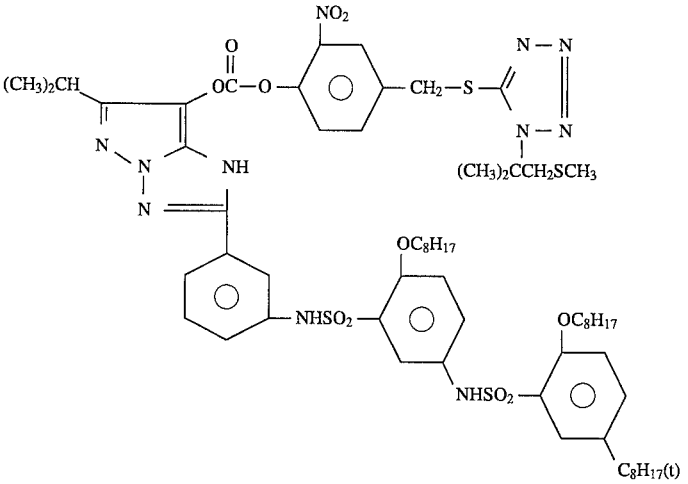

-continued
(CB-35)
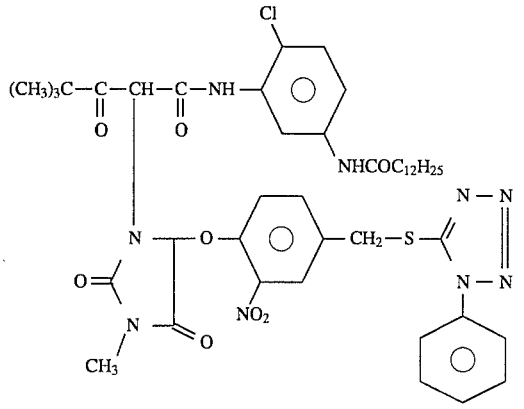
(CB-36)
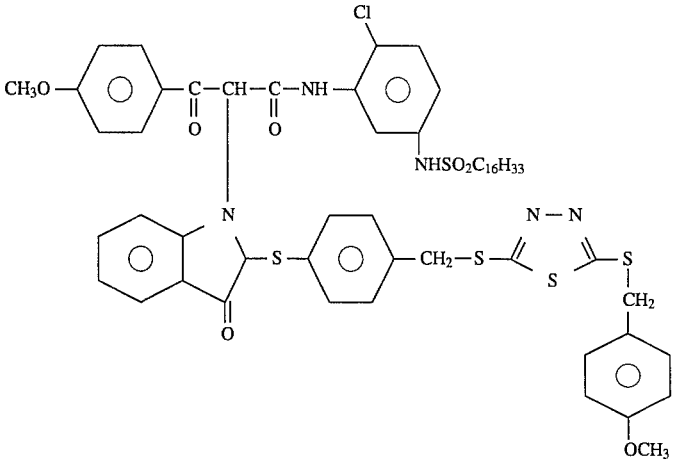
(CB-37)
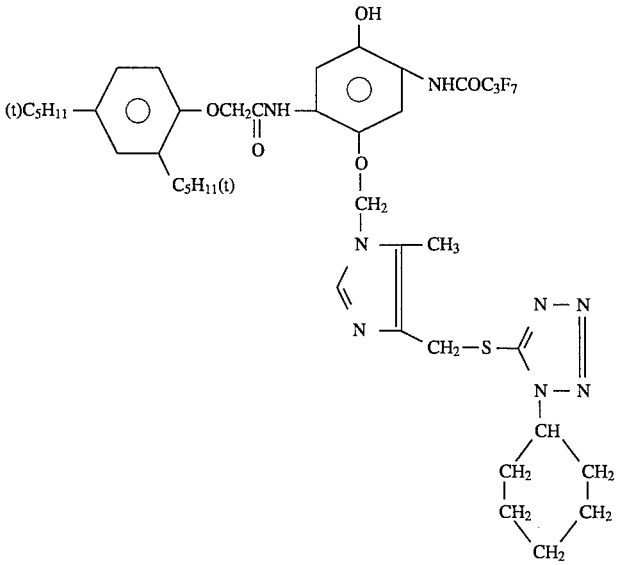

-continued
(CB-38)
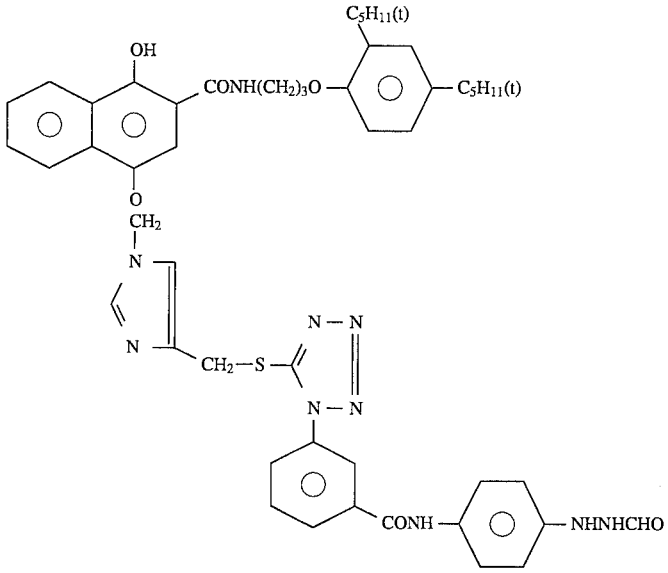
(SA-1)
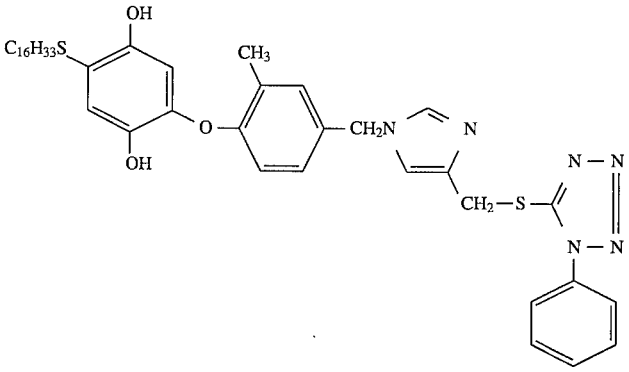
(SA-2)
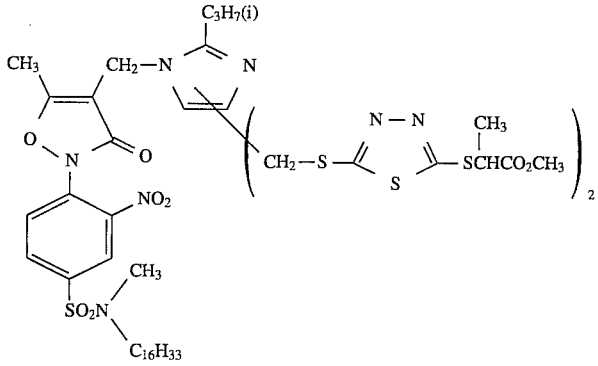
(SA-3)
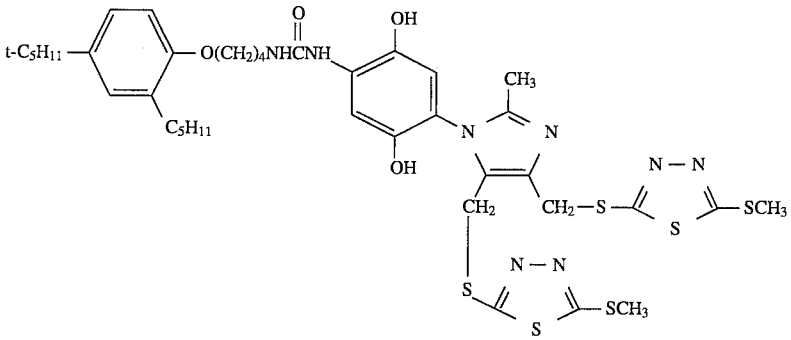

-continued
(SA-4)
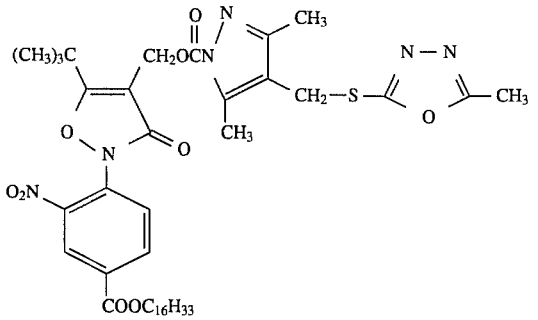
(SA-5)
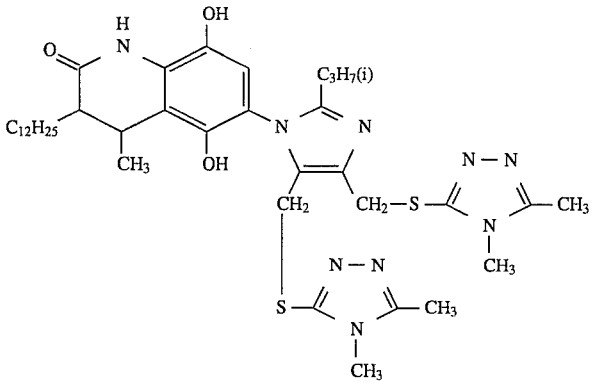
(SA-6)
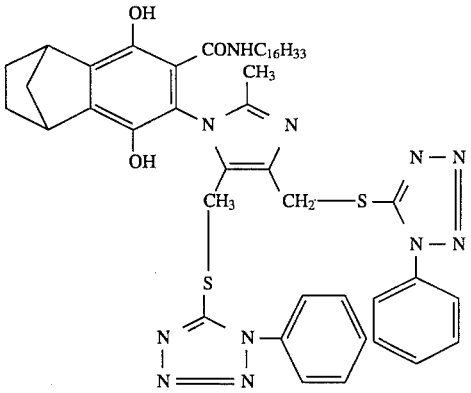
(SA-7)
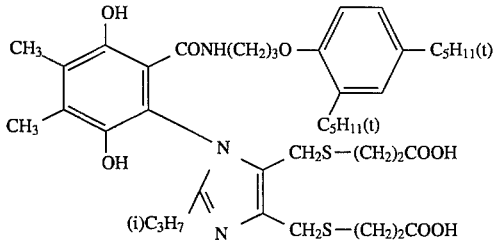

-continued

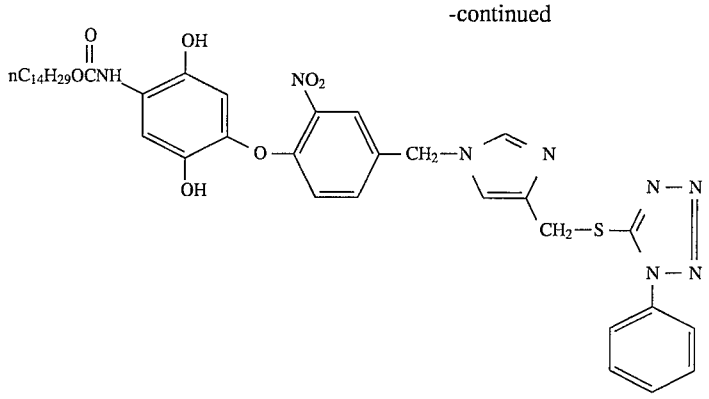

(SA-8)

The compounds according of this invention can be synthesized by the methods disclosed in, for example, U.S. Pat. Nos. 4,847,383, 4,770,990, 4,684,604 and 4,886,736, JP-A-60-218645, JP-A-61-230135, JP-A-2-37070, JP-A-2-170832, and JP-A-2-251192, or by methods similar to these.

Typical examples of synthesis will be described.

(Synthesis example 1): Synthesis of Compound CA-1

Compound CA-1 was synthesized in the synthesis route illustrated below:

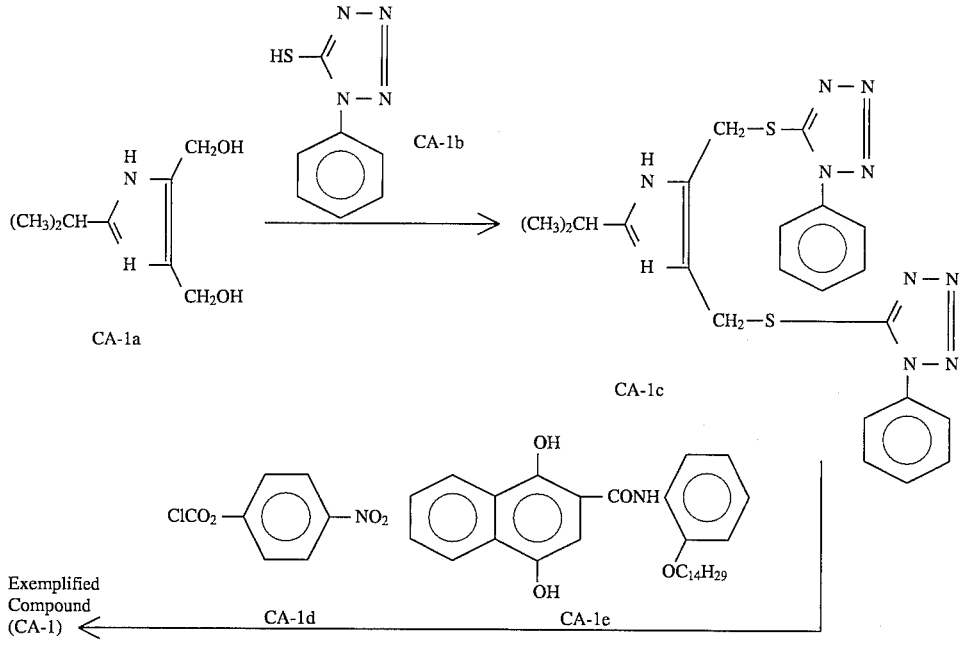

CA-1a (3.40 g) was reacted in thionyl chloride (30 ml) for 1 hour at 60° C. Then, the excess thionyl chloride was distilled off under reduced pressure. The residue was added to a dimethylformamide solution (0° C.) of CA-1b (7.48 g) and diisopropylethylamine (10.5 ml) and stirred for 1 hour. Thereafter, the solution was poured into water (500 ml), and resultant crystals were filtered off. By this procedure, 9.8 g of crude crystals of CA-1c was obtained. The structure of CA-1c was confirmed by means of NMR method.

CA-1c (3.20 g) and CA-1d (1.38 g) were reacted for 1 hour in 1,2-dichloroethane (30 ml). Then, an ethyl acetate solution (20 ml) of CA-1e (3.20 g) was added to the mixture under water-cooled condition. Further, diisopropylethylamine (4.5 ml) was added, and the resultant mixture was stirred for 1 hour.

The reaction was stopped by addition of 1N-hydrochloric acid and the mixture was diluted with chloroform (30 ml). Thereafter, the reacted mixture was washed with water for three times, and the organic layer was dried over sodium sulfate. The solvent was distilled off, and the obtained oily product was purified by means of silica-gel column chromatography (ethyl acetate-hexane=1:5) to yield 1.20 g of compound CA-1. The structure of compound CA-1 was confirmed by NMR. M.P. was 133.0° to 134.0° C.

(Synthesis example 2): Synthesis of Compound CA-19

Compound CA-19 was synthesized in the synthesis route illustrated below:

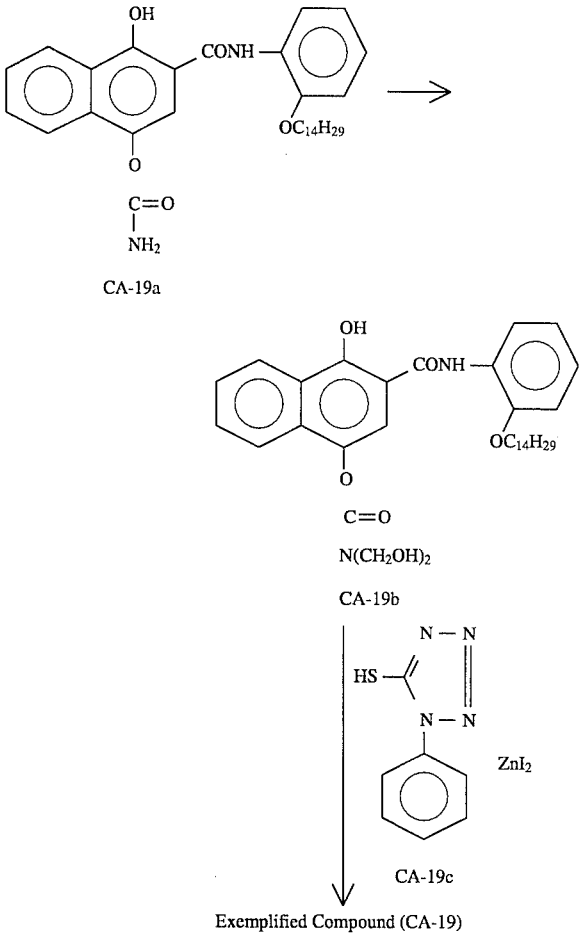

CA-29a (10.7 g) and 37% formalin aqueous solution (30 ml) were reacted for 5 hours at 70° in acetic acid (100 ml), and then the solvent was distilled off under reduced pressure. The residue was purified by silica-gel column chromatography (ethyl acetate-hexane=2:1) to yield 6.4 g of CA-19b (yield: 53%).

Next, CA-19b (3.2 g) and CA-19c (2.1 g) were suspended in chloroform (40 ml). Zinc iodide (5.7 g) was added to the suspension, and the mixture was reacted for 2 hours at room temperature. The reaction was stopped by addition of 1N-hydrochloric acid, the mixture was diluted with 40 ml of chloroform, and then washed twice with water. The organic layer was dried over sodium sulfate and concentrated. The residue was purified by silica-gel column chromatography (ethyl acetate-hexane=1:4) to yield 4.1 g of compound CA-19 (yield: 25%). The structure was confirmed by NMR, Mass spectrum, and elemental analysis.

(Synthesis example 3): Synthesis of Compound CB-2

Compound CB-2 was synthesized in the synthesis route shown below:

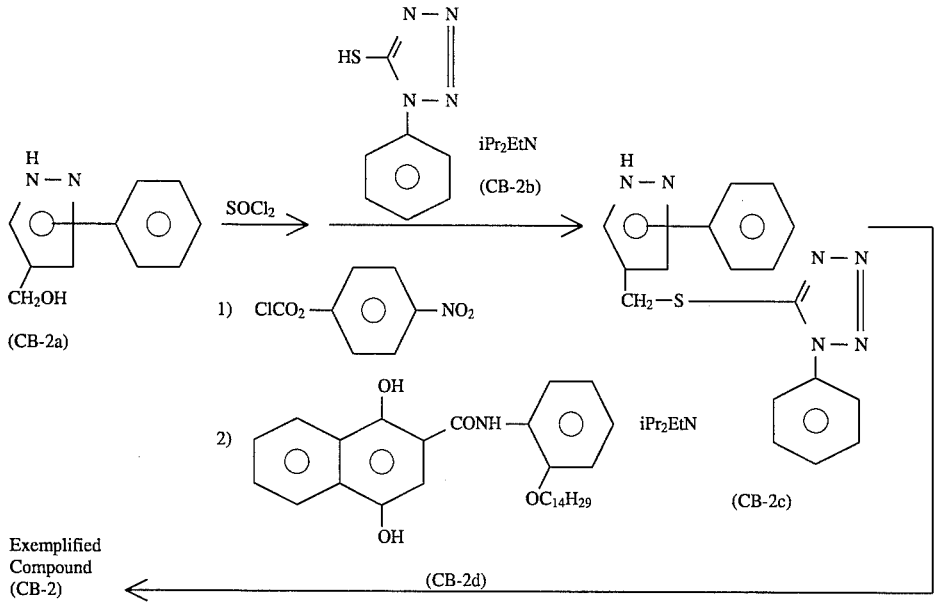

CB-2a (10 mmol) was suspended in chloroform (30 ml). Thionyl chloride (20 mmol) was added to the resultant suspension, and reacted for 1 hour at 50° C. Thereafter, the solvent was distilled off. The obtained residue was added to a dimethylformamide solution (30 ml) of CB-2b (10 mmol) and diisopropylethylamine (20 mmol) and the mixture was reacted for 1 hour. The mixture was poured into ice water (200 ml). Then, 50 ml of chloroform was added to the solution, which was stirred. Thereafter, the water layer was separated, and the organic layer was washed with 100 ml each of water for two times. The organic layer was dried over sodium sulfate and concentrated to give compound CB-2c.

Compound CB-2c obtained above was dissolved in chloroform (30 ml). Nitrophenylchlorocarbonate (10 mmol) was added to the solution, and reacted for 1 hour. Next, ethyl acetate solution (50 ml) of CB-2d (10 mmol) was added to the reaction mixture. After addition of diisopropylethylamine (50 mmol) to the solution, the mixture was reacted for 1 hour. The reaction was stopped by addition of 1N-hydrochloric acid (10 ml). The reacted mixture was diluted with ethyl acetate (10 ml). The organic layer was washed with water dried over sodium sulfate, and concentrated. The residue was purified by silica-gel column chromatography (ethyl acetate-hexane=1:3) to give 1.94 g of compound CB-2 (yield: 23%). M.P. was 101.5° to 102.5° C.

(Synthetic example 4): Synthesis of Compound CB-3

Compound CB-3 was synthesized in the synthetic route illustrated below:

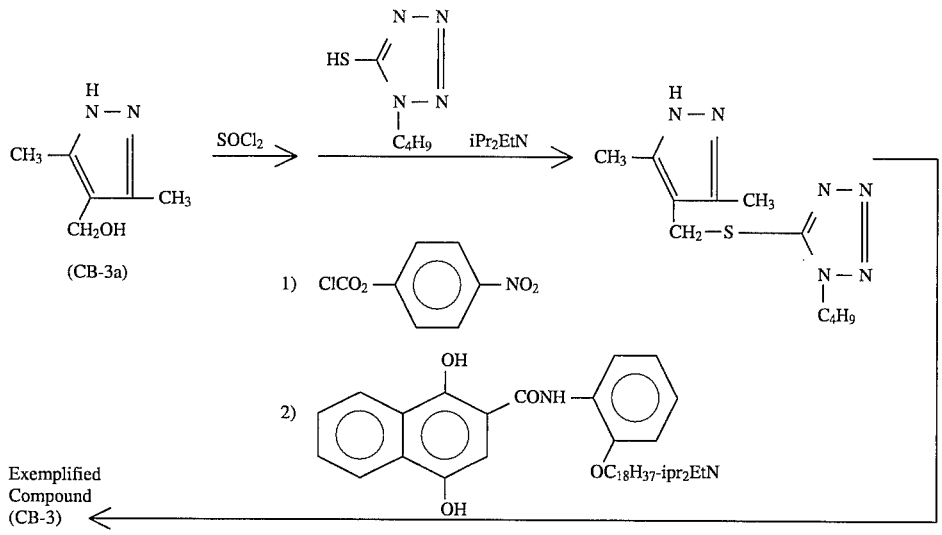

Using CB-3a as starting material, compound CB-3 was synthesized at the yield of 31%, in the same method as compound CB-2. M.P was 68.0° to 69.0° C.

(Synthetic example 5): Synthesis of Compound CB-16

Compound CB-16 was synthesized in the route illustrated below:

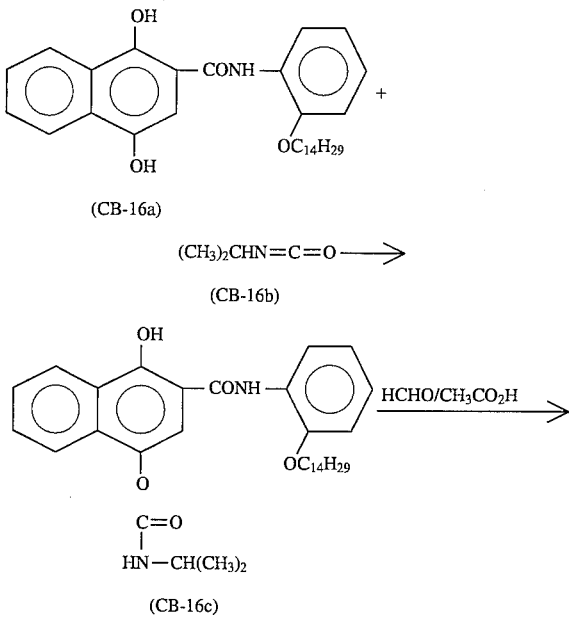

-continued

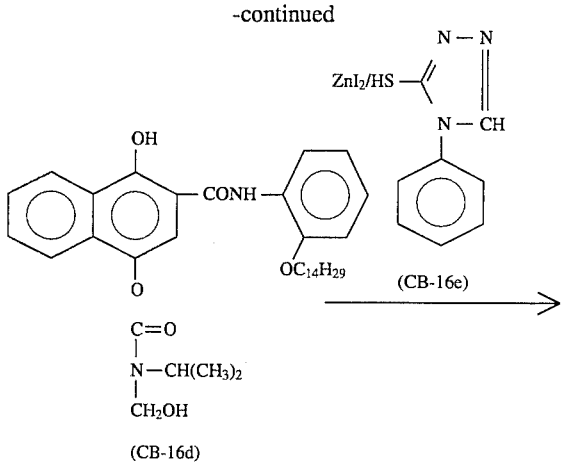

Exemplified Compund (CB-16)

200 g of CB-16a and 34.7 g of CB-16b were dissolved in ethyl acetate (500 ml). Diisopropylethylamine (142 ml) was added to the solution and stirred for 4 hours. The precipitated crystals were filtered off and washed with ethyl acetate, whereby 176 g of compound CB-16c was obtained (yield: 76%).

53.6 g of CB-16c and 27.9 g of paraformaldehyde were reacted for 4 hours in a liquid mixture of 1,2-dichloroethane (500 ml) and acetic acid (54 ml) with refluxing. The mixture was cooled to room temperature, washed with water, dried over anhydrous sodium sulfate, and concentrated. The residue was purified by silicagel column chromatography using chloroform as eluent to give 23.2 g of compound CB-16d (yield; 41.2%).

Then, 23.2 g of CB-16d and 6.78 g of CB-16e were dissolved in chloroform (250 ml). To this solution, 26.88 g of zinc iodide was added. The mixture was stirred for 3 hours. After addition of 1N-hydrochloric acid, the mixture was washed with water. The organic layer was dried over anhydrous sodium sulfate and concentrated. The resultant residue was purified by silica-gel column chromatography (ethyl acetate-hexane=1:4) to give 7.0 g of compound CB-16 (yield: 23.9%). M.P was 117.0° to 118.5° C.

(Synthesis example 6): Synthesis of Compound CB-18

Compound CB-18 was synthesized in the same method as synthesis example 5. M.P was 61.5° to 63.0° C.

(Synthesis example 7): Synthesis of Compound CB-25

Compound CB-25 was synthesized in the same method as synthesis example 2 disclosed in JP-A-60-218645. Compound CB-25 was obtained at yield of 7%. M.P. was point of 115° C.

(Synthesis example 8): Synthesis of Compound SA-6

Compound SA-6 was synthesized in the synthesis route shown below:

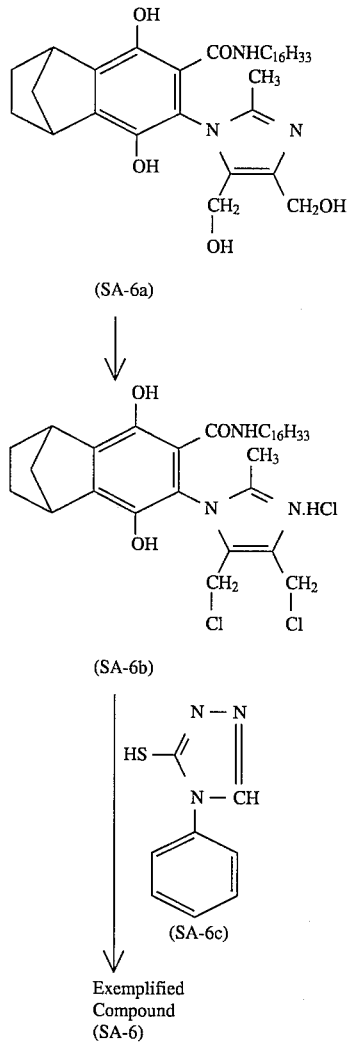

11.6 g of SA-6a (synthesized by the same method as described in JP-A-61-230135) was added to 30 ml of thionyl chloride with water-cooling. The mixture was further reacted for 1 hour at 50° C. The excess thionyl chloride was distilled off under reduced pressure. The resulting crystals were washed with a small amount of ice-cooled chloroform, thereby obtaining SA-6b as crude crystals. Next, 13.1 g of SA-6b was added to an N,N-dimethylformamide solution ( 100 ml) of 7.2 g of SA-6c and 12.1 g of triethylamine at 0° C. Thereafter, the mixture was further reacted for 1 hour at room temperature.

The reaction mixture was poured into an aqueous solution of 60 ml of 2N-hydrochloric acid and 300 ml of ice-water. Further, 300 ml of ethyl acetate was added to the solution. This solution was stirred, and then introduced into a separatory funnel. After removing the aqueous layer, the organic layer was washed with water for several times, dried over anhydrous sodium sulfate and concentrated. The obtained residue was purified by silica-gel column chromatography (ethyl acetate-hexane=1/4 to 1/1 (V/V)) to give 3.7 g of amorphous compound SA-6.

In the present invention, it is necessary to use an emulsion containing silver halide grains each of which has less silver iodide content in its surface than the average AgI content of the grain.

The silver halide composition of the surface region of the grain can be determined based on the depth analyzed by means of XPS (X-ray Photoelectron Spectroscopy) surface analysis. The average AgI content of the grain can be evaluated by using EPMA (Electron-Probe Micro Analyzer) method.

In the XPS surface analysis, a sample in which emulsion grains are well dispersed so as not to contact one another is produced. When the obtained sample is then irradiated with electron beams, X-ray is emitted by electron ray excitation. As a result, elemental analysis of extremely fine parts can be carried out by performing X-ray analysis of the emitted X-ray.

In this method, halogen composition of each grain and the grain surface was determined by measuring a intensity of characteristic X-ray of silver and iodine, emitted from each lattice.

It is possible to determine whether the emulsion is the one according to the present invention or not, if the halogen composition of at least 50 grains of the emulsion is confirmed by the EPMA process.

The particularly preferable emulsion of the invention is the emulsion comprising silver halide grains wherein each grain has a distinct stratiform structure made of silver bromoiodide containing 15 to 45 mol % of silver iodide, and each grain is chemically sensitized silver halide grain which have an average silver bromoiodide content more than 7 mol %. If the silver bromoiodide layer contains more than 45 mol % of silver iodide, the emulsion will not be a solid solution. If the silver iodide layer contains less than 15 mol % of silver iodide, the emulsion will have but very poor graininess.

The distinct stratiform structure can be judged by X-ray diffractometry. An example of applying X-ray diffractometry to silver halide grains has been described in, for example, Hirsch, Journal of Photographic Science, Vol. 10 (1962), p. 129 et seq. When the lattice constant of a grain is determined from the halogen composition of the grain, a diffraction peak is formed in the angle of diffraction which satisfies Bragg's condition (i.e., $2d \sin\theta=n\lambda$).

The manner of measuring the X-ray diffraction has been described in detail in, for example, "X-ray Diffraction" in Lecture 24 on Fundamental Analytic Chemistry, Sankyo Shuppan, and "Manual of X-ray Diffraction," Rigakudenki Co., Ltd.

A standard method of measurement is carried out in such a manner that a diffraction curve of the face (220) of the silver halide is determined by using Cu as a target with a βK ray of Cu as a ray source (tube electric potential:40 KV, tube electric current:60 mA).

In order to increase the resolution of the apparatus for measurement, it is necessary to confirm the accuracy of the measurement by using a standard sample such as silicon and selecting a suitable width of the slit (light-diverging slit, light-receiving slit),time constant of apparatus, scanning of rate of the goniometer and recording rate.

The distinct stratiform structure in the present invention means that when a curve of diffraction intensity of the face (220) of silver halide to angle of diffraction (28) is obtained using a βK ray of Cu in a range of an angle of diffraction of 38° to 48°, the following diffraction peaks appear. Namely, at least two diffraction maxima of a diffraction peak corresponding to a high-iodide layer containing 15 to 45 mol % of silver iodide appear and one minimum corresponding to a low-iodide layer containing 8 mol % or less of silver iodide appears between them, and the diffraction intensity of the peak corresponding to the high-iodide layer is 1/10 to 3/1, more preferably 1/3 to 3/1, of the diffraction intensity of the peak corresponding to the low-iodide layer.

As emulsions having substantially two distinct stratiform structure in the present invention, those wherein the diffraction intensity of the minimum value between two peaks is 90% or less of the diffraction maximum (peaks) having the lower intensity of the two diffraction maxima are preferred.

For the maximum of between the two peaks, 80% or less is more preferred and 60% or less is particularly preferred.

The manner of analyzing the diffraction curve composed of two diffraction components is well known and described in, for example, "Jikken Buturigaku Koza" (Lecture of Experimental Physics), No 11, "Koshi Kekkan" (Failure of Lattice), published by Kyoritsu Shuppan.

It is effective to analyze the curve with a curve analyzer produced by Du Pont on the assumption that it is a function such as a Gauss function or a Lorentz function.

In an emulsion containing two kinds of grains, each having a different halogen composition, which do not have a distinct stratiform structure, two peakes also appear in the above described X-ray diffraction pattern. Such an emulsion cannot show excellent photographic performance as obtained in the present invention.

Whether the silver halide emulsion is an emulsion according to the present invention or the aforesaid emulsion wherein two kinds of silver halide grains are present can be judged by an EPMA process (Electron-Probe Micro Analyzer process) in addition to X-ray diffractometry.

In the emulsion of the present invention, it is preferred that the silver iodide content of each grain is uniform.

For example, it is preferred, when measuring by EPMA method the distribution of the silver iodide content of the grains, that the standard deviation is 50% or less, preferably 30% or less.

Another preferred distribution of the silver iodide content among the grains is the one wherein relationship between the logarithm of the grain size and silver iodide content is positive. Namely, this relationship means that silver halide content of large size grain is higher and silver halide content of small size grain is lower.

An emulsion showing such correlation give preferred results in respect to graininess. It is preferred that the coefficient of correlation is 40% or more, preferably 50% or more.

In the core part, the silver halide other than silver iodide may be either or both of silver chlorobromide and silver bromide, but it is preferred that the amount of silver bromide is higher. The silver iodide content may be 15 to 45 mol %, preferably 25 to 45 mol %, more preferably 30 to 45 mlo %. Particularly preferable silver halide of core part is silver bromoiodide having a silver iodide content of 30 to 45 mol %.

The composition of the most outer layer of each grain is silver halide containing 8 mol % or less, more preferably 6 mol % or less, of silver iodide. As silver halide other than silver iodide in the most outer layer, any of silver chloride, silver chlorobromide and silver bromide may be used, but it is preferred that the amount of silver bromide is higher. As the most outer layer, silver bromoiodide containing 0.5 to 6 mol % of silver iodide or silver bromide may be particularly preferred.

The halogen composition of the whole grains is necessary that the silver iodide content is 7 mol % or more, preferably 10 to 25 mol %, more preferably 12 to 20 mol %.

One of the reason why the silver halide emulsion used in the present invention has good graininess is that the light absorption is incleased, since the iodine content has been incleased without falling the development activity. It is considered more important reason that efficiency of latent image formation is improved by forming distinct stratiform structure which has higher iodine content layer in the core part of the grain and lower iodine content layer in the most outer layer.

The grain size of silver halide grains having a distinct stratiform structure of the present invention is 0.05 to 3.0 μm, preferably 0.1 to 1.5 μm, more preferably 0.2 to 1.3 μm, still more preferably 0.3 to 1.0 μm.

Average size of the silver halide grains in the present invention is geometric average of the grain sizes, well known in the art, as disclosed in T. H. James, "The Theory of the Photographic Process," third ed., p39, Macmillan, (1966). Grain size indicates the equivalent-sphere diameter described in Masafumi Arakawa, "Introduction to Graininess Measuring" (Journal of the Society of Powder Engineering, vol. 17, 299–313 (1980), and can be measured by the manner such as, for example, Coulter counter method, monoparticle light-scattering method, or laser light-scattering method.

The form of silver halide grains having a stratiform structure of the present invention may be any of regular crystal forms (normal crystals) such as hexahedron, octahedron, dodecahedron or tetradecahedron, and irregular crystal form such as sphere, potato-shaped form or tabuler form, etc. Particularly, it is preferred that they have aspect ratio of 1:2 to 1:8, more preferably tubular twinned grain having aspect ratio of 1.5to5.

In case of normal crystals, grains having 50% or more of the face (111) are particulary preferred. In case of irregular crystal forms, grains having 50 or more of the face (111) are also particulary preferred. The face ratio of the face (111) can be determined by a Kubelka-Munk's dye adsorption process. In this process, a dye which is preferentially adsorbed on either the face (111) or the face (100), wherein the association state of the dye on the face (111) is spectrometorically different from that of the dye on the face (100), is selected. Such a dye is added to the emulsion and spectra to the amount of the dye added are examined in detail, by which the face ratio of the face (111) can be determined.

The emulsion of this invention can be used in any layer of a silver halide light-sensitive material, but it is preferred that the emulsion is used in a blue-sensitive emulsion layer containing the compound represented by the formula (I) or (II). Preferably, the blue-sensitive emulsion layer consists of two or more layers having different sensitivity, and it is particularly preferred that the emulsion is used in the layer having a sensitivity other than the lowest one.

In the present invention, it is particularly preferred that a compound represented by the following formula (A) be used.

Formula (A)

$$Q—SM^1$$

In the formula (A), Q is a heterocyclic residual group having at least one group selected from the group consisting of $—SO_3M^2$, $—COOM^2$, —OH and $—NR^1R^2$, the group being directly or indirectly bonded to the heterocyclic residual group. $M^1$ and $M^2$ are independently a hydrogen, alkali metal, quaternary ammonium, quarternary phosphonium $R^1$ and $R^2$ are hydrogen or substituted or unsubstituted alkyl groups.

Typical examples of the heterocyclic residual group Q shown in the formula (A) are: an oxazole ring, a thiazole ring, an imidazole ring, a selenazole ring, a triazole ring, a tetrazole ring, a thiadiazole ring, an oxadiazole ring, a pentazole ring, a pyrimidine ring, a thiadia ring, a triazine ring, a thiadiazine ring, or a ring condensed to another carbon ring or heterocyclic ring (e.g., a benzothiazole ring, a benzotriazole ring, a benzimidazole ring, a benzoxazole ring, a benzoselenazole ring, a naphthoxazole ring, a triazaindolizine ring, a diazaindolizine ring, or a tetraazaindolizine ring.

In the mercapto heterocyclic compounds represented by the formula (A), particularly preferable are those represented by the following formulas (B) and (C):

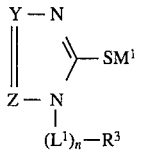

Formula (B)

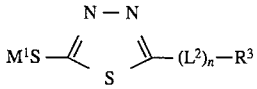

Formula (C)

In the formula (B), Y and Z are independently a nitrogen or $CR^4$, where $R^4$ is a hydrogen, substituted or unsubstituted alkyl group, or substituted or unsubstituted aryl group. $R^3$ is an organic residual group substituted by at least one group selected from the group consisting of $—SO_3M^2$, $—COOM^2$, —OH and $—NR^1R^2$. Typical example of $R^3$ are an alkyl group having 1 to 20 carbon atoms (e.g., methyl, ethyl, propyl, hexyl, dodecyl, or octadecyl), and an aryl group having 6 to 20 carbon atoms (e.g., phenyl or naphthyl). $L^1$ is a linking group selected from the group consisting of —S—, —O—, —N—, —CO—, —SO— and $—SO_2—$. In formula (B), n is 0 or 1.

The alkyl group and the aryl group, both described above, can be further substituted by another substituent such as a halogen atom (e.g., F, Cl, or Br), an alkoxy group (e.g., methoxy or methoxyethoxy), an aryloxy group (e.g., phenoxy), an alkyl group (if $R^2$ is an aryl group), an aryl group (if $R^2$ is an alkyl group), an amido group (e.g., acetamido or benzoylamino), a carbamoyl group (e.g., unsubstituted carbamoyl, phenylcarbamoyl, or methylcarbamoyl), a sulfonamido group (e.g., methanesulfonamido or phenylsulfonamido), a sulfamoyl group (e.g., unsubstituted sulfamoyl, methylsulfamoyl, or phenylsulfamoyl), a sulfonyl group (e.g., methylsulfonyl or phenylsulfonyl), a sulfinyl group (e.g., methylsulfinyl or phenylsulfinyl), a cyano group, an alkoxycarbonyl group (e.g., methoxycarbonyl), an aryloxycarbonyl group (e.g., phenoxycarbonyl), or a nitro group.

If there are two or more substituents for $R^3$, such as $—SO_3M^2$, $—COOM^2$, —OH or $—NR^1R^2$, they can either identical or different.

$M^2$ is of the same meaning as has been explained in conjunction with the formula (A).

In the formula (C), X is a sulfur, an oxygen, or $—N(R^5)—$, where $R^5$ is a hydrogen, a substituted or unsubstituted alkyl group, or a substituted or unsubstituted aryl group. $L^2$ is $—CONR^6—$, $—NR^6CO—$, $—SO_2NR^6—$, $—NR^6SO_2—$, —OCO—, —COO—, —S—, $—NR^6—$, —CO—, —SO—, —OCOO—, $—NR^6CONR^7—$, —$NR^6COO$—, —$OCONR^6$— , or —$NR^6SO_2NR^7$—, where $R^6$ and $R^7$ are each a hydrogen, a substituted or unsubstituted alkyl group, or a substituted or unsubstituted aryl group.

$R^3$ and $M^2$ are of the same meaning as has been described in connection with the formulas (A) and (B), and n is 0 or 1.

Examples of the substituents for the alkyl groups and aryl groups, which are represented by $R^4$, $R^5$, $R^6$, and $R^7$, are identical to those exemplified as the substituent for $R^3$.

Particularly preferred as the compounds represented by the formulas (B) and (C) are those in which $R^3$ is —$SO_3M^2$ or —$COOM^2$.

Typical examples of the preferable compound represented by the formula (A), which is used in the present invention, will be shown below:

(1)

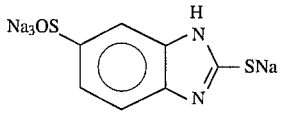

(2)

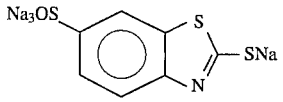

(3)

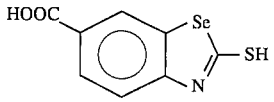

(4)

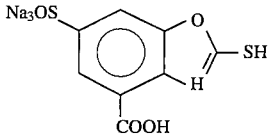

(5)

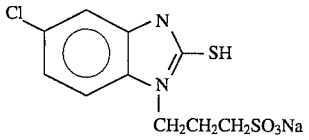

(6)

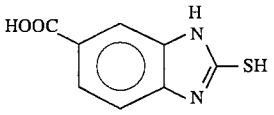

(7)

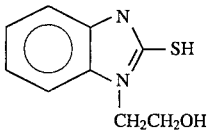

(8)

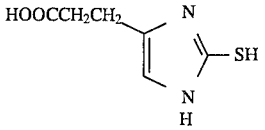

-continued (9)

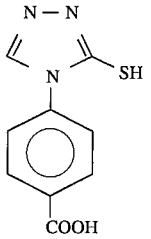

(10)

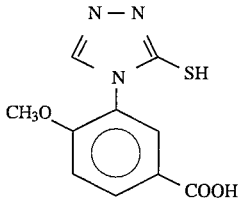

(11)

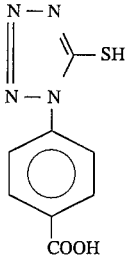

(12)

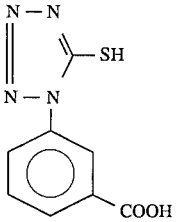

(13)

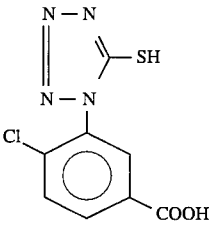

(14)

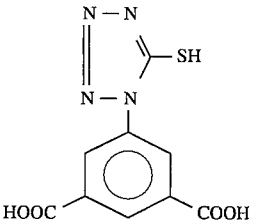

(15)

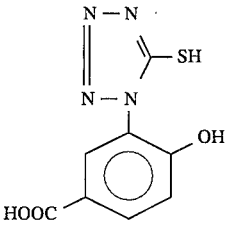

-continued
(16)
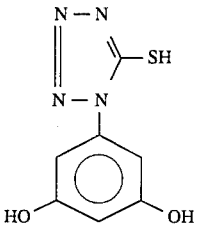
(17)
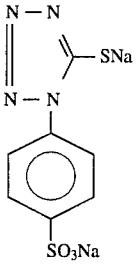
(18)
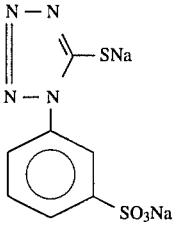
(19)
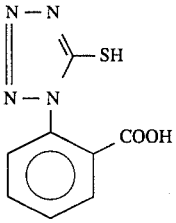
(20)
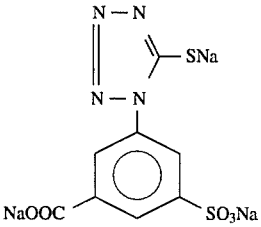
(21)
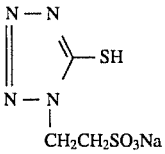
(22)
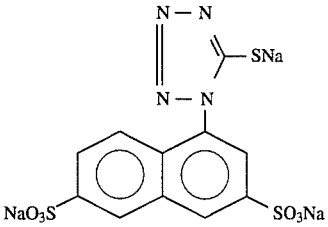
-continued
(23)
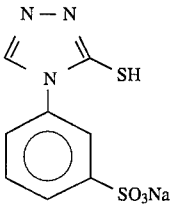
(24)
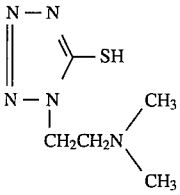
(25)
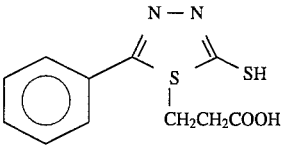
(26)
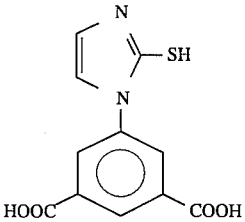
(27)
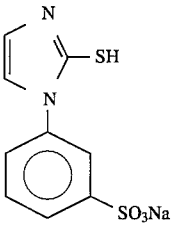
(28)
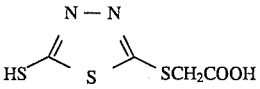
(29)
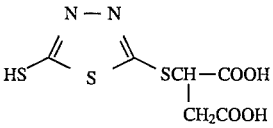
(30)
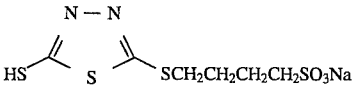
(31)
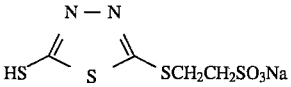
(32)
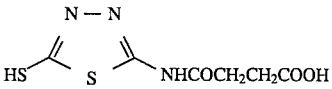
(33)
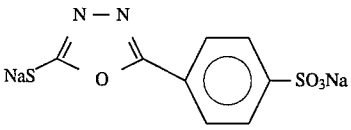

-continued (34)

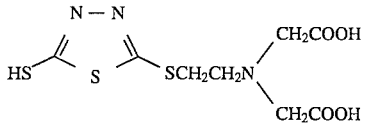

(35)

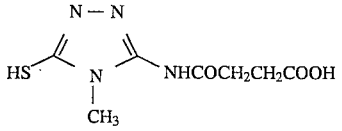

(36)

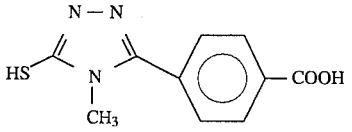

(37)

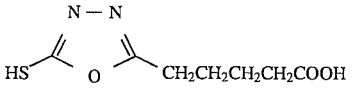

(38)

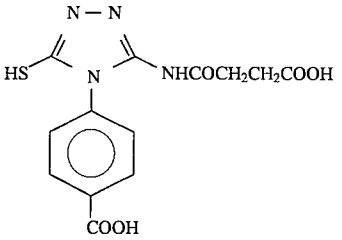

(39)

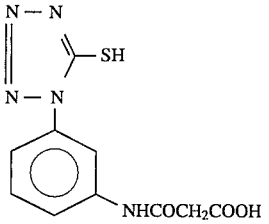

The compound of the formula (A) is known, and can be synthesized by the methods disclosed in U.S. Pat. Nos. 2,585,388 and 2,541,924, JP-B-42-21842 ("JP-B" means Published Examined Japanese Patent Application), JP-A-53-50169, British Patent 1,275,701, D. A. Berges et al., "Journal of the Heterocyclic Chemistry," Vol. 15, No. 981 (1978), "Imidazole and Derivatives, Part I" in *The Chemistry of Heterocyclic Chemistry*, pp. 336–9, "Chemical Abstract," Vol. 58, No. 7921 (1963), p. 394, E. Hoggarth, "Journal of Chemical Society," pp. 1160–7 (1946), S. R. Saudler, W. Karo, "Organic Functional Group Preparation," Academic Press, pp. 312–5 (1968), M. Chamdon, et al., "Bulletin de la Societe Chimique de France," 723 (1954), D. A. Shirley, D. W. Alley, "Journal of American Chemical Society," 79, 4922 (1954), A. Wohl, W. Marchwald, "Chemiche Berichte" (Journal of German Chemical Society), Vol. 22, pp. 568 (1889), Journal of American Chemical Society, 44, pp. 1502–10, U.S. Pat. No. 3,017,270, British Patent 940,169, JP-B-49-8334, JP-A-55-59463, "Advanced in Heterocyclic Chemistry," 9, 165–209 (1968), West German Patent 2,716,707, "The Chemistry of Heterocyclic Compounds Imidazole and Derivatives," Vol. 1, p. 384, "Organic Synthesis," IV., 569 (1963), "Chemiche Berichte," 9, 465 (1976), "Journal of American Chemical Society," 45, 2390 (1923), JP-A-50-89034, JP-A-53-28426, JP-A-55-21007, and JP-A-40-28496.

Preferably, the compound of the formula (A) is contained in an silver halide emulsion layer and a hydrophilic colloid layer (e.g., an interlayer, a surface protective layer, an yellow filter layer, an antihalation layer). More preferably, the compound is contained in a silver halide emulsion layer or a layer formed adjacent thereto. The compound is used in an amount of $1\times10^{-7}$ to $1\times10^{-3}$ mol/m$^2$, preferably $5\times10^{-7}$ to $1\times10^{-4}$ mol/m$^2$, more preferably $1\times10^{-6}$ to $1\times10^{-5}$ mol/m$^2$.

It is preferred that the emulsion of the invention is a monodispersed one.

The monodispersed emulsion according to this invention is an emulsion having a particle-size distribution which has a coefficient of variation of 0.25 or less with respect to grain size of silver halide grains. The term "coefficient of variation" is a value obtained by dividing the standard deviation of grain size by the average grain size. The average grain size r is defined as follows:

$$r=\frac{\Sigma ni\cdot ri}{\Sigma ni}$$

where ri is the diameter of each grain, and ni is the number of grains.

The standard deviation S of grain size is defined as follows:

$$S=\sqrt{\frac{\Sigma(r-ri)^2\cdot ni}{\Sigma ni}}$$

The "grain size" of each grain in the present invention is the equivalent-circle diameter of projected area which is determined from a microscope photograph taken of the silver halide emulsion by the known method in the art (usually by an electron microscope), as is disclosed in T. H. James et al., "The Theory of the Photographic Process," third ed., pp. 36–43, Macmillan (1966). As is defined in the book, the term "equivalent-circle diameter of projected area" is defined as the diameter of the circle whose area is equal to the projected area of a silver halide grain. Hence, even if the silver halide grains are not spherical (e.g., cubic, octahedron, tetrahedron, tabular form, potato-shaped form), their average grain size r and the standard deviation S thereof can be obtained.

The coefficient of variation related to grain size of the silver halide grain is 0.25 or less, preferably 0.20 or less, and more preferably 0.15 or less.

According to the invention, only one emulsion or two or more emulsions having different grain sizes can be used in light-sensitive emulsion layers. In the case where two or more emulsions are used, they can be used in different light-sensitive layers, respectively, or in the same light-sensitive layer in the form of a mixture. Further, in the case of using two or more emulsions, emulsion grains which have a stratiform structure and a silver iodide content falling within the scope of the invention, and an emulsion grains having no stratiform structure and a silver iodide content outside the scope of the invention can be used together. Two or more emulsions should better be used in various combinations as described above, for the purpose of controlling the gradation and the graininess from low-exposure range to high-exposure range, and color-development dependency (time-dependency, pH-dependency, and the dependency on the composition of the development solution containing a color developing agent and sodium sulfide.)

The light-sensitive material of the present invention needs only to have at least one set of silver halide emulsion layers, i.e., a blue-sensitive layer, a green-sensitive layer, and a red-sensitive layer, on a support. The number or order of the silver halide emulsion layers and the non-light-sensitive layers are particularly not limited. A typical example is a silver halide photographic light-sensitive material having, on a support, at least one light-sensitive layers constituted by a plurality of silver halide emulsion layers each of which have essentially the same color sensitivity but different sensitivities. In this case, the light-sensitive layers are unit light-sensitive layer having color sensitive to light of blue, green or red. In a multilayered silver halide color photographic light-sensitive material, the unit light-sensitive layers are generally arranged in such order that red-, green-, and blue-sensitive layers are formed from a support side. However, this order may be reversed or a layer sensitive to one color may be sandwiched between layers sensitive to another color in accordance with the application.

Non-light-sensitive layers such as various types of interlayers may be formed between the silver halide light-sensitive layers described above and at the upper-most layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, two-layers of high- and low-sensitivity emulsion layers can be preferably used as described in West German Patent 1,121,470 or British Patent 923,045. In this case, layers are preferably arranged such that the sensitivity is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-sensitivity emulsion layer is formed remotely from a support and a high-sensitivity layer is formed close to the support.

More specifically, layers may be arranged from the farthest side from a support in an order of slow-speed blue-sensitive layer (BL)/high-speed blue-sensitive layer (BH)/high-speed green-sensitive layer (GH)/low-speed green-sensitive layer (GL)/high-shaped red-sensitive layer (RH)/low-speed red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-A-56-25738 and JP-A-62-63936, layers may be arranged from the farthest side from a support in an order of blue-sensitive layer/GL/RL/GH/RH.

There is another example as follows;

As described in JP-B-49-15495, three layers may be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities may be arranged such that the sensitivity is sequentially decreased toward the support. When a layer structure is constituted by three layers having different sensitivities, these layers may be arranged in an order of medium-speed emulsion layer/high-speed emulsion layer/low-speed emulsion layer from the farthest side from a support in a same color sensitive layer as described in JP-A-59-202464.

Also, an order of high-sensitivity emulsion layer/low-sensitivity emulsion layer/medium-sensitivity emulsion layer or low-sensitivity emulsion layer/medium-sensitivity emulsion layer/high-sensitivity emulsion layer may be adopted. Furthermore, the arrangement can be changed as described above even when four or more layers are formed.

To improve the color reproduction, it is preferable that a donor layer (CL) can be in the proximity to, or arranged adjacent to, a major light-sensitive layer such as BH, BL, GH, GL, RH, or RL. The donor layer shows interlayer effect which is different in spectral sensitivity distribution from that of the major light-sensitive layer. Donor layers of this type are disclosed in U.S. Pat. Nos. 4,663,271, 4,705,744, 4,707,436, JP-A-62-160448, and JP-A-63-89850.

As described above, various layer types and arrangements can be selected in accordance with the purpose of the light-sensitive material.

A preferable silver halide contained in photographic emulsion layers of the photographic light-sensitive material of the present invention is silver bromoiodide, silver chloroiodide, or silver chlorobroiodide containing about 30 mol % or less of silver iodide. The most preferable silver halide is silver bromoiodide or silver chlorobromoiodide containing about 2 mol % to about 10 mol % of silver iodide.

Silver halide grains contained in the photographic emulsion may have regular crystals such as cubic, octahedron, or tetradecahedron crystals, irregular crystal form such as spherical and tabular crystals, crystals having defects such as twined crystal plane, or composite shapes thereof.

The silver halide may be fine grains having a grain size of about 0.2 μm or less, large grains having a projected-area diameter of up to 10 μm, and the emulsion may be either a polydispersed or monodispersed emulsion.

The silver halide photographic emulsion which can be used in the present invention can be prepared by methods described in, for example, Research Disclosure (RD) No. 17,643 (December, 1978), pp. 22 to 23, "I. Emulsion preparation and types", RD No. 18,716 (November, 1979), page 648, and RD No. 307,105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodispersed emulsions described in, for example, U.S. Pat. Nos. 3,574,628 and 3,655,364 and British Patent 1,413,748 are also preferred.

Also, tabular grains having an aspect ratio of about 3 or more can be used in the present invention. The tabular grains can be easily prepared by methods described in, e.g., Gutoff, "Photographic Science and Engineering", Vol. 14, PP. 248 to 257 (1970); U.S. Pat. Nos. 4,434,226, 4,414,310, 4,433,048, and 4,439,520, and British Patent 2,112,157.

The crystal structure may be uniform, may have different halogen compositions in the interior and the surface thereof, or may be a stratiform structure. Alternatively, a silver halide having a different composition may be joined by an epitaxial junction or a compound except for a silver halide such as silver rhodanide or zinc oxide may be joined. A mixture of grains having various types of crystal shapes may be used.

The above emulsion may be of any of a surface latent image type in which a latent image is mainly formed on the surface of each grain, an internal latent image type in which a latent image is formed in the interior of each grain, and a type in which a latent image is formed on the surface and in the interior of each grain. However, the emulsion must be of a negative type. When the emulsion is of an internal latent image type, it may be a core/shell internal latent image type emulsion described in JP-A-63-264740. A method of preparing this core/shell internal latent image type emulsion is described in JP-A-59-133542. Although the thickness of a shell of this emulsion changes in accordance with development or the like, it is preferably 3 to 40 nm, and most preferably, 5 to 20 nm.

A silver halide emulsion layer is normally subjected to physical ripening, chemical ripening, and spectral sensitization steps before it is used. Additives for use in these steps are described in Research Disclosure Nos. 17,643, 18,716, and 307,105 and they are summarized in the following table.

In the light-sensitive material of the present invention, two or more kinds of emulsions different in at least one characteristic of grain size, grain size distribution, halogen composition, grain shape, and sensitivity can be mixed in one layer.

A surface-fogged silver halide grain described in U.S. Pat. No. 4,082,553, an internally fogged silver halide grain described in U.S. Pat. No. 4,626,498 or JP-A-59-214852, and colloidal silver can be preferably used in a light-sensitive silver halide emulsion layer and/or a substantially non-light-sensitive hydrophilic colloid layer. The internally fogged or surface-fogged silver halide grains are silver halide grains which can be uniformly (non-imagewise) developed in either a non-exposed portion or an exposed portion of the light-sensitive material. A method of preparing the internally fogged or surface-fogged silver halide grain is described in U.S. Pat. No. 4,626,498 or JP-A-59-214852.

A silver halide which forms the core of an internally fogged core/shell type silver halide grain may have the same halogen composition as or a different halogen composition from that of the other portion. Examples of the internally fogged or surface-fogged silver halide are silver chloride, silver chlorobromide, silver bromoiodide, and silver chloroiodobromide. Although the grain size of these fogged silver halide grains is not particularly limited, an average grain size is 0.01 to 0.75 μm, and most preferably, 0.05 to 0.6 μm. The grain shape is also not particularly limited but may be a regular grain shape. Although the emulsion may be a polydispersed emulsion, it is preferably a monodispersed emulsion (in which at least 95% in weight or number of silver halide grains have a grain size falling within the range of ±40% of an average grain size).

In the present invention, a non-light-sensitive fine grain silver halide is preferably used. The non-light-sensitive fine grain silver halide means silver halide fine grains not sensitive upon imagewise exposure for obtaining a dye image and essentially not developed in development. Such the non-light-sensitive fine grain silver halide is preferably not fogged beforehand.

The fine grain silver halide contains 0 to 100 mol % of silver bromide and may contain silver chloride and/or silver iodide as needed. Preferably, the fine grain silver halide contains 0.5 to 10 mol % of silver iodide.

An average grain size (an average value of equivalent-circle diameters of projected surface areas) of the fine grain silver halide is preferably 0.01 to 0.5 μm, and more preferably, 0.02 to 0.2 μm.

The fine grain silver halide can be prepared by a method similar to a method of preparing normal light-sensitive material silver halide. In this preparation, the surface of a silver halide grain need not be subjected to either optical sensitization or spectral sensitization. However, before the silver halide grains are added to a coating solution, a known stabilizer such as a triazole compound, an azaindene compound, a benzothiazolium compound, a mercapto compound, or a zinc compound is preferably added. The layer containing this fine grain silver halide grain preferably contains a colloidal silver.

A coating silver amount of the light-sensitive material of the present invention is preferably 6.0 g/m$^2$ or less, and most preferably, 4.5 g/m$^2$ or less.

Known photographic additives usable in the present invention are also described in the above three RDs, and they are summarized in the following Table 1:

TABLE 1

| Additives | RD17643 Dec., 1978 | RD18716 Nov., 1979 | RD307105 Nov., 1989 |
|---|---|---|---|
| 1. Chemical sensitizers | page 23 | page 648, right column | page 866 |
| 2. Sensitivity increasing agents | | page 648, right column | |
| 3. Spectral sensitizers, super sensitizers | pp. 23–24 | page 648, right column to page 649, right column | pp. 866–868 |
| 4. Brighteners | page 24 | page 647, right column | page 868 |
| 5. Antifog agents and stabilizers | pp. 24–25 | page 649. right column | pp. 868–870 |
| 6. Light absorbent. filter dye. ultraviolet absorbents | pp. 25–26 | page 649, right column to page 650, left column | page 873 |
| 7. Stain preventing agents | page 25, right column | page 650. left to right columns | page 872 |
| 8. Dye image stabilizer | page 25 | page 650, left column | page 872 |
| 9. Hardening agents | page 26 | page 651, left column | pp. 874–875 |
| 10. Binder | page 26 | page 651, left column | pp. 873–874 |
| 11. Plasticizers. lubricants | page 27 | page 650, right column | page 876 |
| 12. Coating aids. surface active agents | pp. 26–27 | page 650, right column | pp. 875–876 |
| 13. Antistatic agents | page 27 | page 650, right column | pp. 876–877 |
| 14. Matting agent | | | pp. 878–879 |

In order to prevent degradation in photographic properties caused by formaldehyde gas, a compound described in U.S. Pat. Nos. 4,411,987 or 4,435,503, which can react with formaldehyde to fix, is preferably added to the light-sensitive material.

The light-sensitive material of the present invention preferably contains mercapto compounds described in U.S. Pat. Nos. 4,740,454 and 4,788,132, JP-A-62-18539, and JP-A-1-283551.

The light-sensitive material of the present invention preferably contains compounds for releasing a fogging agent, a development accelerator, a silver halide solvent, or precursors thereof described in JP-A-1-106052 regardless of a developed silver amount produced by the development.

The light-sensitive material of the present invention preferably contains dyes dispersed by methods described in WO 88/04794 and JP-A-1-502912 or dyes described in European Patent 317,308A, U.S. Pat. No. 4,420,555, and JP-A-1-259358.

Various color couplers can be used in the present invention, and typical examples of these couplers are described in patents described in above-mentioned Research Disclosure (RD), No. 17643, VII-C to VII-G and RD No. 307105, VII-C to VII-G.

Preferable examples of a yellow coupler are, besides those represented by the formulas (I) and (II), described in, e.g., U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and EP 249,473A.

Examples of a magenta coupler are preferably 5-pyrazolone and pyrazoloazole compounds, and more preferably, compounds described in, e.g., U.S. Pat. Nos. 4,310,619 and 4,351,897, EP 73,636, U.S. Pat. Nos. 3,061,432 and 3,725,067, Research Disclosure No. 24220 (June 1984), JP-A-60-33552, Research Disclosure No. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,556,630, and WO No. 88/04795.

Examples of a cyan coupler are phenol and naphthol couplers. Of these, preferable couplers are those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Laid-open Application 3,329,729, European Patents 121,365A and 249,453A, U.S. Pat. Nos. 3,446,622, 4,333,999, 4,775,616, 4,451,559, 4,427,767, 4,690,889, 4,254,212, and 4,296,199, and JP-A-61-42658. In addition, the pyrazoloazole-series couplers disclosed in JP-A-64-553, JP-A-64-554, JP-A-64-555 and JP-A-64-556, and imidazole-series couplers disclosed in U.S. Pat. No. 4,818,672 can be used as cyan coupler in the present invention.

Typical examples of a polymerized dye-forming coupler are described in U.S. Pat. Nos. 3,451,820, 4,080,211, 4,367,282, 4,409,320, and 4,576,910, British Patent 2,102,137, and EP 341,188A.

Preferable examples of a coupler capable of forming colored dyes having proper diffusibility are described in U.S. Pat. No. 4,366,237, British Patent 2,125,570, EP 96,570, and West German Laid-open Patent Application No. 3,234,533.

Preferable examples of a colored coupler to revise undesirable absorption of a colored dye are described in Research Disclosure No. 17643, VII-G, No. 307105, VII-G, U.S. Pat. No. 4,163,670, JP-B-57-39413, U.S. Pat. Nos. 4,004,929 and 4,138,258, and British Patent 1,146,368. A coupler to revise undesirable absorption of a colored dye by a fluorescent dye released upon coupling described in U.S. Pat. No. 4,774,181 or a coupler having, as leaving group, a dye precursor group which can react with a developing agent to form a dye described in U.S. Pat. No. 4,777,120 may be preferably used.

Compounds releasing a photographically useful residue upon coupling are preferably used in the present invention. DIR couplers which release a development inhibitor are described in the patents cited in the above-described RD No. 17643, VII-F, RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Research Disclosure Nos. 11449 and 24241, JP-A-61-201247, and the like disclose couplers which release breaching accelerator. These couplers effectively serve to shorten the time of any process that involves breaching. They are effective, particularly when added to light-sensitive material containing tabular silver halide grains. Preferable examples of a coupler for imagewise releasing a nucleating agent or a development accelerator are described in British Patents 2,097,140 and 2,131,188, JP-A-59-157638, and JP-A-59-170840. In addition, compounds for releasing a fogging agent, a development accelerator, or a silver halide solvent upon redox reaction with an oxidized form of a developing agent, described in JP-A-60-107029, JP-A-60-252340, JP-A-1-44940, and JP-A-1-45687, can also be preferably used.

Examples of a coupler which can be used in the light-sensitive material of the present invention are competing couplers described in, e.g., U.S. Pat. No. 4,130,427; multi-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, e.g., JP-A-60-185950 and JP-A-62-24252; couplers releasing a dye which turns to a colored form after being released described in EP 173,302A and 313,308A; a ligand releasing coupler described in, e.g., U.S. Pat. No. 4,555,477; a coupler releasing a leuco dye described in JP-A-63-75747; and a coupler releasing a fluorescent dye described in U.S. Pat. No. 4,774,181.

The couplers for use in this invention can be added to the light-sensitive material by various known dispersion methods.

Examples of a high-boiling organic solvent to be used in the oil-in-water dispersion method are described in, e.g., U.S. Pat. No. 2,322,027. Typical examples of a high-boiling organic solvent having a boiling point of 175° C. or more under atmospheric pressure to be used in the oil-in-water dispersion method are phthalic esters (e.g., dibutylphthalate, dicyclohexylphthalate, di-2-ethylhexylphthalate, decylphthalate, bis(2,4-di-t-amylphenyl)phthalate, bis(2,4-di-t-amylphenyl)-isophthalate, bis(1,1-diethylpropyl)phthalate), phosphates or phosphonates (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoates (e.g., 2-ethylhexylbenzoate, dodecylbenzoate, and 2-ethylhexyl-p-hydroxybenzoate), amides (e.g., N,N-diethyldodecanamide, N,N-diethyllaurylamide, and N-tetradecylpyrrolidone), alcohols or phenols (e.g., isostearylalcohol and 2,4-di-tert-amylphenol), aliphatic carboxylates (e.g., bis(2-ethylhexyl)sebacate, dioctyl azelate, glycerol tributylate, isostearyl lactate, and trioctyl citrate), an aniline derivative (e.g., N,N-dibutyl-2-butoxy-5-tert-octylaniline), and hydrocarbons (e.g., paraffin, dodecylbenzene, and diisopropylnaphthalene). An organic solvent having a boiling point of about 30° C. or more, and preferably, 50° C. to about 160° C. can be used as an auxiliary solvent. Typical examples of the auxiliary solvent are ethyl acetate, butyl acetate, ethyl propionate, methyl ethyl ketone, cyclohexanone, 2-ethoxyethyl acetate, and dimethylformamide.

Steps and effects of a latex dispersion method and examples of a loadable latex are described in, e.g., U.S. Pat. No. 4,199,363 and German Laid-open Patent Application Nos. 2,541,274 and 2,541,230.

Various types of antiseptics and fungicides agent are preferably added to the color light-sensitive material of the present invention. Examples of the antiseptics and the fungicides are phenethyl alcohol, and 1,2-benzisothiazolin-3-one, n-butyl-p-hydroxybenzoate, phenol, 4-chloro-3,5-dimethylphenol, 2-phenoxyethanol, and 2-(4-thiazolyl)benzimidazole described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, color paper, a color positive film, and color reversal paper.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the sum total of film thicknesses of all hydrophilic colloidal layers at the side having emulsion layers is preferably 28 μm or less, more preferably, 23 μm or less, much more preferably, 18 μm or less, and most preferably, 16 μm or less. A film swell speed $T_{1/2}$ is preferably 30 sec. or less, and more preferably, 20 sec. or less. The film thickness means a film thickness measured under moisture conditioning at a temperature of 25° C. and a relative humidity of 55% (two days). The film swell speed $T_{1/2}$ can be measured in accordance with a known method in the art. For example, the film swell speed $T_{1/2}$ can be measured by using a swell meter described in A. Green et al., Photographic Science & Engineering, Vol. 19, No. 2, pp. 124 to 129. When 90% of a maximum swell film thickness reached by performing a treatment by using a color developing agent at 30° C. for 3 min. and 15 sec. is defined as a saturated film thickness, $T_{1/2}$ is defined as a time required for reaching ½ of the saturated film thickness.

The film swell speed $T_{1/2}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation: (maximum swell film thickness—film thickness)/film thickness.

In the light-sensitive material of the present invention, hydrophilic colloid layers (called back layers) having a total dried film thickness of 2 to 20 μm are preferably formed on the side opposite to the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant described above. The swell ratio of the back layers is preferably 150% to 500%.

The color photographic light-sensitive material according to the present invention can be developed by conventional methods described in RD. No. 17643, pp. 28 and 29, RD. No. 18716, the left to right columns of page 651, and RD. No. 307105, pp. 880 and 881.

A color developer used in development of the light-sensitive material of the present invention is an aqueous alkaline solution containing as a main component, preferably, an aromatic primary amine-based color developing agent. As the color developing agent, although an aminophenol compounds is effective, a p-phenylenediamine compounds is preferably used. Typical examples of the p-phenylenediamine compounds are: 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides and p-toluene sulfonates thereof. Of these compounds, 3-methyl-4-amino-N-ethyl-N-β-hydroxyethylaniline sulfate, is preferred in particular. These compounds can be used in a combination of two or more thereof in accordance with the application.

In general, the color developer contains a pH buffering agent such as a carbonate, a borate, or a phosphate of an alkali metal, and a development restrainer or an antifoggant such as a chloride salt, a bromide salt, an iodide salt, a benzimidazole, a benzothiazole, or a mercapto compound. If necessary, the color developer may also contain a preservative such as hydroxylamine, diethylhydroxylamine, salt of sulfurous acid, a hydrazine, such as N,N-biscarboxymethylhydrazine, a phenylsemicarbazide, triethanolamine, or a catechol sulfonic acid; an organic solvent such as ethyleneglycol or diethyleneglycol; a development accelerator such as benzyl alcohol, polyethyleneglycol, a quaternary ammonium salt or an amine; a dye-forming coupler; a competing coupler; an auxiliary developing agent such as 1-phenyl-3-pyrazolidone; a viscosity-imparting agent; and various chelating agents such as aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(O-hydroxyphenylacetic acid), and salts thereof.

In the case of carrying out reversal development, black-and-white development is performed and then color development is performed. As a black-and-white developer, well-known black-and-white developing agents, e.g., dihydroxybenzenes such as hydroquinone, 3-pyrazolidones such as 1-phenyl-3-pyrazolidone, and aminophenols such as N-methyl-p-aminophenol can be singly or in a combination of two or more thereof. The pH of the color and black-and-white developers is generally 9 to 12. Although the quantity of replenisher of the developer depends on a color photographic light-sensitive material to be processed, it is generally 3 liters or less per $m^2$ of the light-sensitive material. The quantity of replenisher can be decreased to be 500 ml or less by decreasing a bromide ion concentration in a replenisher. In order to decrease the quantity of the replenisher, a contact area of a processing tank with air is preferably decreased to prevent evaporation and oxidation of the solution upon contact with air.

The contact area of the solution with air in a processing tank can be represented by an aperture defined below:

Aperture=[contact area ($cm^2$) of processing solution with air]/[volume ($cm^3$) of the solution]

The above aperture is preferably 0.1 or less, and more preferably, 0.001 to 0.05. In order to reduce the aperture, a shielding member such as a floating cover may be provided on the surface of the photographic processing solution in the processing tank. In addition, a method of using a movable cover described in JP-A-1-82033 or a slit developing method descried in JP-A-63-216050 may be used. The aperture is preferably reduced not only in color and black-and-white development steps but also in all subsequent steps, e.g., bleaching, bleach-fixing, fixing, washing, and stabilizing steps. In addition, the quantity of replenisher can be reduced by using a means of suppressing storage of bromide ions in the developing solution.

A color development time is normally 2 to 5 minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are a compound of a multivalent metal, e.g., iron(III), peroxides; quinones; and a nitro compound. Typical examples of the bleaching agent are an organic complex salt of iron(III), e.g., a iron(III) complex salt of an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid; or a iron(III) complex salt of citric acid, tartaric acid, or malic acid. Of these compounds, an iron(III) complex salt of aminopolycarboxylic acid such as an iron(III) complex salt of ethylenediaminetetraacetic acid or 1,3-diaminopropanetetraacetic acid is preferred because it can increase a processing speed and prevent an environmental contamination. The iron(III) complex salt of aminopolycarboxylic acid is useful in both the bleaching and bleach-fixing solutions. The pH of the bleaching or bleach-fixing solution using the iron(III) complex salt of aminopolycarboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Useful examples of the bleaching accelerator are: compounds having a mercapto group or a disulfide group described in, e.g., U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, and JP-A-53-141623, and JP-A-53-28426, and Research Disclosure No. 17,129 (July, 1978); a thiazolidine derivative described in JP-A-50-140129; thiourea derivatives described in JP-B-45-8506, JP-A-52-20832, JP-A-53-32735, and U.S. Pat. No. 3,706,561; iodide salts described in West German Patent 1,127,715 and JP-A-58-16235; poly oxyethylene compounds described in West German Patents 996,410 and 2,748,430; a poly amine compound described in JP-B-45-8836; compounds described in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, e.g., acetic acid, propionic acid, or hydroxy acetic acid.

Examples of the fixing solution or the bleach-fixing solution are thiosulfate, a thiocyanate, a thioether compounds, a thiourea and a large amount of an iodide salt. Of these compounds, a thiosulfate, especially, ammonium thiosulfate can be used in the widest range of applications. In addition, a combination of thiosulfate and a thiocyanate, a thioether compounds, or thiourea is preferably used. As a preservative of the fixing solution or the bleach-fixing solution, a sulfite, a bisulfite, a carbonyl bisulfite adduct, or a sulfinic acid compound described in EP 294,769A is preferred. In addition, in order to stabilize the fixing solution or the bleach-fixing solution, various types of aminopolycarboxylic acids or organic phosphonic acids are preferably added to the solution.

In the present invention, 0.1 to 10 mol/l of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no desilvering defect occurs. A preferable time is one to three minutes, and more preferably, one to two minutes. A processing temperature is 25° C. to 50° C., and preferably, 35° C. to 45° C. within the preferable temperature range, a desilvering speed is increased, and generation of a stain after the processing can be effectively prevented. In the desilvering step, stirring is preferably as strong as possible. Examples of a method of intensifying the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyer means described in JP-A-60-191257, JP-A-60-191258, or JP-A-60-191259. As described in JP-A-60-191257, this conveyer means can significantly reduce carry-over of a processing solution from a pre-bath to a post-bath, thereby effectively preventing degradation in performance of the processing solution. This effect significantly shortens especially a processing time in each processing step and reduces the quantity of replenisher of a processing solution.

The photographic light-sensitive material of the present invention is normally subjected to washing and/or stabilizing steps after desilvering. An amount of water used in the washing step can be arbitrarily determined over a broad range in accordance with the properties (e.g., a property determined by the substances used, such as a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, pp. 248–253 (May, 1955). In the multi-stage counter-current scheme disclosed in this reference, the amount of water used for washing can be greatly decreased. Since washing water stays in the tanks for a long period of time, however, bacteria multiply and floating substances may be adversely attached to the light-sensitive material. In order to solve this problem in the process of the color photo graphic light-sensitive material of the present invention, a method of decreasing calcium and magnesium ions can be effectively utilized, as described in JP-A-62-288838. In addition, a germicide such as an isothiazolone compound and cyabendazole described in JP-A-57-8542, a chlorine-based germicide such as chlorinated sodium isocyanurate, and germicides such as benzotriazole described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bokabi Gakkai ed., "Dictionary of Antibacterial and Antifungal Agents", (1986), can be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of above washing. All known methods described in JP-A-57-8543, JP-A-58-14834, and JP-A-60-220345 can be used in such stabilizing processing.

In some cases, stabilizing is performed subsequently to above washing. An example is a stabilizing bath containing a dye stabilizing agent and a surface-active agent to be used as a final bath of the photographic color light-sensitive material. Examples of the dye stabilizing agent are formalin, an aldehyde such as glutaraldehyde, an N-methylol compound, hexamethylenetetramine, and an formaldehyde bisulfide. Various cheleting agents and fungicides can be added to the stabilizing bath.

An overflow solution produced upon washing and/or replenishment of the stabilizing solution can be reused in another step such as a desilvering step.

In the processing using an automatic developing machine or the like, if each processing solution described above is concentrated by evaporation, water is preferably added to correct condensation.

The silver halide color light-sensitive material of the present invention may contain a color developing agent in order to simplify processing and increases a processing speed. For this purpose, various types of precursors of a color developing agent can be preferably used. Examples of the precursor are an indoaniline compounds described in U.S. Pat. No. 3,342,597, Schiff base compounds described in U.S. Pat. No. 3,342,599 and Research Disclosure (RD) Nos. 14,850 and 15,159, an aldol compound described in RD No. 13,924, a metal salt complex described in U.S. Pat. No. 3,719,492, and an urethane compounds described in JP-A-53-135628.

The silver halide color light-sensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

The silver halide light-sensitive material of the present invention can be applied to thermal development light-sensitive materials described in, for example, U.S. Pat. No. 4,500,626, JP-A-60-133449, JP-A-59-218443, JP-A-61-238056, and European Patent 210,660A2.

The present invention will be described in more detail below by way of its examples, but the present invention is not limited to these examples.

EXAMPLE 1

(Preparation of Emulsions)

20 g of inactive gelatin, 2.4 g of potassium bromide, and 2.05 g of potassium iodide were dissolved in 800 ml of distilled water, forming an aqueous solution. While stirring this aqueous solution and maintaining it at 58° C., 150 cc of an aqueous solution containing 5.0 g of silver nitrate was added instantaneously to the solution. Thereafter, an excess potassium bromide was added to the solution, thus physically ripening the solution for 20 minutes. Then, according to the method disclosed in U.S. Pat. No. 4,242,445 a 0.2 mol/liter silver nitrate aqueous solution, a 0.67 mol/liter silver nitrate aqueous solution, a 2 mol/liter silver nitrate aqueous solution, and a potassium halide aqueous solution (mixfare of 58 mol % of potassium bromide and 42 mol % of potassium iodide) were added to the solution, respectively, at a flow rate of 10 cc/min to grow 42 mol % silver bromoiodide grains. In order to remove salts, it was washed with water to prepare emulsion a. The finished amount of emulsion was 900 g. Emulsion a had an average grain size of 0.61 μm.

Emulsions b, c, d, and e were having 42 mol % of silver iodide content and grain sizes of 0.59 μm, 0.56 μm, 0.52 μm, and 0.46 μm, respectively, prepared by the same method as emulsion a.

850 cc of distilled water and 30 cc of 10% potassium bromide solution were added to 300 g of emulsion a. The resultant solution was heated to 70° C. While stirring the solution, 0.02 g of the compound (18) was added to the solution, thus maintaining pAg at 8.0. 300 cc of an aqueous solution containing 33 g of silver nitrate, and 320 cc of an aqueous solution containing 25 g of potassium bromide were simultaneously added to the solution over 40 minutes. Furthermore 800 cc of an aqueous solution containing 100 g of silver nitrate and 860 cc of aqueous solution containing 75 g of potassium bromide were simultamiously added to the mixture over 60 minute. Silver bromoiodide emulsion 1 was thereby prepared, which contained grains having a silver iodide content of 14 mol % and a grain size of 0.88 μm. The grains in emulsion 1 were twinned crystals having an aspect ratio of 2.0 and a (111) face ratio of 80%.

Also, emulsion 2 was prepared by using 300 g of emulsion b, by the same method as emulsion 1, except that 125 g of silver nitrate was used for forming shells. Emulsion 2 contained silver bromoiodide grains having a silver iodide content of 12 mol %.

Emulsions 3, 4, and 5 were also prepared by the methods similar to the method of preparing emulsion 2.

Further, emulsions 6 to 9 were prepared by the methods which are identical to the methods of preparing emulsions 1 to 4, respectively, except that shells were formed at 60° C., pAg was set at 9.0, and the compound (18) was not used at all.

Emulsion 10 was prepared by forming shells in the same way as the preparation of emulsion 3 from 300 g of emulsion c, using 133 g of emulsion b and 167 g of emulsion d.

Emulsion 11 was prepared by forming shells in the same way as the preparation of emulsion 3 from 300 g of emulsion c, using 50 g of emulsion a and 50 g of emulsion d. Emulsiions 12 and 13 were prepared by methods identical to the methods of preparing emulsions 1 and 4, respectively, except that the compound (18) was not used, and pAg was set at 7.5.

Further, silver bromoiodide emulsion f was prepared which contained grains having an average size of 0.82 μm and a silver bromoiodide content of 14 mol %. Shells of silver bromide were formed on the grains of emulsion f, whereby emulsion 14 was prepared.

Silver iodobromide emulsions g to k were prepared by the methods similar to the method of preparing emulsion a. Emulsions g, h, i, j, and k had silver iodide contents of 14 mol %, 12 mol %, 10 mol %, 8.6 mol %, and 6.4 mol %, respectively. Shells of the same halogen composition were formed for the seed emulsions g to k, thereby preparing emulsions 15 to 19.

Characteristic values of the emulsions 1 to 15, were summarized in the following Table 2:

TABLE 2

| Emulsion | AgI Content (%) Core | AgI Content (%) Shell | Core/shell ratio (in molar ratio of Ag content) | Average AgI content (mol %) | Distinct stratiform | Average grain size (μm) | Coefficient of variation (%) according to grain size | Aspect ratio | Compound of formula [A] |
|---|---|---|---|---|---|---|---|---|---|
| 1 | 42 | 0 | 1/2 | 14.0 | Yes | 0.88 | 0.20 | 2.0 | (18) |
| 2 | 42 | 0 | 1/2.5 | 12.0 | " | 0.86 | 0.19 | 1.9 | " |
| 3 | 42 | 0 | 1/3.2 | 10.0 | " | 0.86 | 0.19 | 1.8 | " |
| 4 | 42 | 0 | 1/4 | 8.4 | " | 0.88 | 0.18 | 1.8 | " |
| 5 | 42 | 0 | 1/6 | 6.0 | " | 0.87 | 0.18 | 1.6 | " |
| 6 | 42 | 0 | 1/2 | 14.0 | No | 0.89 | 0.21 | 2.2 | — |
| 7 | 42 | 0 | 1/2.5 | 12.0 | " | 0.87 | 0.20 | 2.0 | — |
| 8 | 42 | 0 | 1/3.2 | 10.0 | " | 0.86 | 0.20 | 2.0 | — |
| 9 | 42 | 0 | 1/4 | 8.4 | " | 0.87 | 0.19 | 1.9 | — |
| 10 | 42 | 0 | 1/3.2 | 10.0 | Yes | 0.87 | 0.22 | 2.0 | (18) |
| 11 | 42 | 0 | 1/3.2 | 10.0 | Yes | 0.87 | 0.27 | 2.2 | (18) |
| 12 | 42 | 0 | 1/2 | 14.0 | " | 0.89 | 0.21 | 1.9 | — |
| 13 | 42 | 0 | 1/3.2 | 10.0 | " | 0.88 | 0.21 | 1.8 | — |
| 14 | 14 | 0 | 4/1 | 11.2 | No | 0.88 | 0.18 | 2.1 | (18) |
| 15 | 14 | 14 | — | 14 | " | 0.86 | 0.24 | 2.5 | " |
| 16 | 12 | 12 | — | 12 | " | 0.87 | 0.22 | 2.4 | " |
| 17 | 10 | 10 | — | 10 | " | 0.88 | 0.20 | 2.2 | " |
| 18 | 8.4 | 8.4 | — | 8.4 | " | 0.87 | 0.19 | 2.0 | " |
| 19 | 6.0 | 6.0 | — | 6.0 | " | 0.87 | 0.19 | 2.0 | " |

(Sample 101)

A multilayered color light-sensitive material, sample 101, consisting of a plurality of layers having the following compositions on an undercoated triacetylcellulose film support, was prepared.

(Compositions of light-sensitive layers)

Numerals corresponding to each component indicates a coating amount represented in units of g/m$^2$ for the coating amount of a silver halide represented by the coating amount of silver, in units of g/m$^2$ for the coating amount of a couper, additives and gelatin, and in units of moles per mole of a silver halide in the same layer for sensitizing dye.

(Sample 1)

| | |
|---|---|
| Layer 1: Antihalation layer | |
| Black colloidal silver | 0.25 |
| Gelatin | 0.90 |
| MxE-1 | $5.0 \times 10^{-3}$ |
| Layer 2: Interlayer | |
| Gelatin | 0.60 |
| UV-1 | $3.0 \times 10^{-2}$ |
| UV-2 | $6.0 \times 10^{-2}$ |
| UV-3 | $7.0 \times 10^{-2}$ |
| ExF-1 | $4.0 \times 10^{-3}$ |
| Solv-2 | $7.0 \times 10^{-2}$ |
| Layer 3: Slow-speed red-sensitive emulsion layer | |
| Silver bromoiodide emulsion (AgI: 2 mol %; equivalent-sphere diameter: 0.3 μm; coefficient of variation in equivalent-sphere diameter: 29%; regular-twin mixture grains; diameter/thickness: 2.5) | coating amount of silver 0.85 |

| | |
|---|---|
| Gelatin | 1.50 |
| ExS-1 | $1.0 \times 10^{-4}$ |
| ExS-2 | $3.0 \times 10^{-4}$ |
| ExS-3 | $1.0 \times 10^{-5}$ |
| ExC-1 | 0.11 |
| ExC-3 | 0.11 |
| ExC-4 | $3.0 \times 10^{-2}$ |
| ExC-7 | $1.0 \times 10^{-2}$ |
| Solv-1 | $7.0 \times 10^{-3}$ |

Layer 4: Medium-speed red-sensitive emulsion layer

| | |
|---|---|
| Silver bromoiodide emulsion (AgI: 4 mol %; equivalent-sphere diameter: 0.55 μm; coefficient of variation in equivalent-sphere diameter: 20%; regular-twin mixture grains; diameter/thickness: 1.0) | coating amount of silver 0.85 |
| Gelatin | 1.50 |
| ExS-1 | $1.0 \times 10^{-4}$ |
| ExS-2 | $3.0 \times 10^{-4}$ |
| ExS-3 | $1.0 \times 10^{-5}$ |
| ExC-1 | 0.16 |
| ExC-2 | $8.0 \times 10^{-2}$ |
| ExC-3 | 0.17 |
| ExC-7 | $1.5 \times 10^{-2}$ |
| ExY-1 | $2.0 \times 10^{-2}$ |
| ExY-2 | $1.0 \times 10^{-2}$ |
| Compound of the invention (CB-18) | $3.0 \times 10^{-2}$ |
| Cpd-10 | $1.0 \times 10^{-4}$ |
| Solv-1 | 0.10 |

Layer 5: High-speed red-sensitive emulsion layer

| | |
|---|---|
| Emulsion 1 | coating amount of silver 1.00 |
| Gelatin | 1.60 |
| ExS-1 | $1.0 \times 10^{-4}$ |
| ExS-2 | $3.0 \times 10^{-4}$ |
| ExS-3 | $1.0 \times 10^{-5}$ |
| ExC-5 | $7.0 \times 10^{-2}$ |
| ExC-6 | $8.0 \times 10^{-2}$ |
| ExC-7 | $1.5 \times 10^{-2}$ |
| Compound of the invention (CB-18) | $3.0 \times 10^{-2}$ |
| Solv-1 | 0.15 |
| Solve-2 | $8.0 \times 10^{-2}$ |

Layer 6: Interlayer

| | |
|---|---|
| Gelatin | 0.50 |
| P-2 | 0.17 |
| Cpd-1 | 0.10 |
| Cpd-4 | 0.17 |
| Solv-1 | $5.0 \times 10^{-2}$ |

Layer 7: Low-speed green-sensitive emulsion layer

| | |
|---|---|
| Silver bromoiodide emulsion (AgI: 2 mol %; equivalent-sphere diameter: 0.3 μm; coefficient of variation in equivalent-sphere diameter: 28%; twinned grains; diameter/thickness: 2.5) | coating amount of silver 0.30 |
| Gelatin | 0.50 |
| ExS-4 | $5.0 \times 10^{-4}$ |
| ExS-5 | $2.0 \times 10^{-4}$ |
| ExS-6 | $0.3 \times 10^{-4}$ |
| ExM-1 | $3.0 \times 10^{-2}$ |
| ExM-2 | 0.20 |
| ExY-1 | $3.0 \times 10^{-2}$ |
| Cpd-11 | $7.0 \times 10^{-3}$ |
| Solv-1 | 0.20 |

Layer 8: Medium-speed green-sensitive emulsion layer

| | |
|---|---|
| Silver bromoiodide emulsion (AgI: 4 mol %; equivalent-sphere diameter: 0.55 μm; coefficient of variation in equivalent-sphere diameter: 20%; regular-twin mixture grains; diameter/thickness: 4.0) | coating amount of silver 0.70 |
| Gelatin | 1.00 |

| | |
|---|---|
| ExS-4 | $5.0 \times 10^{-4}$ |
| ExS-5 | $2.0 \times 10^{-4}$ |
| ExS-6 | $3.0 \times 10^{-5}$ |
| ExM-1 | $3.0 \times 10^{-2}$ |
| ExM-2 | 0.25 |
| ExM-3 | $1.5 \times 10^{-2}$ |
| ExY-1 | $4.0 \times 10^{-2}$ |
| Cpd-11 | $9.0 \times 10^{-3}$ |
| Solv-1 | 0.20 |

Layer 9: High-speed green-sensitive emulsion layer

| | |
|---|---|
| Silver bromoiodide emulsion (AgI: 7 mol %; equivalent-sphere diameter: 0.6 μm; coefficient of variation in equivalent-sphere diameter: 19%; twinned grains; diameter/thickness: 5.5) | coating amount of silver 0.50 |
| Gelatin | 0.90 |
| ExS-4 | $2.0 \times 10^{-4}$ |
| ExS-5 | $2.0 \times 10^{-4}$ |
| ExS-6 | $2.0 \times 10^{-5}$ |
| ExS-7 | $3.0 \times 10^{-4}$ |
| ExM-1 | $1.0 \times 10^{-2}$ |
| ExM-4 | $3.9 \times 10^{-2}$ |
| ExM-5 | $2.6 \times 10^{-2}$ |
| Cpd-2 | $1.0 \times 10^{-2}$ |
| Cpd-9 | $2.0 \times 10^{-4}$ |
| Cpd-10 | $2.0 \times 10^{-4}$ |
| Solv-1 | 0.20 |
| Solv-2 | $5.0 \times 10^{-2}$ |

Layer 10: Yellow filter layer

| | |
|---|---|
| Gelatin | 0.50 |
| Yellow colloid | $5.0 \times 10^{-2}$ |
| Cpd-1 | 0.20 |
| Solv-1 | 0.15 |

Layer 11: Low-speed blue-sensitive emulsion layer

| | |
|---|---|
| Silver bromoiodide emulsion (AgI: 4 mol %; equivalent-sphere diameter: 0.5 μm; coefficient of variation in equivalent-sphere diameter: 15%; octahedral grains) | coating amount of silver 0.50 |
| Gelatin | 1.00 |
| ExS-8 | $2.0 \times 10^{-4}$ |
| ExY-1 | 0.13 |
| ExY-3 | 0.90 |
| Cpd-2 | $1.0 \times 10^{-2}$ |
| Solv-1 | 0.30 |

Layer 12: High-speed blue-sensitive emulsion layer

| | |
|---|---|
| Silver bromoiodide emulsion (AgI: 6 mol %; equivalent-sphere diameter: 0.8 μm; coefficient of variation in equivalent-sphere diameter: 15%; aspect ratio: 5.0) | coating amount of silver 0.50 |
| Gelatin | 1.20 |
| ExS-8 | $1.0 \times 10^{-4}$ |
| ExY-1 | 0.012 |
| ExY-3 | 0.12 |
| Cpd-2 | $1.0 \times 10^{-3}$ |
| Solv-1 | $4.0 \times 10^{-2}$ |

Layer 13: First protective layer

| | |
|---|---|
| Fine grain silver bromoiodide (average grain size: 0.07 μm; AgI: 1 mol %) | 0.20 |
| Gelatin | 0.50 |
| UV-2 | 0.10 |
| UV-3 | 0.10 |
| UV-4 | 0.20 |
| Solv-3 | $4.0 \times 10^{-2}$ |
| P-2 | $9.0 \times 10^{-2}$ |

Layer 14: Second protective layer

| | |
|---|---|
| Gelatin | 0.40 |
| B-1 (diameter: 1.5 μm) | 0.10 |

-continued

| | |
|---|---|
| B-2 (diameter: 1.5 μm) | 0.10 |
| B-3 | $2.0 \times 10^{-2}$ |
| H-1 | 0.40 |

Further, all layers of Sample 101 contained Cpd-3, cpd-5, Cpd-6, Cpd-7, Cpd-8, P-1, W-1, W-2, and w-3 were added in order to improve storage stability, readily processed, resistant to pressure, antibacterial and antifungal, protection against electrical charging, and coating.

In addition of them, n-butyl-p-hydroxybenzoate was added. Furthermore, B-4, F-1, F-4, F-5, F-6, F-7, F-8, F-9, F-10, F-11, iron salt, lead salt, gold salt, platinum salt, iridium slat, and rohdium salt are were added.

(Samples 102 to 119)

Samples 102 to 119 were prepared by preplacing the emulsion 1 in the fifth layer of Sample 101 with emulsion 2 to 19 respectively.

(Samples 120 to 138)

Samples 120 to 138 were prepared by replacing (CB-18) in the layers 4 and 5 in Sample 101 to 119 with comparative compound C-1.

Samples 101 to 138, thus prepared, were exposed imagewise to white light. Then, they were carried out following development procedure. The relative sensitivity and gamma value of each sample were evaluated, the former being the relative value of logarithm of the reciprocal of the exposure amount which achieved cyan density of fog+0.3, and the latter being the slope of the line connecting two cyan densities of fog+0.3 and fog+1.3. The results were shown in the following Table 3. The RMS value (i.e., cyan image value at aperture of 48 μm) of each sample, which represents the graininess of the sample is also shown in Table 3.

The sharpness was also measured by MTF method which is in common use, in accordance with said process. Further, Samples 101 to 138 were uniformly exposed to green light at 1 lux.sec, then exposed imagewise to red light, and color-developed by the method shown in below. The color turbidity of each sample was measured by subtracting the magenta density where the cyan density is fog density from the magenta density at the exposure achieved a cyan density of fog+1.0. The MTF values and color turbidities of Samples 101 to 138, thus measured, are also shown in Table 3.

Samples 101 to 138 were subjected to imagewise white exposure in the same way as described above and then were allowed to stand for 7 days at 40° C. and relative humidity of 40%. Samples 101 to 138 were then color-developed, and their sensitivities were measured, thus determining the sensitivity change of each sample. This sensitivity change is also shown in Table 3.

In color development of Samples 101 to 138 were used an automatic developing machine, and proceeding by method described below, until the quantity of replenisher reached three times the volume of the mother solution tank.

Processing Method

| Process | Time | Temp. | Quantity of replesnisher | Tank volume |
|---|---|---|---|---|
| Color development | 2 min. 45 sec. | 38° C. | 45 ml | 10 l |
| Bleaching | 1 min. 00 sec. | 38° C. | 20 ml | 4 l |
| Bleach-Fixing | 3 min. 15 sec. | 38° C. | 30 ml | 8 l |
| Washing (1) | 40 sec. | 35° C. | — | 4 l |
| Washing (2) | 1 min. 00 sec. | 35° C. | 30 ml | 4 l |
| Stabilization | 40 sec. | 38° C. | 20 ml | 4 l |
| Drying | 1 min. 15 sec. | 55° C. | | |

Note: The quantity of replenisher is per meter of a 35-mm wide sample.

Note: The washing (1) was carried out in counter flow, from the step (2) to the step (1).

The compositions of the solutions used in the color-developing process are as follows:

| (Color Developing Solution) | Mother Solution (g) | Replenisher (g) |
|---|---|---|
| Diethylenetriamine-pentaacete | 1.0 | 1.1 |
| 1-hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-ethyl-N-β-hydroxyethylamino]-2-methylaniline sulfate | 4.5 | 5.5 |
| Water to make | 1.0 l | 1.0 l |
| pH | 10.05 | 10.10 |

(Bleaching Solution): The same solution used for mother solution and replenisher (g)

| | |
|---|---|
| Ammonium ethylene-diaminetetraaceto-ferrate(II) dehydrate | 120.0 |
| Disodium ethylene-diaminetetraacetate | 10.0 |
| Ammonium bromide | 100.0 |
| Ammonium nitrate | 10.0 |
| Bleach accelerator $[(CH_3)_2NCH_2CH_2S]_2.2HCl$ | 0.005 mol |
| Ammonia water (27%) | 15.0 ml |
| Water to make | 1.0 l |
| pH | 6.3 |

(Bleach-Fixing Solution): The same solution used for mother solution and replenisher (g)

| | |
|---|---|
| Ammonium ethylene-diaminetetraaceto-ferrate(II) dehydrate | 50.0 |
| Disodium ethylene-diaminetetraacetate | 5.0 |
| Sodium sulfite | 12.0 |
| Ammonium thiosulfate aqueous solution (70%) | 240.0 ml |
| Ammonia Water (27%) | 6.0 ml |
| Water to make | 1.0 l |
| pH | 7.2 |

(Washing Solution): The same solution used for mother solution and replenisher

The solution was one having been prepared as follows. Tap-water water was passed through a mixed-bed column filled with H-type strongly acidic cation exchange resin (Amberlite IR-120B made by Rohm and Haas, Inc.) and OH-type anion exchange resin (Amberlite IRA-400 made by Rohm and Haas, Inc.), whereby the calcium and magnesium ion concentration of the water was reduced to 3 mg/l or less. Then, 20 mg/l of sodium isocyanuric dichloride and 150 mg/l of sodium sulfate were added to the water thus processed, thereby obtaining the washing solution. The washing solution had pH value ranging from 6.5 to 7.5.

| (Stabilizing Solution): The same solution used for mother solution and replenisher (g) | |
|---|---|
| Formalin (37%) | 2.0 ml |
| Polyoxyethylene-p-monononyl-phenylether (Av. polymerization degree: 10) | 0.3 |
| ethylenediamine-tetraacetic acid disodium salt | 0.05 |
| Water to make | 1.0 l |
| pH | 0.5 to 8.0 |

EXAMPLE 2

Sample 201 was prepared by replacing the emulsion in layer 9 of sample 103 with emulsion 3, and adding (CB-18) of 0.007 g/m$^2$, 0.011 g/m$^2$ and 0.012 g/m$^2$ to layers 7, 8 and 9, respectively.

Samples 202 to 209 were prepared by replacing (CB-18) in layers 4, 5, 7, 8 and 9 of Sample 201 with other compounds of the present invention and comparative compounds.

Samples 210 to 218 were prepared by replacing emulsion 3 in layers 5 and 9 of Samples 201 to 209 with emulsion 17, respectively.

TABLE 3

| Sample | Emulsion in layer 5 | Compounds in layers 4 and 5 | Relative sensitivity | Gamma | RMS value × 1000 | MTF value × 100 | Color turbidity | Change in sensitivity under forced deterioration |
|---|---|---|---|---|---|---|---|---|
| 101 (Invention) | 1 | CB-18 | 0.00 | 0.70 | 21.5 | 61 | −0.12 | 0.02 |
| 102 (Invention) | 2 | " | 0.00 | 0.71 | 21.8 | 61 | −0.12 | 0.02 |
| 103 (Invention) | 3 | " | 0.01 | 0.71 | 22.1 | 61 | −0.12 | 0.03 |
| 104 (Invention) | 4 | " | 0.01 | 0.71 | 22.3 | 61 | −0.12 | 0.04 |
| 105 (Invention) | 5 | " | 0.02 | 0.72 | 24.0 | 60 | −0.11 | 0.06 |
| 106 (Invention) | 6 | " | −0.05 | 0.66 | 24.5 | 57 | −0.08 | 0.05 |
| 107 (Invention) | 7 | " | −0.04 | 0.66 | 24.4 | 57 | −0.08 | 0.05 |
| 108 (Invention) | 8 | " | −0.03 | 0.67 | 24.1 | 58 | −0.09 | 0.05 |
| 109 (Invention) | 9 | " | −0.02 | 0.68 | 24.0 | 58 | −0.09 | 0.09 |
| 110 (Invention) | 10 | " | 0.00 | 0.69 | 22.0 | 61 | −0.12 | 0.04 |
| 111 (Invention) | 11 | " | −0.01 | 0.69 | 22.3 | 60 | −0.12 | 0.05 |
| 112 (Invention) | 12 | CB-18 | −0.01 | 0.69 | 21.9 | 61 | −0.11 | 0.05 |
| 113 (Invention) | 13 | " | −0.01 | 0.68 | 22.2 | 60 | −0.11 | 0.05 |
| 114 (Invention) | 14 | " | −0.04 | 0.65 | 24.7 | 58 | −0.08 | 0.08 |
| 115 (Comp.) | 15 | " | −0.16 | 0.58 | 26.0 | 52 | −0.04 | 0.06 |
| 116 (Comp.) | 16 | " | −0.15 | 0.60 | 26.2 | 53 | −0.04 | 0.06 |
| 117 (Comp.) | 17 | " | −0.13 | 0.61 | 26.3 | 53 | −0.05 | 0.07 |
| 118 (Comp.) | 18 | " | −0.10 | 0.62 | 26.5 | 54 | −0.06 | 0.07 |
| 119 (Comp.) | 19 | " | −0.08 | 0.64 | 26.8 | 55 | −0.07 | 0.07 |
| 120 (Comp.) | 1 | C-1 | −0.01 | 0.69 | 21.8 | 55 | −0.05 | 0.02 |
| 121 (Comp.) | 2 | " | −0.01 | 0.69 | 22.1 | 55 | −0.05 | 0.02 |
| 122 (Comp.) | 3 | " | 0.00 | 0.70 | 22.3 | 55 | −0.05 | 0.03 |
| 123 (Comp.) | 4 | C-1 | 0.00 | 0.70 | 22.5 | 55 | −0.05 | 0.04 |
| 124 (Comp.) | 5 | " | 0.01 | 0.71 | 24.3 | 54 | −0.04 | 0.06 |
| 125 (Comp.) | 6 | " | −0.06 | 0.65 | 24.7 | 52 | −0.02 | 0.04 |
| 126 (Comp.) | 7 | " | −0.05 | 0.66 | 24.6 | 53 | −0.02 | 0.05 |
| 127 (Comp.) | 8 | " | −0.04 | 0.66 | 24.3 | 53 | −0.03 | 0.05 |
| 128 (Comp.) | 9 | " | −0.03 | 0.67 | 24.3 | 53 | −0.03 | 0.08 |
| 129 (Comp.) | 10 | " | −0.01 | 0.68 | 22.3 | 56 | −0.05 | 0.03 |
| 130 (Comp.) | 11 | " | −0.02 | 0.68 | 22.6 | 55 | −0.05 | 0.04 |
| 131 (Comp.) | 12 | " | −0.02 | 0.67 | 22.2 | 55 | −0.04 | 0.04 |
| 132 (Comp.) | 13 | " | −0.02 | 0.67 | 22.5 | 55 | −0.04 | 0.04 |
| 133 (Comp.) | 14 | " | −0.04 | 0.64 | 25.0 | 53 | −0.02 | 0.07 |
| 134 (Comp.) | 15 | C-1 | —0.16 | 0.58 | 26.2 | 48 | 0.00 | 0.05 |
| 135 (Comp.) | 16 | " | −0.15 | 0.60 | 26.4 | 49 | 0.00 | 0.05 |
| 136 (Comp.) | 17 | " | −0.13 | 0.60 | 26.5 | 49 | −0.01 | 0.06 |
| 137 (Comp.) | 18 | " | −0.11 | 0.61 | 26.7 | 50 | −0.01 | 0.06 |
| 138 (Comp.) | 19 | " | −0.09 | 0.63 | 27.0 | 51 | −0.02 | 0.07 |

As is evident from Table 3, the samples of the invention had high sensitivities, and excelled in graininess indicated as their RMS values, in sharpness indicated as their MTF values, and in color reproduction indicated as their color turbidities. In addition, they underwent slight changes in their photographic properties, though they had been placed under severe conditions after exposure until development. As can be understood from the properties of the samples of the invention, it is preferable that a light-sensitive material have a distinct stratiform structure, be formed by emulsions which silver iodide content is 7 mol % or more, contain the compound represented by the formula (A), and incleased monodispersibility of the emulsion.

Samples 201 to 218 were tested for their photographic properties, in the same way as Samples 101 to 138 of Example 1, except that cyan density was replaced by magenta density, magenta density by yellow density, and red light by green light, and green light by blue light. The results of the test were as is represented in the following Table 4.

TABLE 4

| Sample | Emulsion in layers 5 and 9 | Emulsion in layers 4, 5, 7, 8 and 9 | Relative sensitivity | Gamma | RMS value × 1000 | MTF value × 100 | Color turbidity |
|---|---|---|---|---|---|---|---|
| 201 (Invention) | 3 | CB-18 | 0.00 | 0.65 | 22.5 | 65 | −0.09 |
| 202 (Invention) | 3 | CB-16 | 0.00 | 0.65 | 22.6 | 65 | −0.09 |
| 203 (Invention) | 3 | CB-4 | 0.01 | 0.64 | 22.5 | 64 | −0.08 |
| 204 (Invention) | 3 | CB-3 | 0.01 | 0.65 | 22.6 | 64 | −0.08 |
| 205 (Invention) | 3 | CA-3 | −0.01 | 0.63 | 22.3 | 64 | −0.07 |
| 206 (Comp.) | 3 | C-1 | −0.02 | 0.63 | 23.0 | 59 | −0.01 |
| 207 (Comp.) | 3 | C-2 | −0.03 | 0.64 | 22.8 | 60 | −0.04 |
| 208 (Comp.) | 3 | C-3 | −0.01 | 0.65 | 22.9 | 60 | −0.03 |
| 209 (Comp.) | 3 | C-4 | −0.01 | 0.64 | 23.0 | 59 | −0.03 |
| 210 (Comp.) | 17 | CB-18 | −0.10 | 0.60 | 26.0 | 58 | −0.02 |
| 211 (Comp.) | 17 | CB-16 | −0.10 | 0.60 | 26.1 | 57 | −0.02 |
| 212 (Comp.) | 17 | CB-4 | −0.09 | 0.59 | 26.0 | 57 | −0.02 |
| 213 (Comp.) | 17 | CB-3 | −0.09 | 0.60 | 26.1 | 57 | −0.02 |
| 214 (Comp.) | 17 | CA-3 | −0.11 | 0.59 | 25.9 | 57 | −0.02 |
| 215 (Comp.) | 17 | C-1 | −0.11 | 0.59 | 26.4 | 53 | 0.02 |
| 216 (Comp.) | 17 | C-2 | −0.11 | 0.60 | 26.3 | 53 | 0.00 |
| 217 (Comp.) | 17 | C-3 | −0.09 | 0.60 | 26.3 | 53 | 0.00 |
| 218 (Comp.) | 17 | C-4 | −0.09 | 0.59 | 26.3 | 53 | 0.00 |

As is evident from Table 4, the samples using the compounds and emulsion of the invention not only exhibited high sensitivities, but also excelled in graininess, sharpness and color reproduction.

The compounds used in Examples 1 and 2 will be shown below:

C-1 (Compound T-1 in JP-A-2-230139)

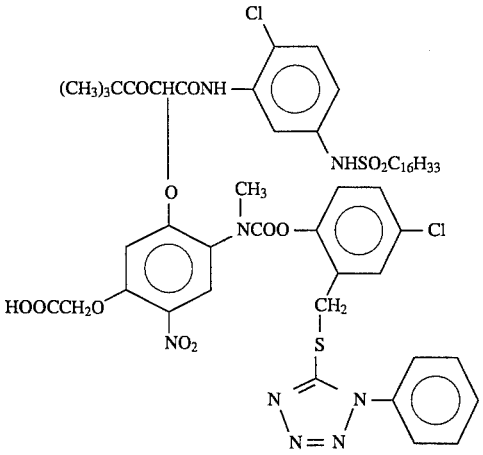

-continued
C-2 (Compound 1 in JP-A-60-218645)
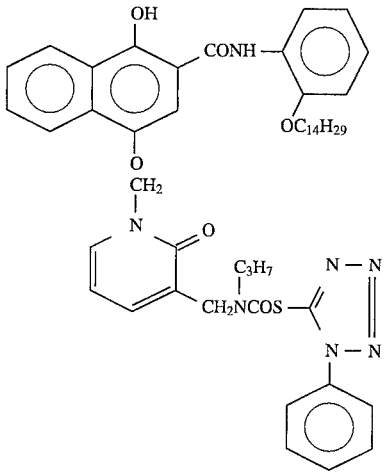
C-3 (Compound 6 in JP-A-63-37346)
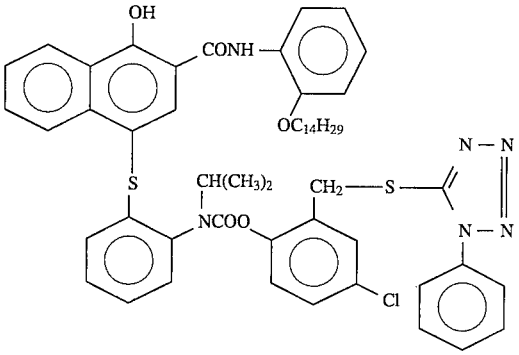
C-4 (Compound 3 in JP-A-1-280755)
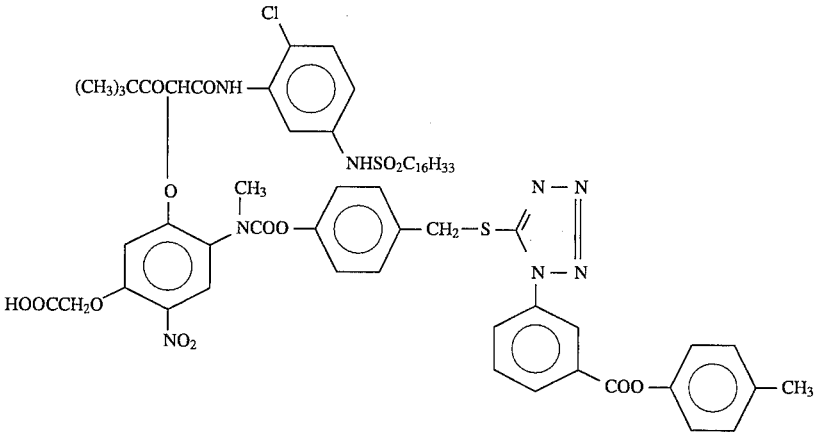
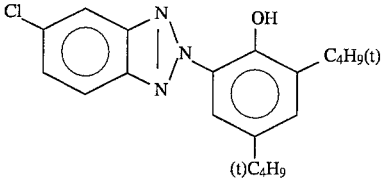
UV-1

-continued
UV-2
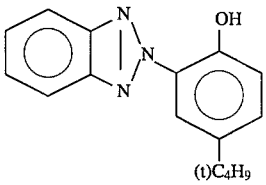
UV-3
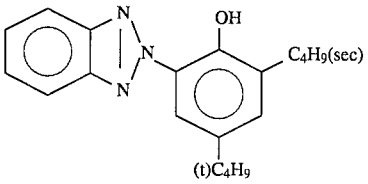
UV-4
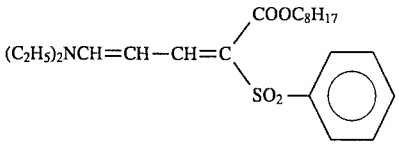
ExF-1
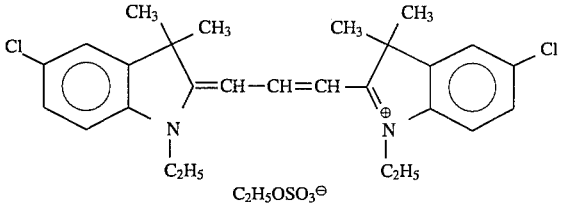
ExC-1
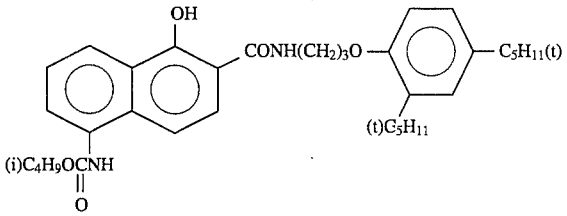
ExC-2
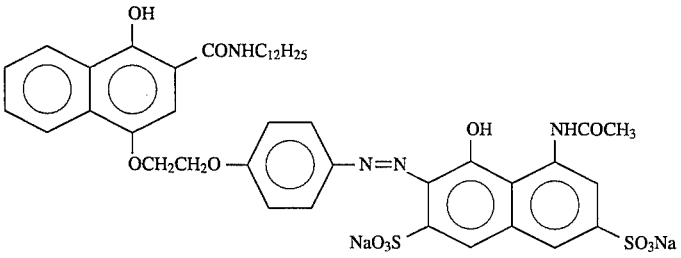
ExC-3
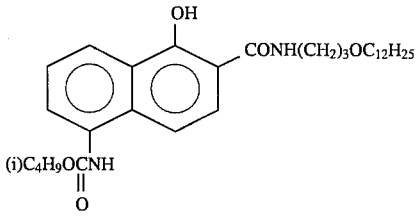

-continued
ExC-4
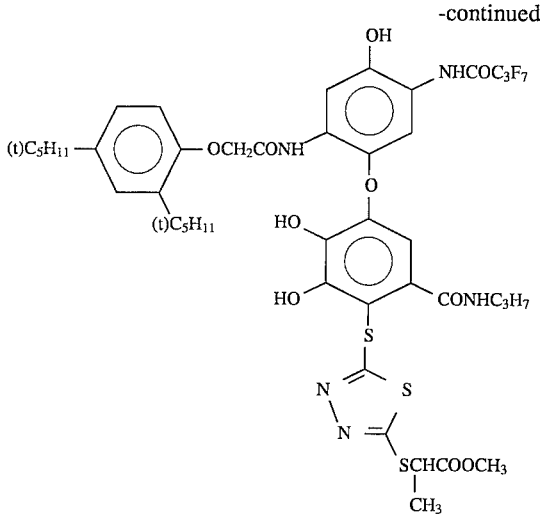
ExC-5
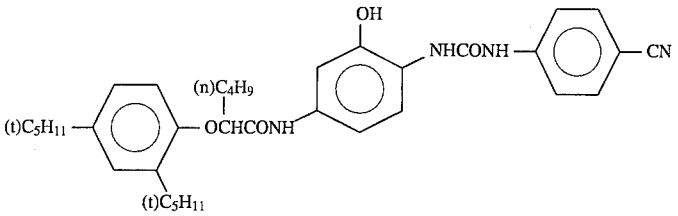
ExC-6
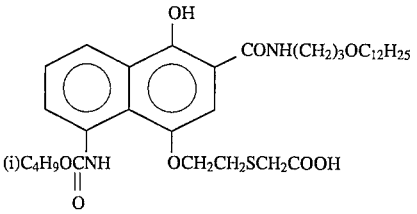
ExC-7
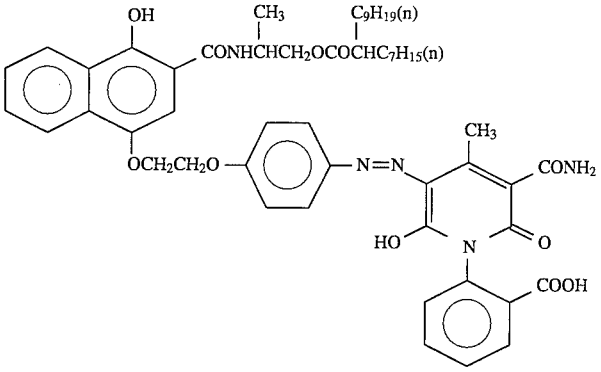
ExM-1
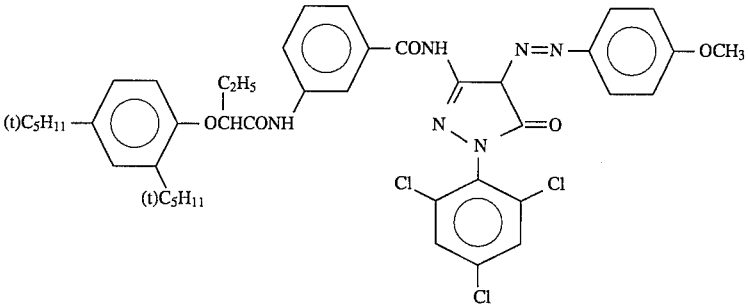

-continued
ExM-2
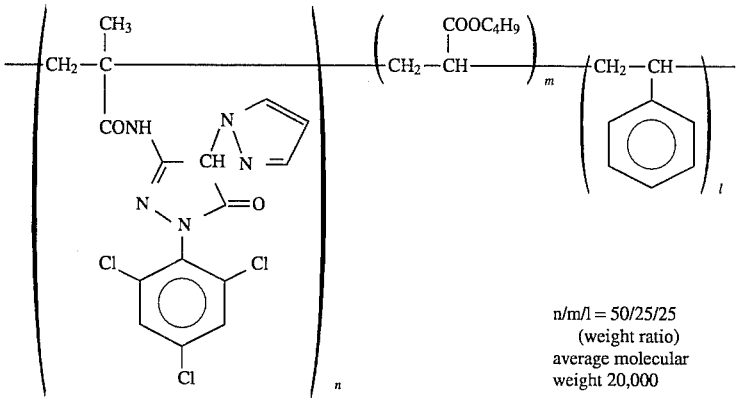
n/m/l = 50/25/25
(weight ratio)
average molecular
weight 20,000
ExM-3
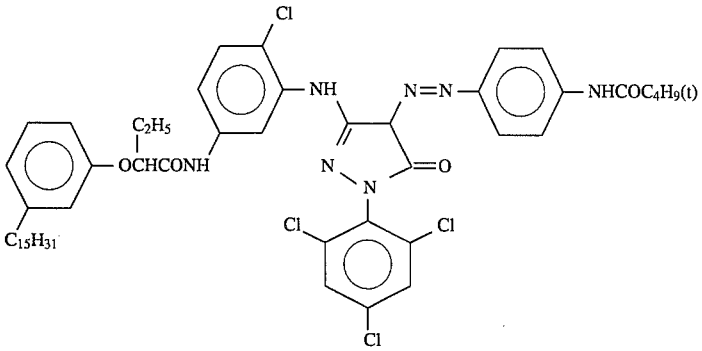
ExM-4
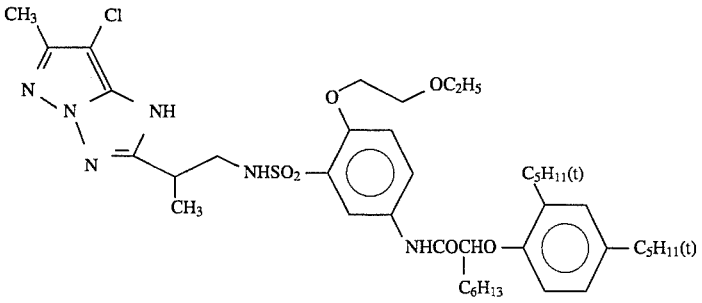
ExM-5
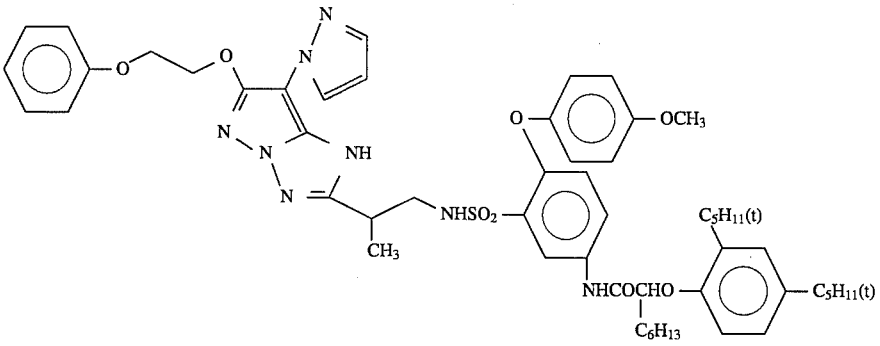
ExY-1
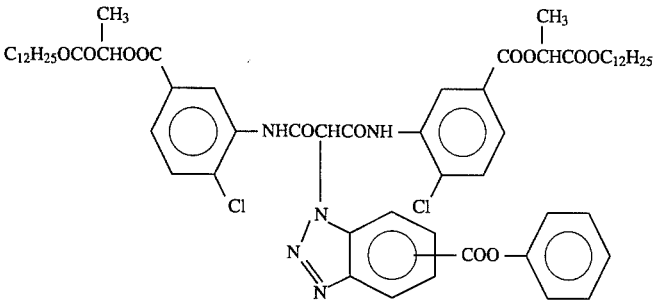

-continued
ExY-2
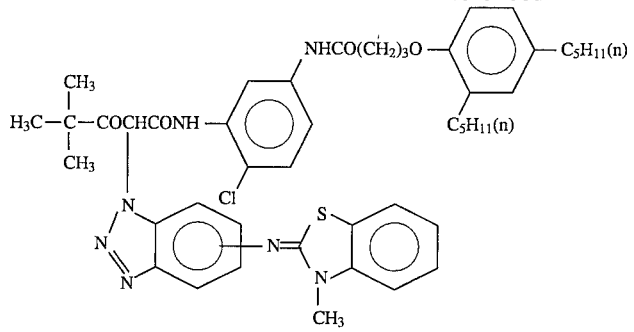
ExY-3
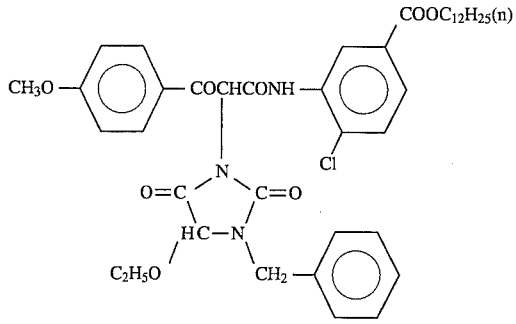
Cpd-1
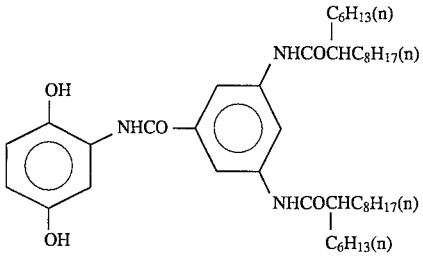
Cpd-2
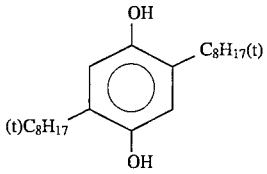
Cpd-3
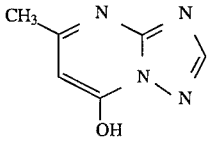
Cpd-4
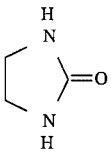
Cpd-5
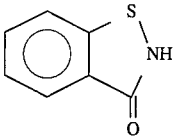
Cpd-6
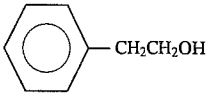

-continued
Cpd-7
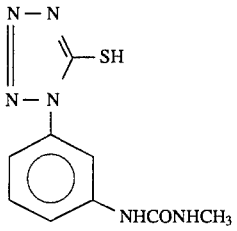
Cpd-8
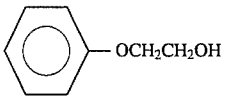
Cpd-9
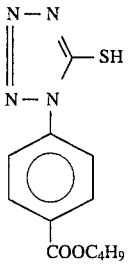
Cpd-10
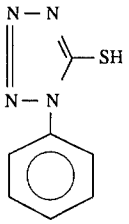
Cpd-11
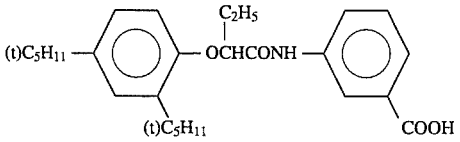
ExS-1
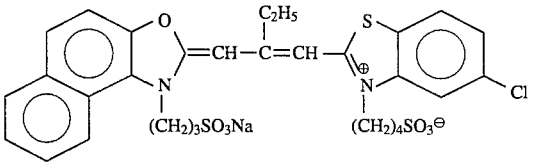
ExS-2
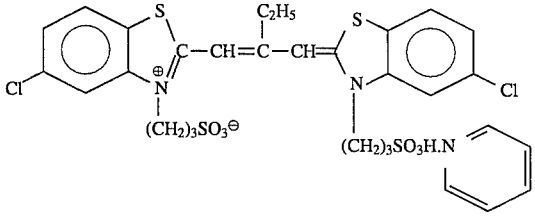
ExS-3
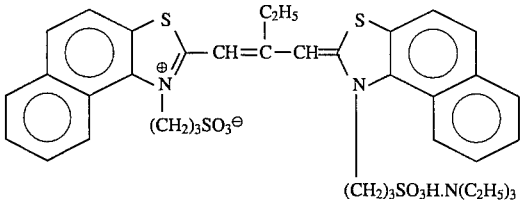

-continued
ExS-4
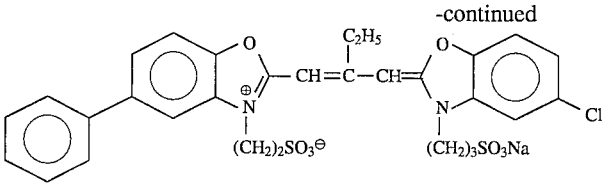
ExS-5
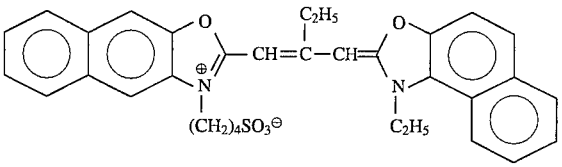
ExS-6
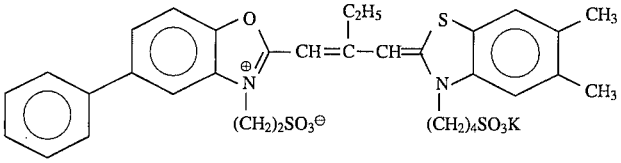
ExS-7
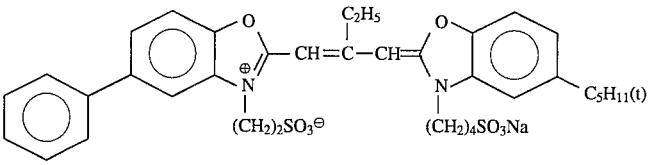
ExS-8
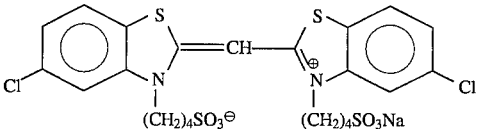
B-1
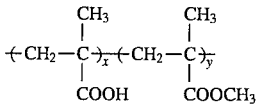
x/y = 10/90
B-2
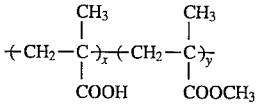
x/y = 40/60
B-3
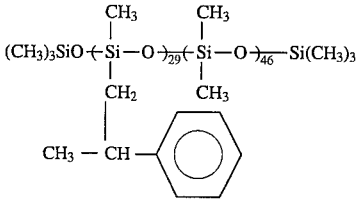
B-4
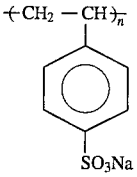
H-1
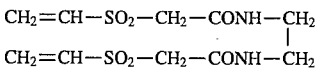
W-1
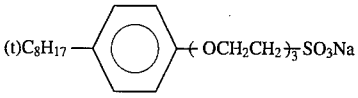

-continued

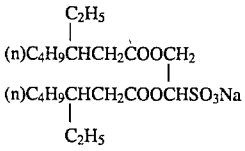

W-2

$C_8F_{17}SO_2N(C_3H_7)CH_2COOK$ W-3

Copolymer of vinylpyrrolidone and vinylalcohol (copolymerization ratio = 70:30 [weight ratio] (average molecular weight 10,000) P-1 polyethylacrylate P-2

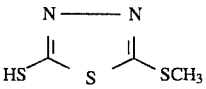

F-1

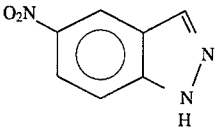

F-4

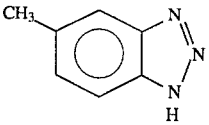

F-5

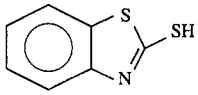

F-6

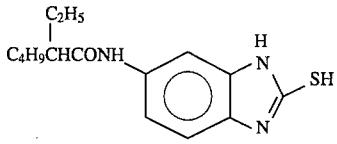

F-7

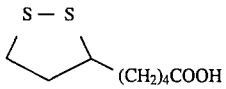

F-8

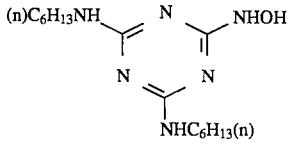

F-9

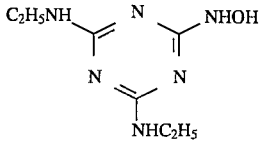

F-10

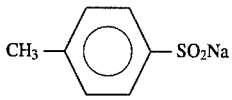

F-11

What is claimed is:

1. A silver halide color photographic light-sensitive material which comprises a support and at least one light-sensitive emulsion layer on the support, wherein the emulsion layer contains silver halide grains having a lower silver iodide content on their surfaces than average silver iodide content of the grains, and wherein at least one emulsion layer contains a compound represented by the following formula (Ia) or (Ib) and/or a compound represented by the following formula (III) or (IV)

Formula (Ia)

$$A—(L_1)_j—W—(Z_1(R_{11})_x=Z_2(R_{12})_y)_t—CH_2\text{-}PUG$$

Formula (Ib)

$$A—(L_1)—N—(Z_3\text{-PUG})_2$$

wherein A is a coupler residue or a redox group, W is an oxygen, a sulfur or tertiary amino group (—$NR_{13}$)—, $R_{11}$ and $R_{12}$ are independently a hydrogen or a substituent group and at least one of $R_{11}$ and $R_{12}$ represents —$CH_2$-PUG, —$CH_2$-PUG is bonded to a position in which PUG can be released by electron transfer, when the bonding between A—$(L_1)_j$— and W is cleaved, $R_{13}$ is a substituent group, $L_1$ is a divalent timing group, PUG is a photographically useful group, and j indicates 0, 1, or 2; $R_{11}$, $R_{12}$, and W can bond together to form a benzene ring or a heterocyclic ring; $Z_1$ and $Z_2$ are independently a carbon or a nitrogen; x and y are 0 or 1, x being 0 if $Z_1$ is a carbon atom but both x and y cannot be 0 at the same time and when only one of $R_{11}$ and $R_{12}$ is present, said only one of $R_{11}$ and $R_{12}$ represents —$CH_2$-PUG; $Z_2$ and y have the same relation as $Z_1$ and x; t is 1 or 2; and if t is 2, the two groups can either be identical or different; $Z_3$ is a substituted or unsubstituted methylene group, and two groups $Z_3$ can either be identical or different and can bond together to form a ring;

Formula (III)

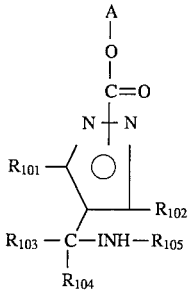

wherein A is a coupler residue or a redox group; $R_{101}$ and $R_{102}$ are independently a hydrogen or a substituent group; $R_{103}$ and $R_{104}$ are independently a hydrogen or a substituent group; INH is a group which can inhibit development; $R_{105}$ is an unsubstituted phenyl or primary alkyl group, or a primary alkyl group substituted by a group other than an aryl group; and at least one of groups $R_{101}$ to $R_{104}$ is a substituent group other than a hydrogen;

Formula (IV)

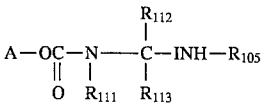

wherein A, INH, and $R_{105}$ have the same definition as in formula (III); $R_{111}$, $R_{112}$, and $R_{113}$ are independently a hydrogen or an organic residual group; and any two of $R_{111}$, $R_{112}$, and $R_{113}$ can be divalent groups forming a ring by bonding together.

2. A silver halide color photographic light-sensitive material according to claim 1, wherein residual groups which are the groups other than those represented by A and PUG in the formulas (Ia) and (Ib) have a formula weight of 64 to 240.

3. A silver halide color photographic light-sensitive material according to claim 1, which contains a compound represented by the following formula (A):

Formula (A)

$$Q—SM^1$$

wherein Q is a heterocyclic residual group having at least one group selected from the group consisting of —$SO_3M^2$, —$COOM^2$, —OH and —$NR^1R^2$, the group being directly or indirectly bonded to the heterocyclic residual group; $M^1$ and $M^2$ are independently a hydrogen, alkali metal, quarternary ammonium, or quaternary phosphonium; $R^1$ and $R^2$ are hydrogen atoms or substituted or unsubstituted alkyl groups.

4. A silver halide color photographic light-sensitive material according to claim 1, wherein said emulsion layer comprises silver halide grains wherein the grains have a distinct stratiform structure made of silver bromoiodide containing 15 to 45% of silver iodide, and said grains are chemically sensitized silver halide grains having an average silver bromoiodide content of more than 7 mol %.

5. A silver halide color photographic light-sensitive material according to claim 1, wherein said emulsion is a monodisperse emulsion having a coefficient of variation of 0.25 or less with respect to grain size of silver halide grains.

6. A silver halide color photographic light-sensitive material according to claim 1, wherein said emulsion comprises silver halide grains whose relative standard deviation of silver iodide content is 30% or less.

7. A silver halide color photographic light-sensitive material according to claim 1, wherein two or more silver halide emulsions of the type defined in claim 1, or a silver halide emulsion of the type defined in claim 1 and a silver halide emulsion of another type are contained in a same light-sensitive layer.

8. A silver halide color photographic light-sensitive material according to claim 4, wherein two or more silver halide emulsions of the type defined in claim 4, or a silver halide emulsion of the type defined in claim 4 and a silver halide emulsion of another type are contained in a same light-sensitive layer.

9. A silver halide color photographic light-sensitive material according to claim 5, wherein two or more silver halide emulsions of the type defined in claim 5, or a silver halide emulsion of the type defined in claim 5 and a silver halide emulsion of another type are contained in a same light-sensitive layer.

10. A silver halide color photographic light-sensitive material according to claim 6, wherein two or more silver halide emulsions of the type defined in claim 6, or a silver halide emulsion of the type defined in claim 6 and a silver halide emulsion of another type are contained in a same light-sensitive layer.

11. A silver halide color photographic light-sensitive material according to claim 1, which contains the compound represented by the formula (Ia).

12. A silver halide color photographic light-sensitive material according to claim 1, wherein PUG is a development inhibitor.

13. A silver halide color photographic light-sensitive material according to claim 1, wherein, in the formula (Ia), all PUGs are identical and are development inhibitors.

14. A silver halide color photographic light-sensitive material according to claim 1, wherein said emulsion is a monodisperse emulsion having a coefficient of variation of 0.20 or less with respect to grain size of silver halide grains.

15. A silver halide color photographic light-sensitive material according to claim 14, wherein said emulsion is a monodisperse emulsion having a coefficient of variation of 0.15 or less with respect to grain size of silver halide grains.

* * * * *